US005744292A

United States Patent [19]

Yoneyama

[11] Patent Number: 5,744,292

[45] Date of Patent: Apr. 28, 1998

[54] SILVER HALIDE PHOTOGRAPHIC LIGHT-SENSITIVE MATERIAL CONTAINING A DISPERSION OF SOLID FINE GRAINS

[75] Inventor: Hiroyuki Yoneyama, Minami-ashigara, Japan

[73] Assignee: Fuji Photo Film Co., Ltd., Kanagawa-ken, Japan

[21] Appl. No.: 593,373

[22] Filed: Jan. 29, 1996

[30] Foreign Application Priority Data

Jan. 30, 1995 [JP] Japan ..... 7-031872

[51] Int. Cl.[6] ..... G03C 1/815; G03C 1/875

[52] U.S. Cl. ..... 430/510; 430/517; 430/522; 430/531; 430/546; 430/631; 430/627; 430/629; 430/527

[58] Field of Search ..... 430/510, 517, 430/522, 531, 546, 631, 627, 629, 527

[56] References Cited

U.S. PATENT DOCUMENTS

| | | | |
|---|---|---|---|
| 5,213,957 | 5/1993 | Adachi | 430/522 |
| 5,232,825 | 8/1993 | Hattori et al. | 430/517 |
| 5,344,749 | 9/1994 | Kiekens et al. | 430/522 |
| 5,346,810 | 9/1994 | Ohno et al. | 430/522 |
| 5,360,702 | 11/1994 | Zengerle et al. | 430/546 |
| 5,453,352 | 9/1995 | Tachibana | 430/546 |
| 5,468,598 | 11/1995 | Miller et al. | 430/531 |
| 5,609,999 | 3/1997 | Aida et al. | 430/517 |

FOREIGN PATENT DOCUMENTS

| | | |
|---|---|---|
| 0323729 | 7/1989 | European Pat. Off. . |
| 4-324858 | 11/1992 | Japan . |
| 5-216166 | 8/1993 | Japan . |
| 5-313307 | 11/1993 | Japan . |

*Primary Examiner*—Geraldine Letscher

*Attorney, Agent, or Firm*—Birch, Stewart, Kolasch & Birch, LLP

[57] ABSTRACT

There is disclosed a silver halide photographic light-sensitive material that comprises, in at least one photographic layer constituting the material, a dispersion containing fine grains of a solid dye represented by the following general formula (II), wherein the solid dye has been subjected to heat treatment at 40° C. or higher, and wherein the dispersion further contains a specific water-soluble or water-dispersible polymer-compound that has a hydrophobic group bonding at a terminal of a copolymer of vinyl alcohol and vinyl ester:

$$D\leftarrow X)_y \qquad \text{formula (II)}$$

wherein D represents a residue of a compound having a chromophoric group; X represents a dissociating hydrogen atom, or a group having a dissociating hydrogen atom, which atom or group connects to the D directly or via a divalent connecting group; and y is an integer of 1 to 7. The photographic light-sensitive material prevents any change of viscosity with the lapse of time due to the dye in a state of dispersion solution containing fine grains of the dye. The material does not cause any change of absorption spectral due to the dispersion solution containing the fine grains.

11 Claims, No Drawings

SILVER HALIDE PHOTOGRAPHIC LIGHT-SENSITIVE MATERIAL CONTAINING A DISPERSION OF SOLID FINE GRAINS

FIELD OF THE INVENTION

The present invention relates to a silver halide photographic light-sensitive material that can simplify processing-processes and reduce a load caused by replenishment of the processing solution, by making the material contain a dispersion of dye in the form of solid fine grains. Particularly, the present invention relates to such the silver halide photographic light-sensitive material containing a dispersion of dye in the form of solid fine grains which does not cause any change of its absorption spectral and does not increase its viscosity with the lapse of time in the state of a dispersion solution to be supplied for a coating, and whose dyes do not migrate through hydrophilic colloid layers during a storage of the obtained light-sensitive material, and are photochemically inactive, and further have excellent light absorption characteristics, and moreover can be decolored and/or eluted in order not to cause a stain due to a remaining color at the time of developing processes.

BACKGROUND OF THE INVENTION

In the technical field of the silver halide photographic light-sensitive material, coloring of its photographic emulsion layers or other hydrophilic colloid layers has been conventionally conducted for the purpose of the light absorption at the specific wavelength region. Such the colored layer is called a filter layer, an antihalation layer, a crossover-cut filter layer, or so on, depending on its purpose. Further, photographic emulsion layers have been colored in order to prevent irradiation.

Hitherto, as these colored layers, a resin layer containing carbon black has been coated on the back surface of a transparent support in order to prevent halation, or a filter layer and an antihalation layer each using a yellow or black colloidal silver have been coated on a support.

In the case where a resin layer containing carbon black is used, an additional step to remove the resin layer is necessary, and further a load necessary for processing a black waste containing carbon black is heavy. On the other hand, in the case where the colloidal silver is used, a total silver amount of the silver halide photographic light-sensitive material increases, so that a load of a bleach bath, a fix bath or a bleach-fix bath necessary for removing the colloidal silver becomes heavier. Therefore it is necessary to keep a replenishment amount of such the processing solution at a high level. Further, when the colloidal silver is used in a layer adjacent to a layer containing a coupler, sometimes a fog is formed. Furthermore, for a cinematographic color positive film in particular, the colloidal silver cannot be used because a silver image is used for a soundtrack.

As a method for resolving problems of the previous methods, is proposed a method of coloring a specific layer by the use of a dispersion of water-insoluble dye in the form of solid fine grains, as disclosed, for example, in JP-A ("JP-A" means unexamined published Japanese patent application) No. 120030/1980, ibid. 12639/1981, ibid. 155350/1980, ibid. 155351/1980, ibid. 27838/1988, ibid. 197943/1988, ibid. 92716/1977, ibid. 40827/1989, ibid. 282244/1990, EP-A-015601, ibid. 323729, ibid. 274723, ibid. 276566, ibid. 299435, and PCT WO 88/04794.

With respect to the dispersion of such the dye in the form of solid fine grains, the dye has a dissociating hydrogen atom in its molecule, and a solid state and a decoloring of the dye in a hydrophilic colloid layer are controlled by the dependency of dissociation on pH.

JP-A-216166/1993 and ibid. 313307/1993 each describes that acceleration of molecular configuration for the dispersion of dye in the form of solid fine grains, e.g., heat treatment, is conducted in order to hold the dye at the colored layer without diffusion to other layers, and that as a result, reduction of sensitivity due to optical and chemical function to a silver halide emulsion can be improved, while avoiding reduction of film strength.

However, it was found that these previous methods using the dispersion of dye in the form of solid fine grains had such the problems that viscosity of the solid fine grained dispersion remarkably increases with the lapse of time, and that absorption spectrum of the silver halide color photographic light-sensitive material obtained by coating the dispersion varies depending on the storage time of the used solid fine grained dispersion.

SUMMARY OF THE INVENTION

A purpose of the present invention is to provide a silver halide photographic light-sensitive material that has overcome the drawbacks in previous dispersions of dye in the form of solid fine grains, i.e., a silver halide photographic light-sensitive material that has minimized a change of absorption spectrum variable by a solid fine grained dispersion to be used, by means of preventing the solid fine grained dispersion from a change of viscosity with the lapse of time.

Another purpose of the present invention is to provide a silver halide photographic light-sensitive material containing a solid fine-grained dispersion of dye, which material has a colored layer that is photochemically inactive, and which material has excellent absorption characteristics, and the material moreover can be easily decolored at the time of developing processes, while the material having improved film strength.

Other and further objects, features, and advantages of the invention will appear more fully from the following description.

DETAILED DESCRIPTION OF THE INVENTION

The above-described purposes of the present invention have been accomplished by the photographic composition described below and by a silver halide photographic light-sensitive material containing the same in any of photographic layers constituting the material.

(1) A composition for a silver halide photography, which composition comprises a dispersion containing fine grains of a solid dye represented by general formula (II) as illustrated below, wherein the solid dye represented by the above-described general formula (II) has been subjected to heat treatment at 40° C. or higher, and wherein the dispersion further contains a compound represented by general formula (I) as illustrated below:

$$D\leftarrow X)_y \qquad \text{formula (II)}$$

wherein D represents a residue of a compound having a chromophoric group; X represents a dissociating hydrogen atom, or a group having a dissociating hydrogen atom, which atom or group connects to the D directly or via a divalent connecting group; and y is an integer of 1 to 7:

$$P\text{-}(S)_m\text{-}R)_n$$ formula (I)

wherein R represents a hydrogen atom, a hydrophobic group, or a hydrophobic polymer; P contains at least one of the recurring units A, B, and C as illustrated below, and represents a polymer having a polymerization degree of 10 to 3500; m is 0 or 1, and n is 1 or 2:

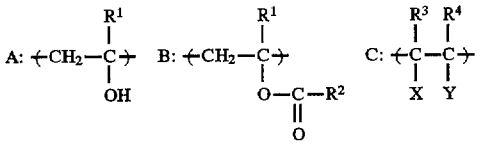

wherein $R^1$ represents a hydrogen atom or an alkyl group having 1 to 6 carbon atom(s); $R^2$ represents a hydrogen atom or an alkyl group having 1 to 10 carbon atom(s); $R^3$ represents a hydrogen atom or a methyl group; $R^4$ represents a hydrogen atom, a methyl group, a $—CH_2COOH$ group (or its ammonium salts or metal salts), or a cyano group; X represents a hydrogen atom, a —COOH group (or its ammonium salts or metal salts), or a $—CONH_2$ group; and Y represents a —COOH group (or its ammonium salts or metal salts), an $—SO_3H$ group (or its ammonium salts or metal salts), an $—OSO_3H$ group (or its ammonium salts or metal salts), a $—CH_2SO_3H$ group (or its ammonium salts or metal salts), a $—CONHC(CH_3)_2CH_2SO_3H$ group (or its ammonium salts or metal salts), or a $—CONHCH_2CH_2CH_2N^+(CH_3)_3Cl^-$ group.

(2) The photographic composition as described in (1), wherein, in general formula (II), the group having a dissociating hydrogen atom is a group having a carboxylic acid group.

(3) The photographic composition as described in (1) or (2), wherein the dye is represented by the following general formula (III) or (IV):

$$A^1=L^1\text{-}(L^2=L^3)_m\text{-}Q$$ formula (III)

wherein $A^1$ represents an acidic nucleus; Q represents an aryl group or a heterocyclic group; $L^1$, $L^2$, and $L^3$ each represent a methine group; and m is 0, 1, or 2, with the proviso that the compound of general formula (III) has 1 to 7 group(s) selected from a group consisting of a carboxylic acid group, a sulfonamide group, a sulfamoyl group, a sulfonylcarbamoyl group, an acylsulfamoyl group, a phenolic hydroxyl group, and an enol group of an oxonol dye, as a water-soluble group in its molecule:

$$A^1=L^1\text{-}(L^2=L^3)_n\text{-}A^2$$ formula (IV)

wherein $A^1$ and $A^2$ each represent an acidic group; $L^1$, $L^2$, and $L^3$ each represent a methine group; and n is 0, 1, 2, or 3, with the proviso that the compound of general formula (IV) has 1 to 7 group(s) selected from a group consisting of a carboxylic acid group, a sulfonamide group, a sulfamoyl group, a sulfonylcarbamoyl group, an acylsulfamoyl group, a phenolic hydroxyl group, and an enol group of an oxonol dye, as a water-soluble group in its molecule.

(4) The photographic composition as described in (1) or (2), wherein the dye is represented by the following general formula (V):

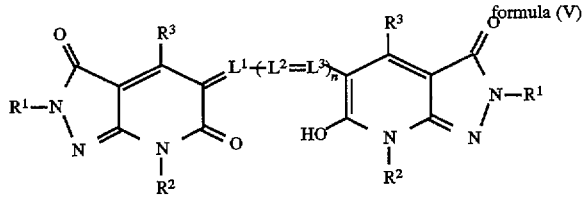

formula (V)

n = 1 or 2 wherein $R^1$ represents a hydrogen atom, an alkyl group, an aryl group, or a heterocyclic group; $R^2$ represents a hydrogen atom, an alkyl group, an aryl group, a heterocyclic group, a $—COR^4$ group, or an $—SO_2R^4$ group; $R^3$ represents a hydrogen atom, a cyano group, a hydroxyl group, a carboxyl group, an alkyl group, an aryl group, a $—CO_2R^4$ group, an $—OR^4$ group, an $—NR^5R^6$ group, a $—CONR^5R^6$ group, an $—NR^5COR^4$ group, an $—NR^5SO_2R^4$ group, or an $—NR^5CONR^5R^6$ group, wherein $R^4$ represents an alkyl group or an aryl group, and wherein $R^5$ and $R^6$ each represent a hydrogen atom, an alkyl group, or an aryl group; $L^1$, $L^2$, and $L^3$ each represent a methine group; and n is 1 or 2.

(5) The photographic composition as described in any of (1) to (4), wherein the dye has already been subjected to heat treatment at 40° C. or higher at a pH of 2.0 to 7.0.

(6) A silver halide photographic light-sensitive material that comprises, in a photographic layer constituting the material, the photographic composition as described in any of (1) to (5).

A photographic layer constituting a silver halide photographic light-sensitive material of the present invention is described below.

The silver halide photographic light-sensitive material of the present invention can be applied to ordinary or cinematographic color photographic materials, such as a color negative film, a color reversal film, a cinematographic color negative film, a color paper, and a cinematographic color positive film, as well as black and white photographic materials, such as a black and white negative film, a microfilm, and an X-ray film.

Various additives and developing processes to be used when the present invention is applied to a black and white photographic material are not limited in particular, however those materials and methods as described, for example, in the specified portion of JP-A-68539/1990, ibid. 11389/1993 and ibid. 58041/1990 are preferably used.

1. Silver halide emulsions and Methods of manufacturing the same: From line 6 up, right under column, page 8 to line 12, right upper column, page 10 of JP-A-68539/1990.
2. Chemical sensitization methods: From line 13, right upper column, page 10 to line 16, left under column, page 10 of JP-A-68539/1990, and selenium sensitization as described in JP-A-11389/1993.
3. Antifoggants and stabilizers: From line 17, left under column, page 10 to line 7, left upper column, page 11, and from line 2, left under column, page 3 to left under column, page 4 of JP-A-68539/1990.
4. Spectral sensitizing dyes: From line 4, right under column, page 4 to right under column, page 8 of JP-A-68539/1990, and from line 4, left under column, page 12 to right under column, page 8 of JP-A-68539/1990, and from line 8, left column, page 12 to line 19, right under column, page 12 of JP-A-58041/1990.
5. Surface active agents and antistatic agents: From line 14, left upper column, page 11 to line 9, left upper column, page 12 of JP-A-68539/1990, and from line 14, left under column, page 2 to line 12, page 5 of JP-A-58041/1990.

6. Matting agents, plasticizers and sliding agents: From line 10, left upper column, page 12 to line 10, right upper column, page 12 of JP-A-68539/1990, and from line 13, left under column, page 5 to line 13, left under column, page 10 of JP-A-58041/1990.
7. Hydrophilic colloid: From line 11, right upper column, page 12 to line 16, left under column, page 12 of JP-A-68539/1990.
8. Hardening agents: From line 17, left under column, page 12 to line 6, right upper column, page 13 of JP-A-68539/1990.
9. Developing process: From line 14, left upper column, page 15 to line 13, left under column, page 15 of JP-A-68539/1990.

A color photographic light-sensitive material to which the present invention is applied, may have at least one light-sensitive layer and at least one light-insensitive layer (hydrophilic colloid layer) each coated on a transparent or reflective support. One of typical examples is a silver halide photographic light-sensitive material that contains on a transparent support, a light-sensitive layer composed of plural silver halide emulsion layers that are same spectrally sensitized, but each has different photographic speed. The above-said light-sensitive layer is a light-sensitive layer unit that has sensitivity to any one of blue light, green light and red light. In a multi-layer silver halide color photographic material, configuration of the units of light-sensitive layer is typically a red-sensitive layer, a green-sensitive layer and a blue-sensitive layer on a support in this order. On the other hand, the order of these spectrally sensitized layer is reversed on a reflective type color photographic material. Further, another configuration order of the layers may be set so that a different spectrally sensitized layer may be interposed between the same spectrally sensitized layers. A light-insensitive layer may be provided between silver halide light-sensitive layers, or on the uppermost layer, or lowermost layer. These light-sensitive layers and light-insensitive layers may contain the couplers, DIR compounds, anti-color mixing agent and etc., which will be described later. In the arrangement of a plurality of silver halide emulsion layers each constructing unit of sensitive layer, the two layers of a high-sensitivity emulsion layer and a low-sensitive emulsion layer are preferably arranged so that the sensitivity becomes gradually lower toward the support as described in German patent 1,121,470 or British patent 923,045. As described in JP-A-112751/1982, JP-A-200350/1987, JP-A-206541/1987, and JP-A-206543/1987, it is also possible to arrange a low-sensitivity emulsion layer on a side far from the support and a high-sensitivity emulsion layer on a side near the support.

Preferable silver halides for the use in a photographic light-sensitive material for filming are silver iodobromide, silver iodochloride, and silver iodochlorobromide having a silver iodide content of about 0.5 mol % to 30 mol %, silver iodobromide or silver iodochlorobromide having a silver iodide content of about 2 mol % to about 10 mol % are particularly preferred. Further, preferable silver halides for the use in a reflective-type photographic material and a cinematographic color posi film are silver chlorobromide and silver chloride, with the most preferable example being the silver halide containing 95 mol % or more of silver chloride (remainder is silver bromide (silver iodide)).

Silver halide grains contained in the photographic emulsion may have a regular crystal form, such as a cubic, tetradecahedral or octahedral form; or irregular crystal form, such as a spherical form and a tubular form; or a composite form of these crystal forms.

The silver halide grains may have a broad range of size, from about 0.2 μm or even smaller up to about 10 μm in terms of a diameter of a circle equivalent to the projected area of the grain. The emulsion may be either a polydispersion or a monodispersion.

The silver halide emulsion to be used in the present invention can be prepared with the method described in, for example, *Research Disclosure* (hereinafter abbreviated as RD) No. 17643 (December, 1978), pp. 22 to 23, "I. (Emulsion preparation and types)", *RD* No. 18716 (November, 1979), p. 648, *RD* No. 307105 (November, 1989), pp. 863 to 865, and P. Glafkides "*Chemie et Phisique Photographique*", Paul Montel (1967), G. F. Duffin, "*Photorgaphic Emulsion Chemistry*", Focal Press (1966), and V. L. Zelikman, et al., "*Making and Coating Photographic Emulsion*", Focal Press (1964).

It is preferred to use a monodisperse emulsion as described in U.S. Pat. Nos. 3,574,628 and 3,655,394, and British patent 1,413,748.

Further, tubular grains having an aspect ratio of about 3 or more can be also used in the present invention.

The tubular grains can easily be prepared with the method described in, for example, Gutoff, "*Photographic Science and Engineering*", Vol. 14, pp. 248 to 257 (1970), U.S. Pat. Nos. 4,434,226, 4,414,310, 4,433,048 and 4,439,520, and British patent 2,112,157.

The silver halide grains may have a homogeneous crystal structure, or may have a heterogeneous structure in which the inside and the outside have different halogen compositions, or may have a layered structure. Silver halides of different composition may be fused on a host silver halide grains by epitaxy. Further, compounds other than silver halides, such as silver thiocyanate or lead oxide, may be fused to silver halide grains. Furthermore, a mixture of various grains each having different crystal forms may be used.

The emulsions may be any of a surface latent image type which forms a latent image predominantly on the surface of the grains, an internal latent image type which forms a latent image predominantly in the inside of the grains, and a type which form a latent image both on the surface and in the inside. In any case, the emulsion must be of negative type. The internal latent image type emulsion may be a core/shell type emulsion as described in JP-A-264740/1988. The process for preparing a core/shell type internal latent image type emulsion is described in JP-A-133542/1984. The shell thickness is preferably 3 to 40 nm, particularly preferably 5 to 20 nm, while varying depending on development processing, etc.

The silver halide emulsions are usually used after being subjected to physical ripening, chemical ripening, and spectral sensitization. Additives used in these steps are described in *RD* Nos. 17643, 18716 and 307105 as hereinafter tabulated.

A mixture of two or more emulsions different in at least one characteristics of grain size, grain size distribution, halogen composition, grain shape, and sensitivity may be used in the same layer.

Surface fogged silver halide grains described in U.S. Pat. No. 4,082,553, internal fogged silver halide grains described in U.S. Pat. No. 4,626,498 and JP-A-214852/1984, and colloidal silver are preferably applied to light-sensitive silver halide emulsion layers and/or substantially light-insensitive hydrophilic colloid layers. The terminology "surface or internal fogged silver halide grains" as used herein means silver halide grains which are developable uniformly (i.e., non-imagewise) irrespective of exposure. The method for preparing these fogged grains is described in U.S. Pat. No. 4,626,498 and JP-A-214852/1984. In internal fogged core/shell type grains, the silver halide forming the core may have a different halogen composition. Internal or surface fogged core/shell type grains, the silver halide forming the core may have a different halogen composition. Internal or surface fogged silver halides may be any of silver chloride, silver chlorobromide, silver iodobromide, and silver chloroiodobromide. The fogged grains preferably have an average grain size of 0.01 to 0.75 μm, particularly 0.05 to 0.6 μm. The fogged grains may be regular crystals and may be either polydispersed or monodispersed but are preferably monodispersed (at least 95% by weight or number of the total grains have a grain size falling within ±40% of an average).

The light-sensitive materials according to the present invention preferably have a silver coating weight of not more than 6.0 g/m$^2$, most preferably not more than 4.5 g/m$^2$.

Photographic additives which can be used in the present invention are described in *RD* (relevant portions) as shown in the table below.

| Additives | RD 17643 | RD 18716 | RD 307105 |
|---|---|---|---|
| 1. Chemical Sensitizer | p. 23 | p. 648, right column | p. 866 |
| 2. Sensitivity Increasing Agent | pp. 23–24 | ditto | |
| 3. Spectral Sensitizer, Supersensitizer | p. 24 | p. 648, right column to p. 649, right column | pp. 866–868 |
| 4. Brightening Agent | pp. 25–26 | p. 647, right column | p. 868 |
| 5. Light Absorber, Filter Dye, Ultraviolet ray Absorber | p. 26 | p. 649, right column to p. 650, left column | p. 873 |
| 6. Binder | p.27 | p. 651, left column | pp. 873–874 |
| 7. Plasticizer, Lubricant | pp. 26–27 | p. 650, right column | p. 876 |
| 8. Coating Aid, Surface Active Agent | p.27 | p. 650, right column | pp. 875–876 |
| 9. Antistatic Agent | | ditto | pp. 876–877 |
| 10. Matting Agent | | | pp. 878–879 |

While various color forming couplers can be used in the light-sensitive materials of the present invention, the following couplers are particularly preferred.

Yellow Couplers:

Couplers represented by formulae (I) and (II) of EP 502,424A, couplers represented by formulae (1) and (2) of EP 513,496A (especially Y-28 on page 18), couplers represented by formula (I) claimed in claim 1 of JP-307248/1993, couplers represented by formula (I) of U.S. Pat. No. 5,066,576, col. 1, pp. 45–55, couplers represented by formula (I) of JP-A-274425/1992, paragraph 0008, couplers claimed in claim 1 (page 40) of EP 498,381A (especially D-35 on page 18), couplers represented by formula (Y) of EP 447,969A, page 4 (especially Y-1 on page 17 and Y-54 on page 41), and couplers represented by formula (II) to (IV) of U.S. Pat. No. 4,476,219, col. 7, pp. 36–58 (especially II-7 and -19 in column 17 and II-27 in column 19).

Magenta Couplers:

Couplers of JP-A-39737/1991 (L-57 in the lower right part of page 11, L-68 in the lower right part of page 12, and L-77 in the lower right part of page 13; couplers of EP 456,257 (A-4-63 on page 134 and A-4-73 and -75 on page 139); couplers of EP 486,965 (M-4 and -6 on page 26 and M-7 on page 27); couplers of JP-A-43611/1994 (M-45 in para. 0024); couplers of JP-A-204106/1993 (M-1 in para. 0036); and couplers of JP-A-362631/1992 (M-22 in para. 0237).

Cyan Coupler:

Couplers of JP-A-204843/1992 (CX-1, 3, 4, 5, 11, 12, 14 and 15 on pp. 14–16); couplers of JP-A-43345/1992 (C-7 and -10 on p. 35, C-34 and -35 on p. 37, (I-1) and (I-7) on pp. 42–43); and couplers represented by formula (Ia) or (Ib) claimed in claim 1 of JP-A-67385/1994.

Polymer Coupler:

P-1 and P-5 (p. 11) of JP-A-44345/1990.

Examples of suitable couplers which develop a dye having moderate diffusibility are described in U.S. Pat. No. 4,366,237, British Patent 2,125,570, EP 96,873B, and German Patent 3,234,533.

Examples of suitable colored couplers which can be used for correcting unnecessary absorption of a developed dye are yellow-colored cyan couplers represented by formulae (CI), (CII), (CIII), and (CIV) described in EP 456,257A1, page 5 (especially YC-86 on page 84), yellow-colored magenta couplers ExM-7 (page 202), EX-1 (page 249), and EX-7 (page 251) of EP 456,257A1, magenta-colored cyan couplers CC-9 (column 8), and CC-13 (column 10) of U.S. Pat. No. 4,833,069, coupler (2) of U.S. Pat. No. 4,837,136, column 8, and colorless masking couplers represented by formula (A) claimed in claim 1 of WO 92/11575 (especially the compounds on pp. 36–45).

Compounds (inclusive of couplers) capable of releasing a photographically useful residue on reacting with an oxidized developing agent include development inhibitor-releasing compounds, such as the compounds represented by formulae (I) to (IV) on page 11 of EP 378,236A1 (especially T-101 on p. 30, T-104 on p. 31, T-113 on p. 36, T-131 on p. 45, T-144 on p. 51, and T-158 on p. 58), the compounds represented by formula (I) on page 7 of EP 436,938A2 (especially D-49 on p. 51), the compounds represented by formula (1) of JP-A-307248/1993 (especially (23) in para. 0027), and the compounds represented by formulae (I), (II) and (III) on pages 5 to 6 of EP 440,195A2 (especially I-(1) on p. 29); bleaching accelerator-releasing compounds, such as the compounds represented by formulae (I) and (I') on page 5 of EP 310,125A2 (especially (60) and (61) on p. 61) and the compounds represented by formula (I) claimed in claim 1 of JP-A-59411/1994 (especially (7) in para. 0022); ligand-releasing compounds, such as the compounds represented by formula LIG-X claimed in claim 1 of U.S. Pat. No. 4,555,478 (especially the compounds in col. 12, pp. 21–41); leuco dye-releasing compounds, such as compounds 1 to 6 in cols. 3 to 8 of U.S. Pat. No. 4,749,641; fluorescent dye-releasing compounds, such as the compounds represented by formula COUP-DYE claimed in claim 1 of U.S. Pat. No. 4,774,181 (especially compounds 1 to 11 in cols. 7 to 10); development accelerator- or fogging agent-releasing compounds, such as the compounds represented by formulae (1), (2) and (3) in col. 3 of U.S. Pat. No. 4,656,123 (especially (I-22) in col. 25), and ExZk-2 on page 75 lines 36–38 of EP 450,637A2; and compounds releasing a group which becomes a dye on release, such as the compounds represented by formula (I) claimed in claim 1 of U.S. Pat. No. 4,857,447 (especially Y-1 to Y-19 in cols. 25–36).

Additives other than couplers which can preferably used in the present invention are as follows. Dispersing media for oil-soluble organic compounds, such as P-3, 5, 16, 19, 25, 30, 42, 49, 54, 55, 66, 81, 85, 86 and 93 of JP-A-215272/1987 (pp. 140–144); scavengers for an oxidized developing agent, such as the compounds represented by formula (I) of U.S. Pat. No. 4,978,606, col. 2, lines 54–62 (especially I-(1), (2), (6) and (12) in cols. 4–5) and the compounds in col. 2, lines 5–10 of U.S. Pat. No. 4,923,787 (especially compound 1 in col. 3); stain inhibitors, such as the compounds of formulae (I), (II) and (III) on page 4, lines 30–33 of EP 298321A (especially I-47 and -72 and III-1 and -27 on pp. 24–48); discoloration preventives, such as A-6, 7, 20 to 26, 30, 37, 40, 42, 48, 63, 90, 92, 94, and 164 on pp. 69–118 of EP 298,321A, and II-1 to III-23 in cols. 25–38 of U.S. Pat. No. 5,122,444 (especially III-10), and I-1 to III-4 on pp. 8–12 of EP 471,347A (especially II-2), and A-1 to 48 in cols. 32–40 of U.S. Pat. No. 5,139,931 (especially A-39 and 42); color formation enhancing agents or materials for reducing the amount of color mixing preventives, such as I-1 to II-15 on pp. 5–24 of EP 411324A (especially I-46); formalin scavengers, such as SCV-1 to 28 on pp. 24–29 of EP 477932A (especially SCV-8); hardening agents, such as H-1, 4, 6, 8 and 14 on p. 17 of JP-A-214845/1990, the compounds represented by formulae (VII) to (XII) in cols. 13–23 of U.S. Pat. No. 4,618,573 (H-1 to 54), the compounds represented by formula (6) in the right lower part on page 8 of JP-A-214852/1990 (H-1 to 76, especially H-14), and the compounds claimed in claim 1 of U.S. Pat. No. 3,325,287; development inhibitor precursors, such as P-24, 37 and 39 on pp. 6–7 of JP-A-168139/1987, and the compounds claimed in claim 1 of U.S. Pat. No. 5,019,492 (especially 28 and 29 in col. 7); antiseptics and antifungal agents, such as I-1 to III-43 in cols. 3–15 of U.S. Pat. No. 4,923,790 (especially II-1, 9, 10 and 18 and III-25); stabilizers and antifoggants, such as I-1 to (14) in cols. 6–16 of U.S. Pat. No. 4,923,793 (especially I-1, 60, (2) and (13)), and compounds 1 to 65, especially 36, in cols. 25–32 of U.S. Pat. No. 4,952,483; chemical sensitizers, such as triphenylphosphineselenides, and compound 50 of JP-A-40324/1993; dyes, such as a-1 to b-20 (especially a-1, 12, 18, 27, 35 and 36 and b-5) on pp. 15–18 of JP-A-156450/1992 and V-1 to 23 (especially V-1) on pp. 27–29, ibid., F-I-1 to F-II-43 (especially F-I-11 and F-II-8) on pp. 33–55 of EP 445627A, III-1 to 36 (especially III-1 and 3) on pp. 17–28 of EP 457153A, microcrystalline dispersions of Dye-1 to 124 on pp. 8–26 of WO 88/04794, compounds 1 to 22 on pp. 6–11 of EP 319999A (especially compound 1), compounds D-1 to 87 (pp. 3–28) represented by formulae (1) to (3) of EP 519306A, compounds 1 to 22 (cols. 3–10) represented by formula (I) of U.S. Pat. No. 4,268,622, and compounds (1) to (31) (cols. 2 to 9) represented by formula (I) of U.S. Pat. No. 4,923,788; ultraviolet absorbers, such as compounds (18*b*) to (18*r*) and 101 to 427 (pp. 6–9) represented by formula (1) of JP-A-3335/1971, compounds (3) to (66) (pp. 10–44) represented by formula (I) and compounds HBT-1 to 10 (p. 14) represented by formula (III) of EP 520938A, and compounds (1) to (31) (cols. 2–9) represented by formula (1) of EP 521823A.

In the light-sensitive materials of the present invention, the hydrophilic colloidal layers on the side having emulsion layers preferably have a total film thickness of not more than 28 μm, more preferably not more than 23 μm, still more preferably not more than 18 μm, particularly preferably not more than 16 μm, and a rate of swelling $T_{1/2}$ of not more than 30 seconds, more preferably not more than 20 seconds. The terminology "total film thickness" as used herein means a film thickness as measured after condition at 25° C. and a relative humidity of 55% for 2 days. The terminology "rate of swelling $T_{1/2}$" means a time required for a light-sensitive material to be swollen to ½ the saturated swollen thickness, the saturated swollen thickness being defined to be 90% of the maximum swollen thickness which is reached when the light-sensitive material is swollen with a color developing solution at 30° C. for 3 minutes and 15 seconds. The rate of swelling $T_{1/2}$ can be measured with a swellometer of the type described in A. Green, et al., *Photographic Science and Engineering*, Vol. 19, No. 2, pp. 124–129. $T_{1/2}$ can be controlled by adding a proper amount of a hardening agent for a gelatin binder or by varying aging conditions after coating.

Further, the light-sensitive material preferably has a degree of swelling of from 150 to 400%. The terminology "degree of swelling" as used herein means a value obtained from the maximum swollen film thickness as defined above according to formula: (maximum swollen film thickness–film thickness)/film thickness.

The support which can be used for a silver halide photographic light-sensitive material of the present invention includes transparent, semi-transparent, or reflective supports on which a hydrophilic colloid layer may be coated, such as glass plates, papers including a paper composed of a neutral paper or an acidic paper laminated with a resin such as polyethylene and polyester, a baryta paper and a polypropylene type synthetic paper and plastic films or sheets including polyesters such as polyethylene terephthalate, polyethylene-2,6-naphthalene dicarboxylate, cellulose triacetate and cellulose nitrate, and resins such as polyvinyl chloride.

For a cinematographic color posi film to which the present invention can be preferably applied, a transparent plastic film can be preferably used.

A dye represented by the following general formula (II) is explained below.

$$D\leftarrow X)_y \qquad \text{formula (II)}$$

wherein D represents a residue of a compound having a chromophoric group, x represents a dissociating hydrogen atom or a group having a dissociating hydrogen atom, y represents an integer of 1 to 7. A preferred range of y is 1 to 5, more preferably 1 to 3.

The terminology "solid dye" as used herein means a dye which is solid at a room temperature (25° C.), and preferably has a melting point of 60° C. or higher.

The two valent connecting group between X and D includes an alkylene group, an arylene group, a heterocyclic group, a —CO— group, a —$SO_n$— group in which n is 0, 1, or 2, a —NR— group in which R represents a hydrogen atom, an alkyl group or an aryl group, a —O— group, and a combination of these two valent groups, each of which may be substituted with a substitute such as an alkyl group, an aryl group, an alkoxy group, an amino group, an acyl amino group, a halogen atom, a hydroxide group, a carboxyl group, a sulfamoyl group, a carbamoyl group and a sulfonamide group. Preferred examples of these connecting groups include —$(CH_2)_n$— in which n is 1, 2, or 3, —$CH_2CH(CH_3)CH_2$—, a 1,2-phenylene group, a 5-carboxy-1,3-phenylene group, a 1,4-phenylene group, a 1,4-phenylene group, a 6-methoxy-1,3-phenylene group, and a —$CONHC_6H_4$— group.

The dye represented by general formula (II) according to the present invention is characterized by a dissociating hydrogen atom in its molecule.

The compound having a chromophoric group relative to D can be selected from various well-known dyes. These dyes include oxonol dyes, merocyanine dyes, cyanine dyes, arylidene dyes, azomethine dyes, triphenylmethane dyes, azo dyes, anthraquinone dyes and indoaniline dyes.

The dissociating hydrogen atom or the group having the dissociating hydrogen atom has a characteristic that they are non-dissociation in the situation where a dye represented by general formula (II) is incorporated in a silver halide photographic light-sensitive material, which eventually render the dye of formula (II) substantially water-insoluble. On the other hand, in the step of developing the light-sensitive material, the dissociating hydrogen atom or the group having the same has an opposite characteristic that they dissociate and render the dye substantially water-soluble. Examples of the group having a dissociating hydrogen atom are groups containing a carboxylic acid group, a sulfonamide group, a sulfamoyl group, a sulfonylcarbamoyl group, an acylsulfamoyl group, a phenolic group, etc. Examples of the dissociating hydrogen atom represented by X include a hydrogen atom of the enol group of the oxonol dye.

Preferred of the compounds represented by formula (II), are those in which the group having a dissociating hydrogen atom represented by X is a group containing a carboxylic acid group, especially an aryl group substituted with a carboxyl group.

Still more preferable compounds are those represented by the following general formula (III) or (IV):

$$A^1{=}L^1{-}(L^2{=}L^3)_m{-}Q \qquad \text{formula (III)}$$

wherein $A^1$ represents an acidic nucleus which means a proton-donating nucleus and etc., Q represents an aryl group or a heterocyclic group, $L^1$, $L^2$ and $L^3$ each represents a methine group, m is 0, 1 or 2, with the proviso that the compound of general formula (III) has 1 to 7 group(s) selected from a member consisting of a carboxylic acid group, a sulfonamide group, a sulfamoyl group, a sulfonyl carbamoyl group, an acylsulfamoyl group, a phenolic hydroxide group, and an enol group of the oxonol dye as a water-soluble group in its molecule.

$$A^1{=}L^1{-}(L^2{=}L^3)_n{-}A^2 \qquad \text{formula (IV)}$$

wherein $A^1$ and $A^2$ each represents an acidic group; $L^1$, $L^2$ and $L^3$ each represents a methine group; n is 0, 1 or 2, with the proviso that the compound of general formula (IV) has 1 to 7 group(s) selected from a member consisting of a carboxylic acid group, a sulfonamide group, a sulfamoyl group, a sulfonylcarbamoyl group, an acylsulfamoyl group, a phenolic hydroxide group, and an enol group of the oxonol dye as a water-soluble group in its molecule.

The dyes represented by general formulae (III) and (IV) are explained below in detail.

The acidic nucleus represented by $A^1$ or $A^2$ is preferably residue of a cyclic ketomethylene compound or a compound having a methylene group sandwiched by electron-withdrawing groups.

Examples of the cyclic ketomethylene compound include 2-pyrazoline-5-one, rhodanine, hydantoine, thiohydantoine, 2,4-oxazolidinedione, isooxazolone, barbitulic acid, thiobarbitulic acid, indandione, dioxopyrazolopyridine, pyrazolidinedione, and 2,5-dihydrofuran, each of which may be substituted.

The compound having a methylene group sandwiched by electron-withdrawing groups can be represented by the following general formula:

$$Z^1\ CH_2\ Z^2$$

wherein $Z^1$ and $Z^2$ each represents —CN, $—SO_2R^{11}$, $—COR^{11}$, $—COOR^{12}$, $—CONHR^{12}$, $—SO_2NHR^{12}$ or $—C[{=}C(CN)_2]R^{11}$, in which $R^{11}$ represents an alkyl group, an aryl group, or a heterocyclic group, and $R^{12}$ represents a hydrogen atom, or groups represented by $R^{11}$, each of which may be substituted.

Examples of the aryl group represented by Q are a phenyl group and a naphthyl group, each of which may be substituted. Examples of the heterocyclic group represented by Q include residues of pyrrole, indole, furan, thiophene, imidazole, pyrazole, indolidine, quinoline, carbazole, phenothiazine, phenoxazine, indoline, thiazole, pyridine, pyridazine, thiadiazine, pyrane, thiopyrane, oxodiazole, benzoquinoline, thiadiazole, pyrrothiazole, pyrropyridazine, tetrazole, oxazole, coumarin, and coumarone, each of which may be substituted.

The methine group represented by $L^1$, $L^2$ and $L^3$ may be substituted with a substituent, and the substituents may combine with each other to form a 5- or 6-membered ring such as cyclopentene and cyclohexane.

There is no limitation for the above-mentioned substituent to be used, except for the substituent which renders the compounds of formulae (II) to (VI) substantially water-soluble in water having pH of 5 to 7.

Examples of the substituent include a carboxylic acid group, a sulfonamide group having 1 to 10 carbon atom(s) (e.g., methanesulfonamide, benzenesulfonamide, butanesulfonamide, n-octanesulfonamide), an unsubstituted or alkyl- or aryl-substituted sulfamoyl group having 0 to 10 carbon atom(s) (e.g., unsubstituted sulfamoyl, methylsulfamoyl, phenylsulfamoyl, naphthylsulfamoyl, butylsulfamoyl), a sulfonylcarbamoyl group having 2 to 10 carbon atoms (e.g., methanesulfonylcarbamoyl, propanesulfonylcarbamoyl, benzenesulfonylcarbamoyl), an acylsulfamoyl group having 1 to 10 carbon atom(s) (e.g., acetyl sulfamoyl, propionyl sulfamoyl, pivaroylsulfamoyl, benzoylsulfamoyl), a chain or cyclic alkyl group having 1 to 8 carbon atom(s) (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), an alkenyl group having 2 to 8 carbon atoms (e.g., vinyl, allyl), an alkoxy group having 1 to 8 carbon atom(s) (e.g., methoxy, ethoxy, butoxy), a halogen atom (e.g., F, Cl , Br), an amino group having 0 to 10 carbon atom(s) (e.g., unsubstituted amino, dimethylamino, diethylamino, carboxyethylamino), an ester group having 2 to 10 carbon atoms (e.g., methoxycarbonyl), an amido group having 1 to 10 carbon atom(s) (e.g., acetylamino, benzamido), a carbamoyl group having 1 to 10 carbon atom(s) (e.g., unsubstituted carbamoyl, methyl carbamoyl, ethyl carbamoyl), an aryl group having 6 to 10 carbon atoms (e.g., phenyl, naphthyl, hydroxyphenyl, 4-carboxyphenyl, 3-carboxyphenyl, 3,5-dicarboxyphenyl, 4-methanesulfonamidophenyl, 4-butanesulfonamido phenyl), an aryloxy group having 6 to 10 carbon atoms (e.g., phenoxy, 4-carboxyphenoxy, 3-methylphenoxy, naphthoxy), an alkylthio group having 1 to 8 carbon atoms (e.g., methylthio, ethylthio, octylthio), an arylthio group having 6 to 10 carbon atoms (e.g., phenylthio, naphthylthio), an acyl group having 1 to 10 carbon atom(s) (e.g., acetyl, benzoyl, propanoyl), a sulfonyl group having 1 to 10 carbon atom(s) (e.g., methanesulfonyl, benzenesulfonyl), an ureid group having 1 to 10 carbon atom(s) (e.g., ureid, methylureid), an urethane group having 2 to 10 carbon atoms (e.g., methoxycarbonylamino, ethoxycarbonylamino), a cyano group, a hydroxyl group, a nitro group, and a heterocyclic group (e.g. 5-carboxybenzoxazole ring, pyridine ring, sulforane ring, pyrrol ring, pyrrolidine ring, morpholine ring, piperazine ring, pyrimidine ring, furane ring).

Still more preferable compounds of general formula (IV) are those represented by general formula (V). The compound represented by the general formula (V) has a hydrogen atom of the enol group as a dissociating hydrogen atom.

formula (V)

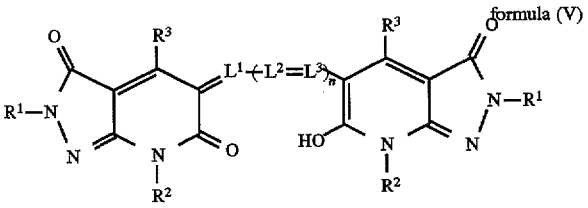

n = 1 or 2 wherein $R^1$ represents a hydrogen atom, an alkyl group, an aryl group, or a heterocyclic group; $R^2$ represent a hydrogen atom, an alkyl group, an aryl group, a heterocyclic group, $—COR^4$ or $—SO_2R^4$; $R^3$ represents a hydrogen atom, a cyano group, a hydroxyl group, a carboxyl group, an alkyl group, an aryl group, $—CO_2R^4$, $—OR^4$, $—NR^5R^6$, $—CONR^5R^6$, $—NR^5COR_4$, $—NR^5SO_2R^4$, or $—NR^5CONR^5R^6$, in which $R^4$ represents an alkyl group, or an aryl group, and $R^5$ and $R^6$ each represents a hydrogen atom, an alkyl group, or an aryl group; $L^1$, $L^2$ and $L^3$ each represents a methine group, and n is 1 or 2.

The alkyl group of $R^1$ includes an alkyl group having 1 to 4 carbon atom(s), a 2-cyanoethyl group, a 2-hydroxyethyl group and a carboxybenzyl group. The aryl group of $R^1$ includes a phenyl group, a 2-methylphenyl group, a 2-carboxyphenyl group, a 3-carboxyphenyl group, a 4-carboxyphenyl group, a 3,6-dicarboxyphenyl group, a 2-hydroxyphenyl group, a 3-hydroxyphenyl group, a 4-hydroxyphenyl group, a 2-chloro-4-carboxyphenyl group, and a 4-methylsulfamoylphenyl group. The heterocyclic group of $R^1$ includes those groups as illustrated below.

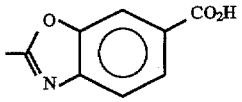

The alkyl group of $R^2$ includes an alkyl group having 1 to 4 carbon atom(s), a carboxymethyl group, a 2-hydroxyethyl group, and a 2-methoxyethyl group. The aryl group of $R^2$ includes a 2-carboxyphenyl group, a 3-carboxyphenyl group, a 4-carboxyphenyl group, and a 3,6-dicarboxyphenyl group. The heterocyclic group of $R^2$ includes those as illustrated below.

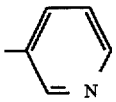

An example of the $—COR^4$ group is an acetyl group. An example of the $—SO_2R^4$ is a methanesulfonyl group.

The alkyl group of $R^3$, $R^4$, $R^5$ and $R^6$ each includes an alkyl group having 1 to 4 carbon atom(s). The aryl group of $R^3$, $R^4$, $R^5$ and $R^6$ each includes a phenyl group and a methylphenyl group.

In the present invention, it is preferred that $R^1$ is a phenyl group substituted with a carboxyl group (e.g., 2-carboxyphenyl, 3-carboxyphenyl, 4-carboxyphenyl, and 3,6-dicarboxyphenyl).

Specific examples of the compounds represented by general formulae (II) to (V) for the use in the present invention are illustrated below, but the present invention must not be limited to these compound.

(II-1)

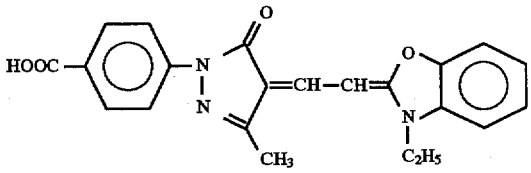

(II-2)

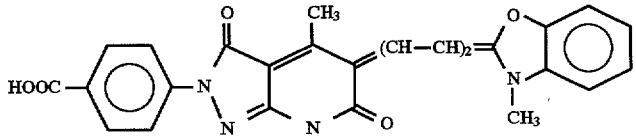

(II-3)

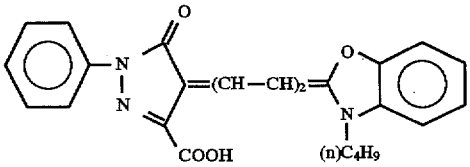

(II-4)

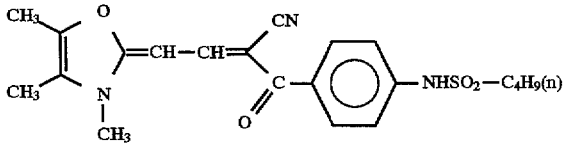

-continued
(II-5)
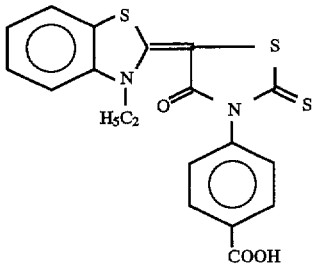
(II-6)
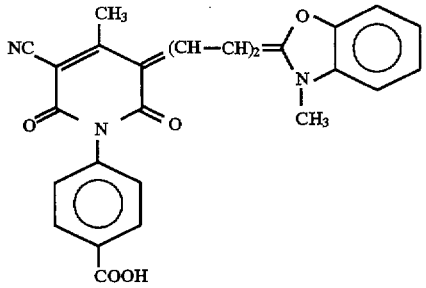
(II-7)
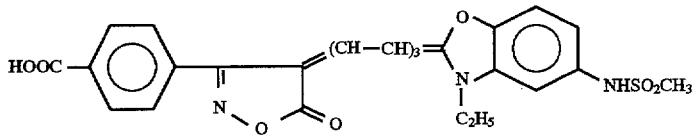
(II-8)
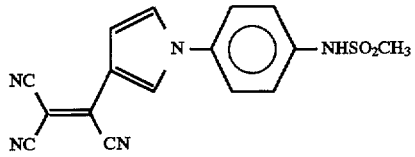
(II-9)
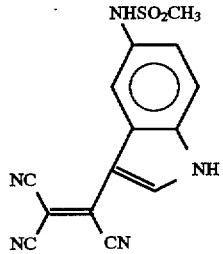
(II-10)
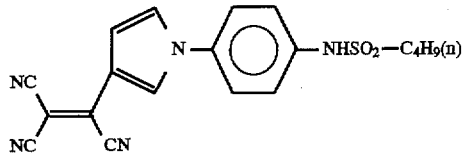
(II-11)
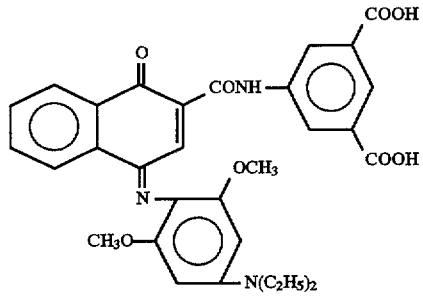

-continued
(II-12)
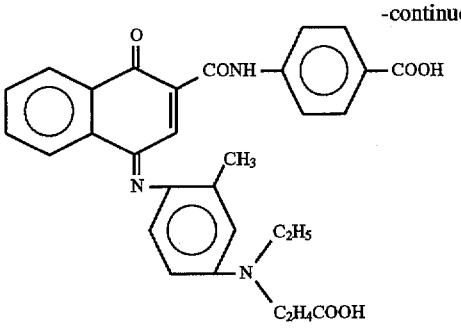
(II-13)
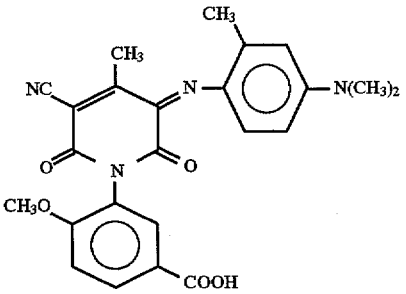
(II-14)
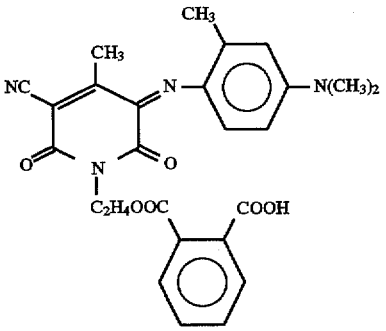
(III-1)
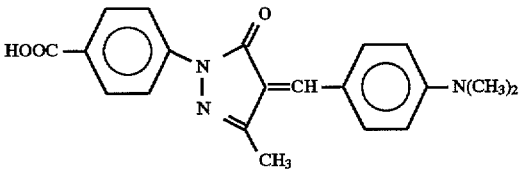
(III-2)
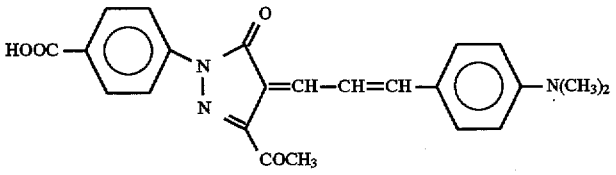
(III-3)
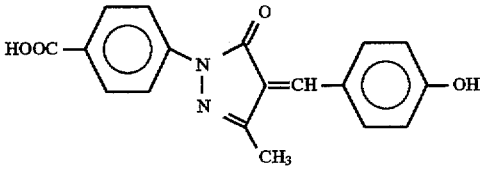
(III-4)
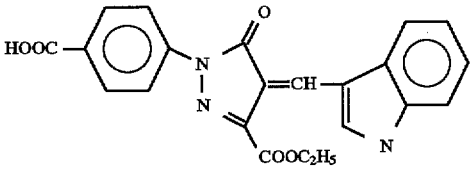

-continued
(III-5)
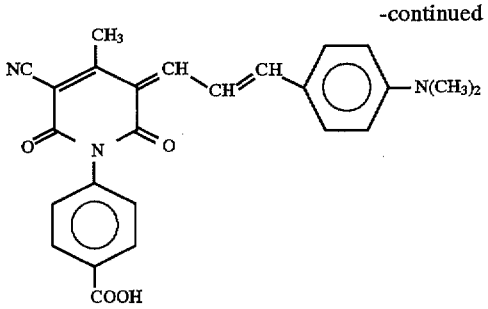
(III-6)
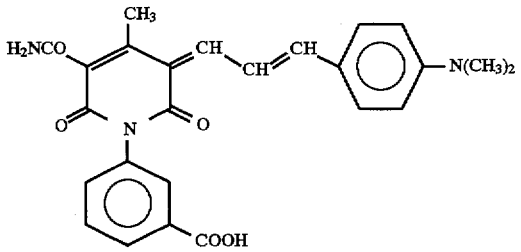
(III-7)
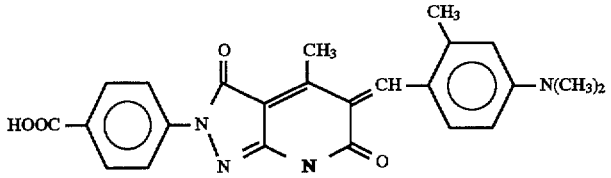
(III-8)
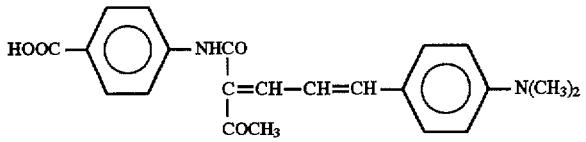
(III-9)
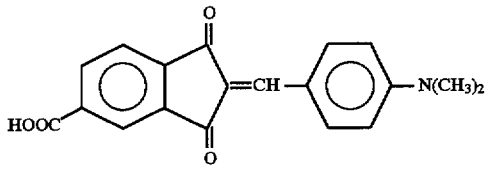
(III-10)
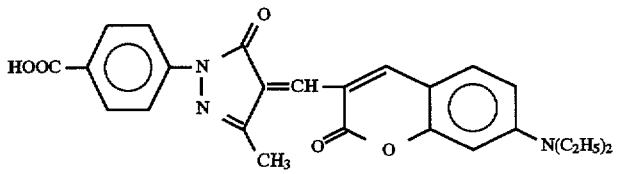
(III-11)
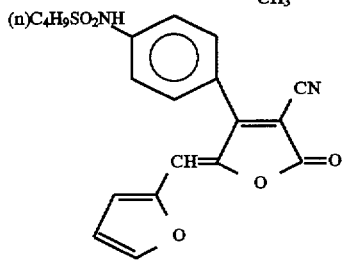
(III-12)
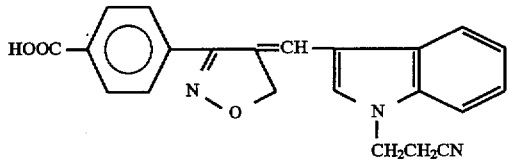

-continued
(III-13)
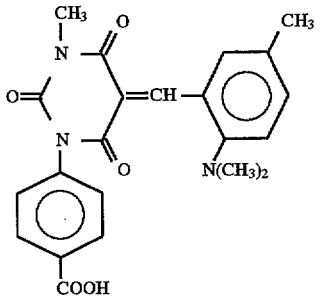
(III-14)
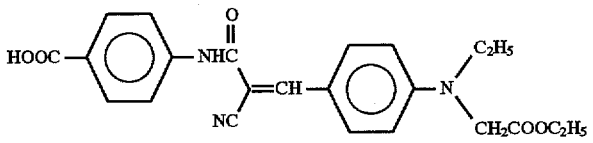
(III-15)
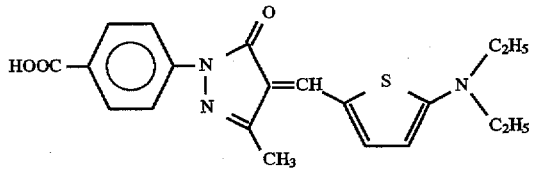
(III-16)
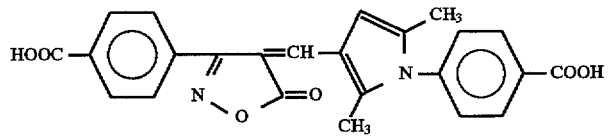
(III-17)
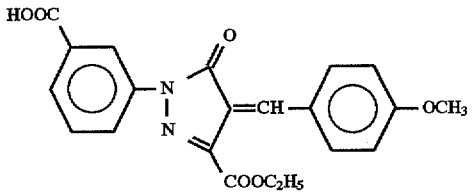
(III-18)
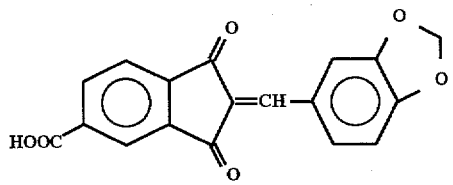
(III-19)
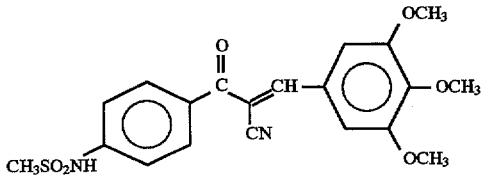
(III-20)
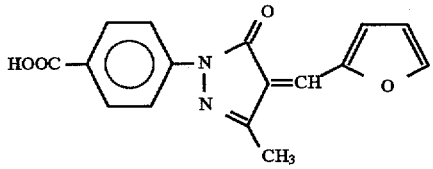

-continued
(III-21)
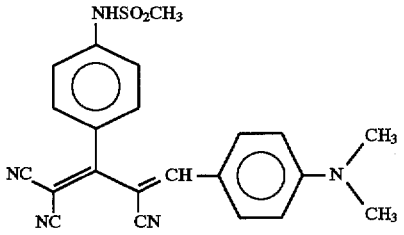
(III-22)
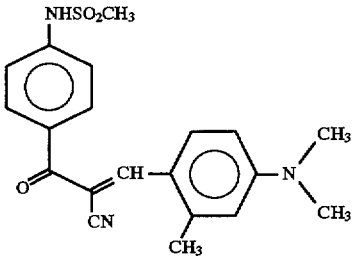
(III-23)
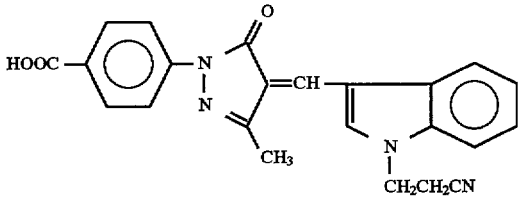
(III-24)
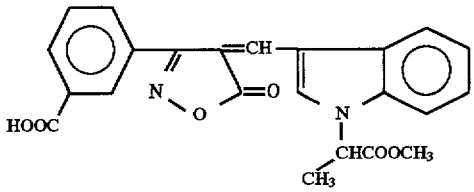
(III-25)
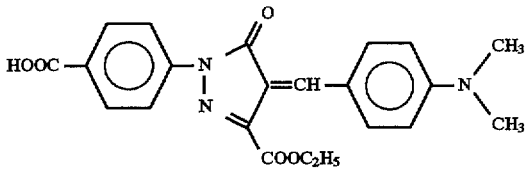
(III-26)
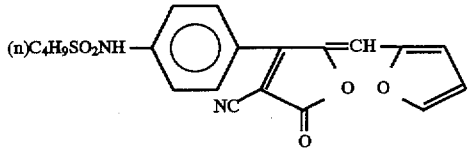
(IV-1)
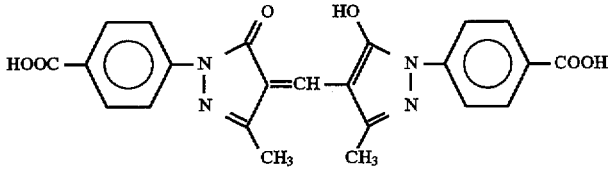
(IV-2)
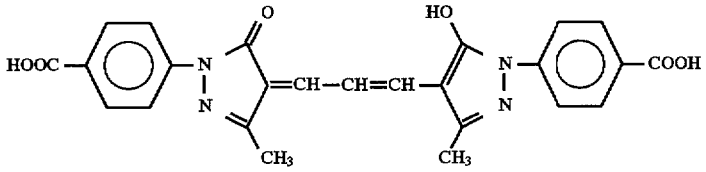

-continued
(IV-3)
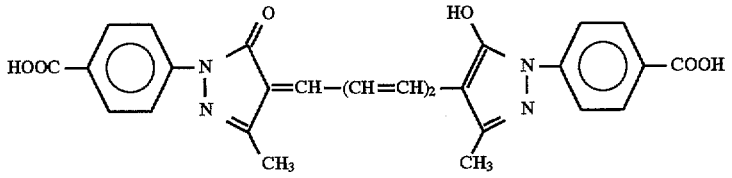
(IV-4)
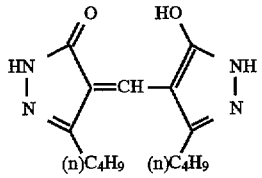
(IV-5)
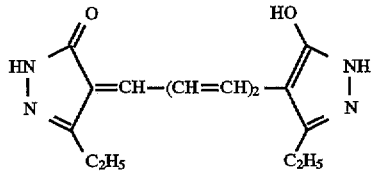
(IV-6)
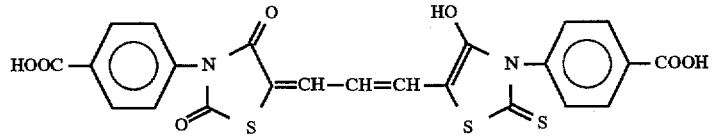
(IV-7)
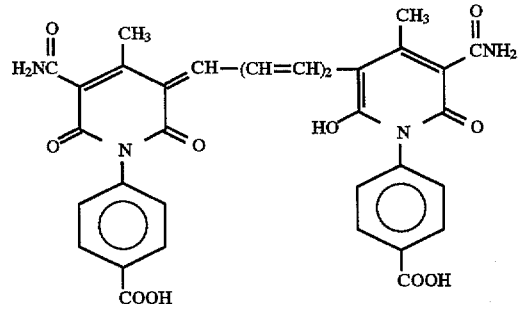
(IV-8)
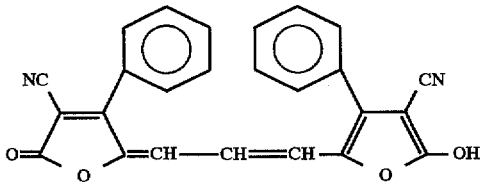
(IV-9)
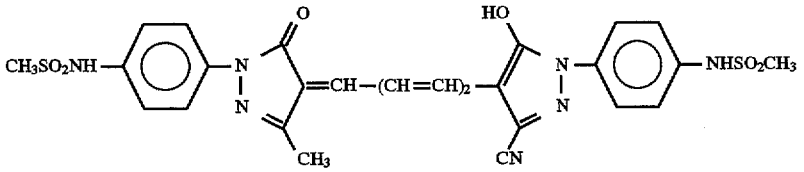
(IV-10)
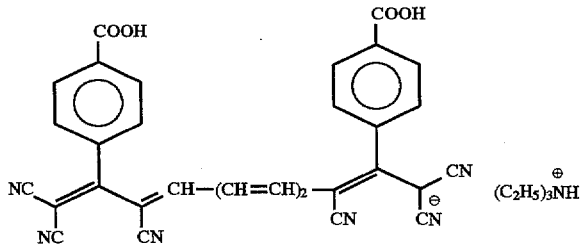

-continued
(IV-11)
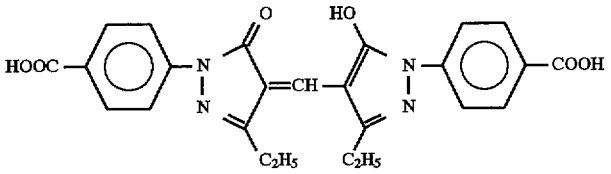
(IV-12)
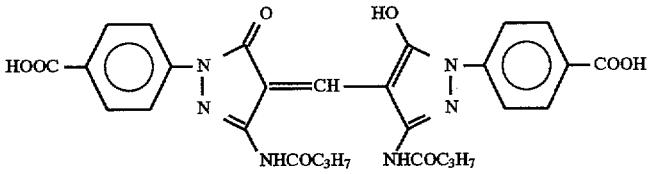
(IV-13)
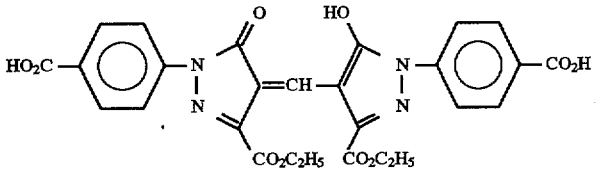
(IV-14)
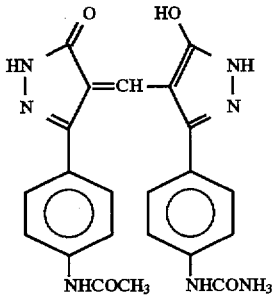
(IV-15)
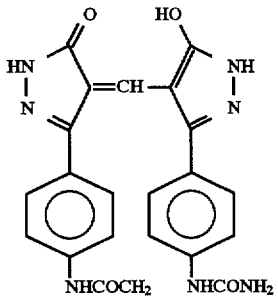
(IV-16)
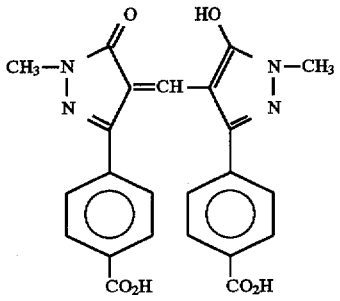

-continued
(IV-17)
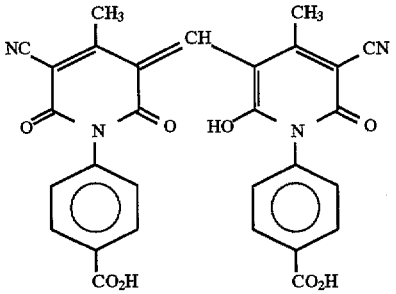
(IV-18)
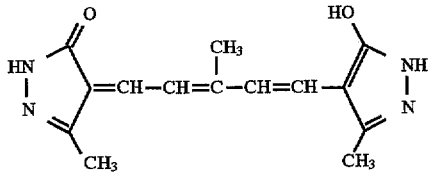
(IV-19)
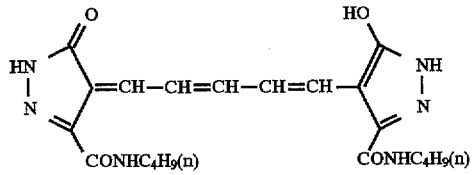
(IV-20)
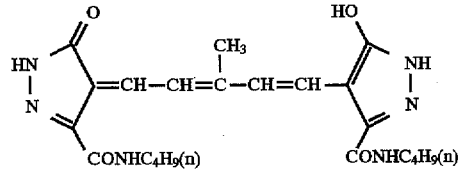
(IV-21)
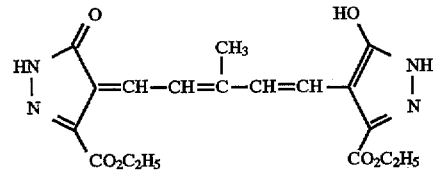
(IV-22)
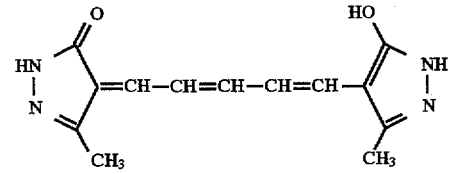
(IV-23)
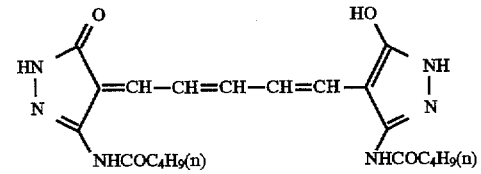
(IV-24)
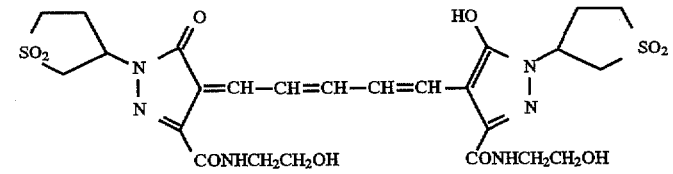

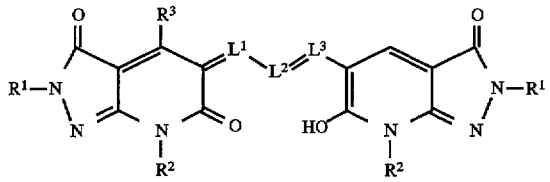
| | $R^1$ | $R^2$ | $R^3$ | $=L^1-L^2=L^3-$ |
|---|---|---|---|---|
| V-1 | 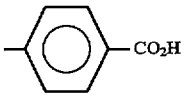 | H | $CH_3$ | $=CH-CH=CH-$ |
| V-2 | 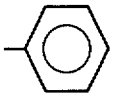 | H | $CH_3$ | $=CH-CH=CH-$ |
| V-3 | $CH_3$ | H | $CH_3$ | $=CH-CH=CH-$ |
| V-4 | 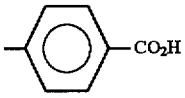 | $CH_3$ | $CH_3$ | $=CH-CH=CH-$ |
| V-5 | 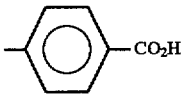 | 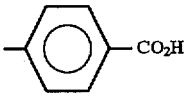 | $CH_3$ | $=CH-CH=CH-$ |
| V-6 | 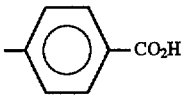 | $CH_3$ | $-CO_2C_2H_5$ | $=CH-CH=CH-$ |
| V-7 | 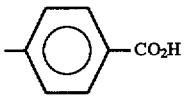 | $CH_3$ | $-CO_2H$ | $=CH-CH=CH-$ |
| V-8 | $CH_3$ | 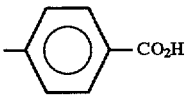 | $CH_3$ | $=CH-CH=CH-$ |
| V-9 | $CH_3$ | 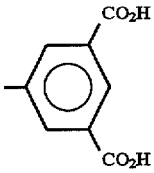 | $CH_3$ | $=CH-CH=CH-$ |
| V-10 | $CH_3$ | $CH_3$ | $CH_3$ | $=CH-CH=CH-$ |
| V-11 | 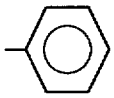 | 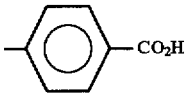 | $CH_3$ | $=CH-CH=CH-$ |
| V-12 | 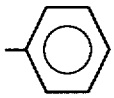 | 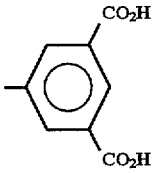 | $CH_3$ | $=CH-CH=CH-$ |

-continued
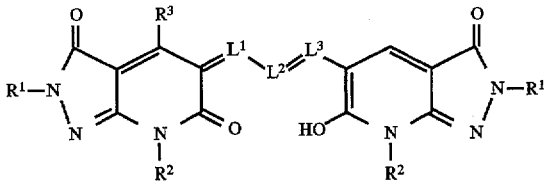
| | $R^1$ | $R^2$ | $R^3$ | $=L^1-L^2=L^3-$ |
|---|---|---|---|---|
| V-13 | 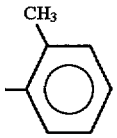 | 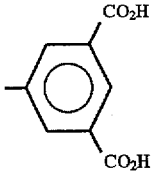 | $CH_3$ | $=CH-CH=CH-$ |
| V-14 | 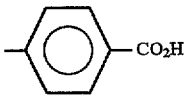 | H | $CH_3$ | $=CH-C(CH_3)=CH-$ |
| V-15 | 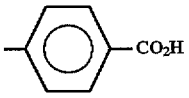 | H | $-CO_2CH_2CH_3$ | $=CH-CH=CH-$ |
| V-16 | 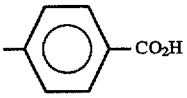 | H | $CO_2H$ | $=CH-CH=CH-$ |
| V-17 | 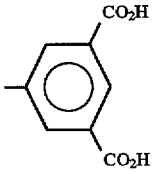 | H | $CH_3$ | $=CH-CH=CH-$ |
| V-18 | 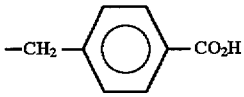 | H | $CH_3$ | $=CH-C(CH_3)=CH-$ |
| V-19 | 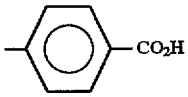 | $-CH_2CH_2-OH$ | H | $=CH-CH=CH-$ |
| V-20 | 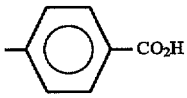 | $-CH_2CO_2H$ | $CH_3$ | $=CH-C(CH_3)=CH-$ |
| V-21 | 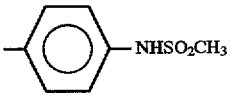 | H | $CH_3$ | $=CH-CH=CH-$ |
| V-22 | 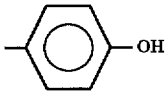 | H | $CH_3$ | $=CH-CH=CH-$ |
| V-23 | $-CH_2CH_2OH$ | H | $CH_3$ | $=CH-CH=CH-$ |
| V-24 | $CH_3$ | $-CH_2CH_2OH$ | $CH_3$ | $=CH-CH=CH-$ |
| V-25 | H | 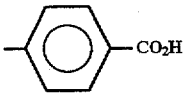 | $CH_3$ | $=CH-CH=CH-$ |

-continued
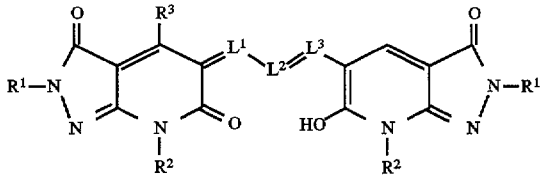
| | $R^1$ | $R^2$ | $R^3$ | $=L^1-L^2=L^3-$ |
|---|---|---|---|---|
| V-26 | H | H | $-CO_2H$ | $=CH-CH=CH-$ |
| V-27 | 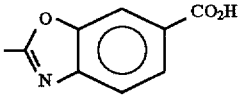 | H | $C_2H_5$ | $=CH-CH=CH-$ |
| V-28 | 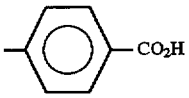 | $-SO_2CH_3$ | $-CO_2CH_3$ | $=CH-C(CH_3)=CH-$ |
| V-29 | 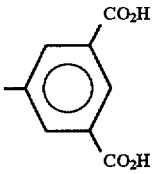 | $-COCH_3$ | $CH_3$ | $=CH-CH=CH-$ |
| V-30 | H | 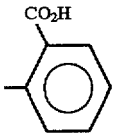 | $CH_3$ | $=CH-CH=CH-$ |
| V-31 | 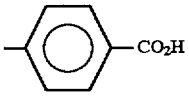 | 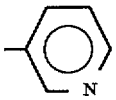 | $CH_3$ | $=CH-C(CH_3)=CH-$ |
| V-32 | 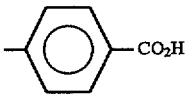 | $CH_3$ | CN | $=CH-CH=CH-$ |
| V-33 | 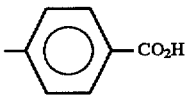 | H | H | $=CH-CH=CH-$ |
| V-34 | 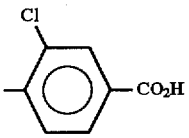 | H | $-OC_2H_5$ | $=CH-CH=CH-$ |
| V-35 | 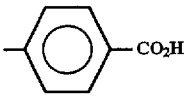 | H | $(n)C_4H_9-$ | $=CH-CH=CH-$ |
| V-36 | 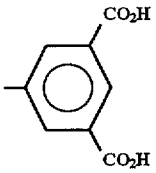 | $CH_3$ | $-NHCH_3$ | $=CH-CH=CH-$ |

-continued

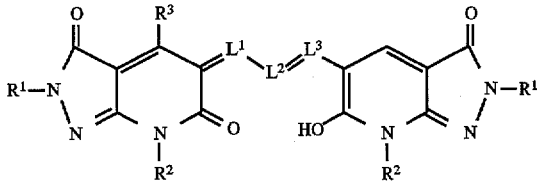

| | $R^1$ | $R^2$ | $R^3$ | $=L^1-L^2=L^3-$ |
|---|---|---|---|---|
| V-37 | 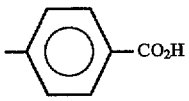 | $-COCH_3$ | $-NHCOCH_3$ | $=CH-CH=CH-$ |
| V-38 | 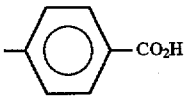 | $-CO_2CH_3$ | $-NHSO_2CH_3$ | $=CH-CH=CH-$ |
| V-39 | 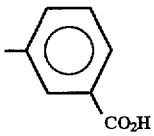 | $-CH_2CH_2OH$ | $CH_3$ | $=CH-CH=CH-$ |
| V-40 | $-CH_2CH_2CN$ | H | $CH_3$ | $=CH-CH=CH-$ |
| V-41 | 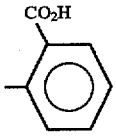 | H | $CH_3$ | $=CH-CH=CH-$ |
| V-42 | 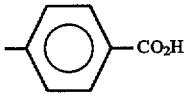 | H | $C_2H_5$ | $=CH-CH=CH-$ |
| V-43 | 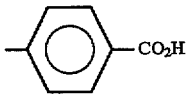 | $-CH_2CH_2OCH_3$ | $CH_3$ | $=CH-\overset{C_2H_5}{\overset{\vert}{C}}=CH-$ |
| V-44 | 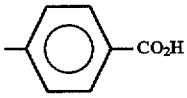 | H | $CH_3$ | $=CH-\overset{Cl}{\overset{\vert}{C}}=CH-$ |
| V-45 | 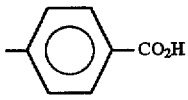 | H | $CO_2H$ | $=CH-\overset{CH_3}{\overset{\vert}{C}}=CH-$ |
| V-46 | 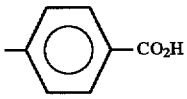 | H | $CO_2H$ | $=CH-\overset{Cl}{\overset{\vert}{C}}=CH-$ |
| V-47 | $-CH_2CH_2CN$ | 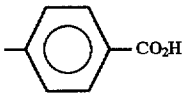 | $CH_3$ | $=CH-CH=CH-$ |
| V-48 | $-CH_2CH_2CN$ | 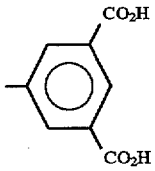 | $CH_3$ | $=CH-CH=CH-$ |

-continued

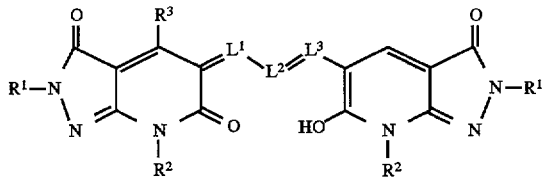

| | $R^1$ | $R^2$ | $R^3$ | $=L^1-L^2=L^3-$ |
|---|---|---|---|---|
| V-49 | 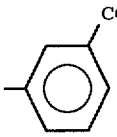 | H | $CH_3$ | $=CH-CH=CH-$ |
| V-50 | 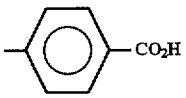 | H | $CH_3$ | $=CH-CH=CH-CH=CH-$ |
| V-51 | $CH_3$ | 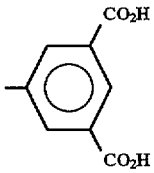 | $CH_3$ | $=CH-CH=CH-CH=CH-$ |

The dye for use in the present invention can be prepared in the same manner as or a similar manner to the methods as described in, for example, WO 88/04794, EP 274,723A1, 276,566, and 299,435, JP-A-92716/1977, JP-A-155351/1980, JP-A-205934/1986, JP-A-68623/1973, U.S. Pat. Nos. 2,527,583, 3,486,897, 3,746,539, 3,933,798, 4,130,429, and 4,040,841, JP-A-282244/1991, JP-A-7931/1991, and JP-A-167546/1991.

The compound represented by general formula (I) is explained below.

Typical examples of the compound of general formula (I) include random or block copolymers of vinyl alcohol and vinylester, or these copolymers composed of the third monomer having an anionic group such as a carboxyl group in addition to these monomers, with the end of these copolymers being modified with an alkyl group or a hydrophobic polymer.

The problems encountered with the use of a dispersion of dye in a form of solid fine grains, such as difficulties in coating due to an interaction between the dye and a binder (e.g., gelatin), and in obtaining a coating layer having a desired absorption are dissolved by a combination of the dye with the compound represented by formula (I).

It is preferred that the molecular weight of the compound of formula (I) for use in the present invention is larger than surface active agents conventionally used in the art of photography, i.e., the molecular weight is 1,000 or greater. Further, the conventional surface active agent usually has any one of a nonionic alkyleneoxide group such as an ethylene oxide group, an anionic group such as a carboxylic group, a sulfone group and a phosphoric acid group, and a cationic group such as a quaternary ammonium group as a hydrophilic group. In contrast, the hydrophilic group of the compound of formula (I) is necessary to have any one of a recurring structure of the monomer unit containing a hydroxyl group, a recurring structure having an anionic group, and a recurring structure having a cationic group.

The compound of formula (I) can be also used as a coating aid, an antistatic agent, a surface friction-controlling agent and a material which renders the surface hydrophobic.

The hydrophobic group of R in general formula (I) includes an aliphatic group (e.g., an alkyl group, an alkenyl group, an alkynyl group), an aromatic group (e.g., a phenyl group, a naphthyl group), and an alicyclic group, each of which may be substituted with a substituent. Examples of the substituent include an aliphatic group, an aromatic group, an alicyclic group, a heterocyclic group, a halogen atom, a hydroxyl group, a cyano group, a nitro group, a N-substituted sulfamoyl group, a carbamoyl group, an acylamino group, an alkylsulfonylamino group, an arylsulfonylamino group, an alkoxy group, an aryloxy group, an aralkyl group, and an acyl group.

When the hydrophobic group of R in general formula (I) is an alkyl group, the alkyl group generally has 3 to 70 carbon atoms, preferably 4 to 50, and most preferably 8 to 24.

Further, when R is a substituted or unsubstituted alicyclic group, aromatic hydrocarbon group or hydrophobic polymer, the improvement in dispersion stability is more effective.

Further, when R in general formula (I) is a hydrophobic polymer, the hydrophobic polymer includes water-insoluble vinyl polymers or copolymers such as polystyrene and its derivatives, a polymethacrylic acid ester (e.g., polymethyl methacrylate) and its derivatives, a polyacrylic acid ester and its derivatives, polybutene, polyvinyl acetate, and vinylester polymer of saturated tertiary alkyl monocarboxylic acid (e.g., "Versatic" acid: trade name of Shell UK); water-insoluble polyoxyalkylenes such as polyoxypropylene and polyoxytetramethylene; and other water-insoluble polymers such as a polyamide and a polyester. Especially preferred of these polymers, are polystyrene and its derivatives, a polymethacrylic acid ester and its derivatives, a polyacrylic acid ester and its derivatives and polyvinyl chloride. Further, a polymerization degree of the hydrophobic polymer is generally from 2 to 500, preferably from 2 to 200, and still preferably from 2 to 100.

Specific examples of the above-described hydrophobic group of R in general formula (I) are illustrated below, but it should be noted that the present invention is not restricted thereto.
$n\text{-}C_{12}H_{25}-$ (S-1)
$C_{16}H_{33}-$ (S-2)
$C_{12}H_{25}NHCOCH_2-$ (S-3)
$C_{12}H_{25}OCH_2CH_2-$ (S-4)
$(C_{18}H_{37})_2NCH_2CH_2CH_2-$ (S-5)
$C_2H_5SO_2CH_2CH_2-$ (S-6)
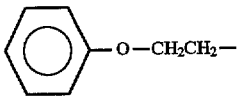
(S-7)
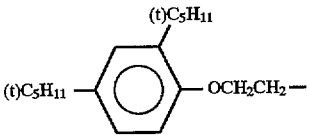
(S-8)
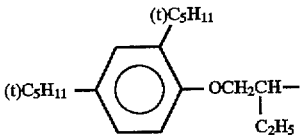
(S-9)
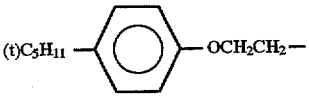
(S-10)
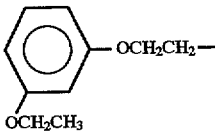
(S-11)
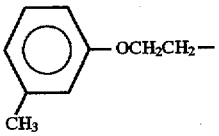
(S-12)
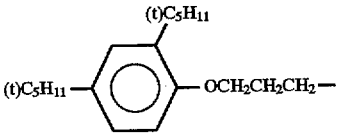
(S-13)
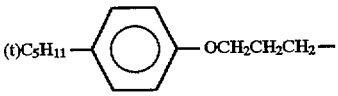
(S-14)
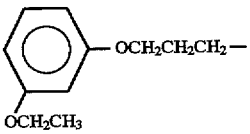
(S-15)
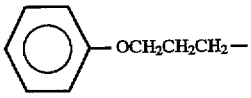
(S-16)
-continued
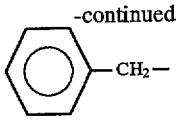
(S-17)
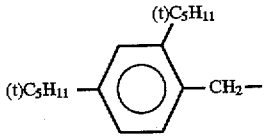
(S-18)
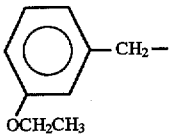
(S-19)
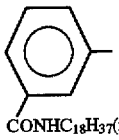
(S-20)
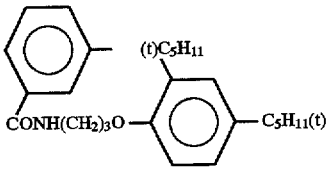
(S-21)
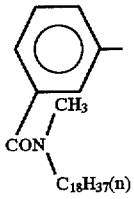
(S-22)
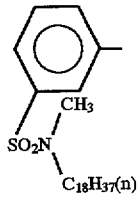
(S-23)
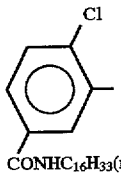
(S-24)
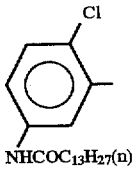
(S-25)
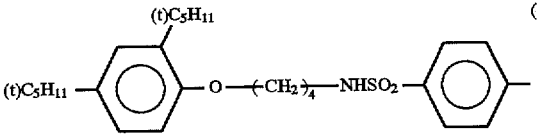
(S-26)

-continued
(S-27)
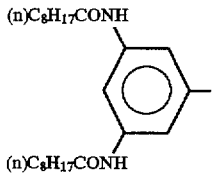
(S-28)
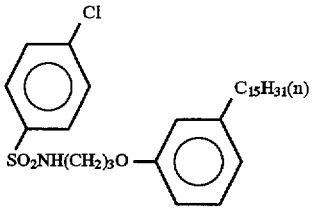
(S-29)
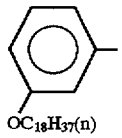
(S-30)
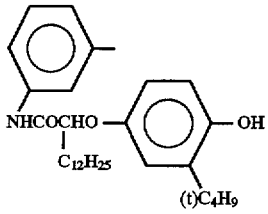
(S-31)
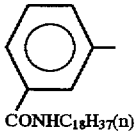
(S-32)
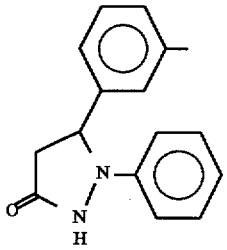
(S-33)
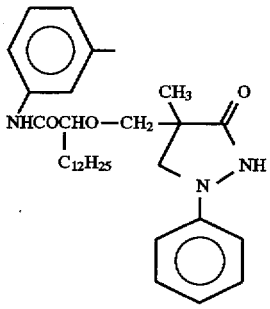
-continued
(S-34)
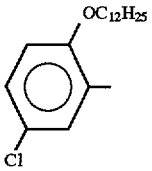
(S-35)
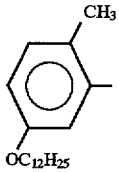
(S-36)
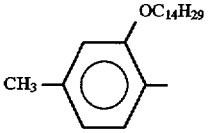
(S-37)
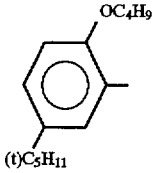
(S-38)
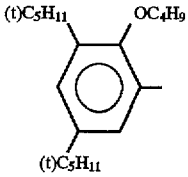
(S-39)
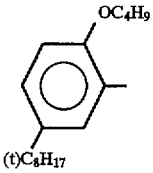
(S-40)
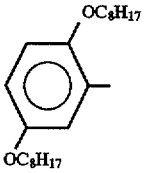
(S-41)
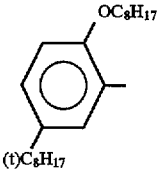
(S-42)
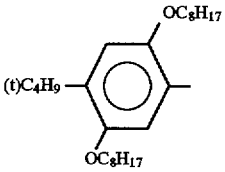

-continued (S-43)

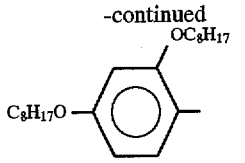

(S-44)

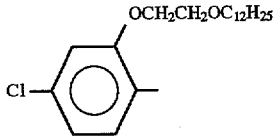

(S-45)

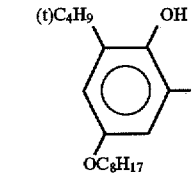

(S-46)

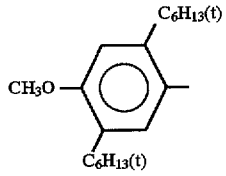

(S-47)

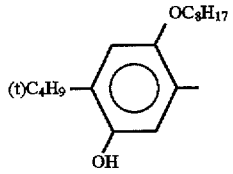

(S-48)

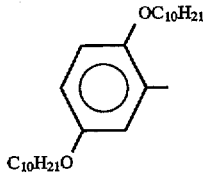

(S-49)

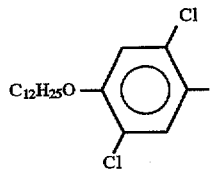

(S-50)

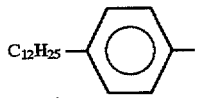

(S-51)

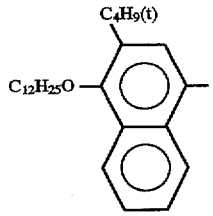

With respect to the compound of general formula (I) for use in the present invention, the polymer P is a polymer containing at least one of the above-described structure units A, B and C.

Specific examples of the structure unit A constituting the polymer P include vinyl alcohol, α-methylvinyl alcohol, and α-propylvinylalcohol.

The structure unit B constituting the polymer P includes vinyl acetate, vinyl formate, vinyl propionate and a α-substituted material of these vinyl esters.

Further, the structure unit C constituting the polymer P includes monomer units which is subjected to ionic dissociation in water, such as acrylic acid, methacrylic acid or crotonic acid each including its ammonium salts and metal salts such as a sodium salt and a potassium salt; maleic acid or itaconic acid each including its monoalkyl esters, ammonium salts and metal salts such as a sodium salt and a potassium salt; vinyl phosphonic acid, vinyl sulfuric acid, acryl sulfonic acid, methacryl sulfonic acid, 2-acrylamido-3-methylpropanesulfonic acid or 2-methacrylamido-3-methylpropanesulfonic acid including its ammonium salts and metal salts such as a sodium salt and a potassium salt; and acrylamidopropyl trimethylammonium chloride or methacryl amidopropyl trimethylammonium chloride.

Preferred of these monomers, are a vinyl alcohol unit as the structure unit A; a vinylacetate unit as the structure unit B; and a carboxylic acid unit or a sulfonic acid unit each including its ammonium salts and metal salts such as a sodium salt and a potassium salt as the structure unit C.

There is no specific limitation for an amount of the above-described structure units A, B and C constituting the polymer P. However, it is preferred that the amount of the structure unit A is from 50 mol % to 100 mol % in order to render the polymer of general formula (I) water-soluble or water-dispersive, where the amount of the structure unit C is 1 mol % or less.

The compounds of general formula (I) for use in the present invention include a variety of compounds ranging from water-soluble compounds to water-dispersive compounds. The polymer component P may contain any other structure unit than the above-described structure units A, B and C, so long as the compound of general formula (I) is water-soluble or water-dispersive. Examples of such the additional structure unit include ethylene, propylene, isobutene, acrylonitrile, acrylamide, methacrylamide, N-vinylpyrrolidone, vinyl chloride and vinyl fluoride.

A polymerization degree of the polymer component P is generally from 10 to 3,500, preferably from 10 to 2,000, more preferably 10 to 1,000, and most preferably 10 to 500.

The lower alkyl group of $R^2$ in the structure units A and B constituting the polymer component P includes an alkyl group having from 1 to 10 carbon atom(s). Especially, a methyl group is preferred. Further, the alkyl group may be substituted with a substitute such as a hydroxyl group, an amido group, a carboxyl group, a sulfonic acid group, a sulfinic acid group, and a sulfonamido group.

In the photographic composition, gelatin is most generally used for many good reasons such as superior photographic properties, production suitability and physical properties as a binder. When the compound of general formula (I) for use in the present invention is mixed with gelatin in an amount of 1 wt. % or more per gelatin, a compound having a composition compatible with gelatin is preferably used. Such the compound is preferably a compound in which the content of the structure unit B is 50 mol % or less and the structure unit C contains a carboxyl group in an amount of 5 mol % or more, preferably 10 mol % or more, and most preferably 15 mol % or more when the number of the carboxyl group is 1 per the unit, while the amount is 1/n of the above-described amounts when the number of the carboxyl group is n per the unit. In view of the compatibility with gelatin, the most preferred compounds of general formula (I) for use in the present invention are polymers in which the structure unit A contains vinyl alcohol in an amount of 50 mol % or more, the structure unit B contains in an amount of 40 mol % or less, and the structure unit C contains itaconic acid including its ammonium salts and metal salts such as a sodium salt and a potassium salt in an amount of 2 mol % or more.

An optimal chemical composition and molecular weight, etc. of P and R constituting the compound of general formula (I) for use in the present invention varies depending on purposes of the present invention. However, the compounds having a ratio by weight of P and R as shown by the formula below are especially superior for every purpose of the present invention.

$0.001 \leqq R/P \leqq 2$, more preferably $0.01 \leqq R/P \leqq 1$

Specific examples of the compound of general formula (I) for use in the present invention are illustrated below, but it should be noted that the present invention is not restricted thereto.

| | | | P | | | | | | |
|---|---|---|---|---|---|---|---|---|---|
| Compound No. | R | Degree of Polymerization | A *1 Content (mol %) | B *2 Content (mo %) | C Content (mol %) | | Degree of Polymerization | *3 n | *3 m |
| P-1 | (S-1) | — | 98 | 2 | — | | 300 | 1 | 1 |
| P-2 | (S-1) | — | 88 | 12 | — | | 300 | 1 | 1 |
| P-3 | (S-1) | — | 98 | 2 | — | | 200 | 1 | 1 |
| P-4 | (n)$C_4H_9$ | — | 90 | 10 | — | | 78 | 1 | 1 |
| P-5 | (t)$C_8H_{17}$ | — | 88 | 12 | — | | 88 | 1 | 1 |
| P-6 | (n)$C_{30}H_{61}$ | — | 88 | 12 | — | | 750 | 1 | 1 |
| P-7 | (n)$C_{18}H_{37}$ | — | 98 | 2 | — | | 260 | 1 | 1 |
| P-8 | $C_{12}H_{25}$ (branched) | — | 98 | 2 | — | | 300 | 1 | 1 |
| P-9 | Polymethyl methacrylate | 22 | 94.6 | 2.5 | $\leftarrow CH_2-CH(CONH-C(CH_3)_2-CH_2SO_3Na)\rightarrow$ | 3.0 | 110 | 1 | 1 |
| P-10 | Polystyrene | 20 | 93.6 | 1.4 | $\leftarrow CH_2-CH(COONa)\rightarrow$ | 5.0 | 150 | 1 | 1 |
| P-11 | Polyoxypropylene | 55 | 79.1 | 15.9 | $\leftarrow CH_2-C(CH_2COONa)(COONa)\rightarrow$ | 5.0 | 440 | 1 | 1 |
| P-12 | Polystyrene | 10 | 89.7 | 0.3 | $\leftarrow CH_2-C(CH_2COONa)(COONa)\rightarrow$ | 10.0 | 45 | 2 | 1 |
| P-13 | Polystyrene | 10 | 0 | 70.0 | $\leftarrow CH_2-CH(CONH-C(CH_3)_2-CH_2SO_3Na)\rightarrow$ | 30.0 | 105 | 1 | 1 |
| P-14 | Polyoxypropylene | 50 | 95.6 | 2.4 | $\leftarrow CH_2-CH(CONH-C(CH_3)_2-CH_2SO_3Na)\rightarrow$ | 2.0 | 110 | 2 | 1 |
| P-15 | Polystyrene | 20 | 95.4 | 1.6 | $\leftarrow CH_2-C(CH_2COONa)(COONa)\rightarrow$ | 3.0 | 85 | 2 | 1 |
| P-16 | Polystyrene | 20 | 88 | 2 | $\leftarrow CH_2-C(CH_2COONa)(COONa)\rightarrow$ | 5.0 | 300 | 1 | 1 |
| P-17 | Polymethyl methacrylate | 30 | 88 | 2 | $\leftarrow CH_2-C(CH_2COONa)(COONa)\rightarrow$ | 7.5 | 300 | 1 | 1 |

-continued

| Compound No. | R | Degree of Polymerization | P: A *1 Content (mol %) | P: B *2 Content (mo %) | P: C Content (mol %) | | P: Degree of Polymerization | *3 n | *3 m |
|---|---|---|---|---|---|---|---|---|---|
| P-18 | Poly n-butyl acrylate | 30 | 88 | 2 | $\leftarrow CH_2-\underset{\underset{COONa}{\vert}}{\overset{\overset{CH_2COONa}{\vert}}{C}}\rightarrow$ | 10.0 | 300 | 1 | 1 |
| P-20 | (S-1) | — | 88 | 2 | $\leftarrow CH_2-\underset{\underset{COONa}{\vert}}{\overset{\overset{CH_2COONa}{\vert}}{C}}\rightarrow$ | 10.0 | 400 | 1 | 1 |
| P-21 | (S-1) | — | 88 | 2 | $\leftarrow CH_2-\underset{\underset{COONa}{\vert}}{\overset{\overset{CH_2COONa}{\vert}}{C}}\rightarrow$ | 7.5 | 300 | 1 | 1 |
| P-22 | (S-1) | — | 88 | 2 | $\leftarrow CH_2-\underset{\underset{COONa}{\vert}}{\overset{\overset{CH_2COONa}{\vert}}{C}}\rightarrow$ | 5.0 | 300 | 1 | 1 |
| P-23 | Poly n-butyl methacrylate | 10 | 98 | 2 | — | | 300 | 1 | 1 |
| P-24 | Polystyrene | 20 | 98 | 2 | — | | 300 | 1 | 1 |
| P-25 | (S-7) | — | 98 | 2 | — | | 180 | 1 | 1 |
| P-26 | (S-8) | — | 98 | 2 | — | | 110 | 1 | 1 |
| P-27 | (S-10) | — | 98 | 2 | — | | 190 | 1 | 1 |
| P-28 | (S-18) | — | 98 | 2 | — | | 88 | 1 | 1 |
| P-29 | (S-27) | — | 98 | 2 | — | | 200 | 1 | 1 |
| P-30 | (S-50) | — | 98 | 2 | — | | 200 | 1 | 1 |
| P-31 | (S-39) | — | 93 | 2 | $\leftarrow CH_2\underset{\underset{COOH}{\vert}}{\overset{\overset{CH_2COONa}{\vert}}{C}H}\rightarrow$ | 5.0 | 400 | 1 | 1 |
| P-32 | (S-50) | — | 93 | 2 | $\leftarrow CH_2\underset{\underset{COOH}{\vert}}{\overset{\overset{CH_2COONa}{\vert}}{C}H}\rightarrow$ | 5.0 | 400 | 1 | 1 |
| P-33 | (S-1) | — | 93 | 2 | $\leftarrow \underset{\underset{COONa}{\vert}}{CH}\rightarrow\!\!-\!\!\leftarrow \underset{\underset{COONa}{\vert}}{CH}\rightarrow$ | 5.0 | 300 | 1 | 1 |
| P-34 | (S-39) | — | 93 | 2 | $\leftarrow \underset{\underset{COONa}{\vert}}{CH}\rightarrow\!\!-\!\!\leftarrow \underset{\underset{COONa}{\vert}}{CH}\rightarrow$ | 5.0 | 300 | 1 | 1 |
| P-35 | (S-50) | — | 93 | 2 | $\leftarrow \underset{\underset{COONa}{\vert}}{CH}\rightarrow\!\!-\!\!\leftarrow \underset{\underset{COONa}{\vert}}{CH}\rightarrow$ | 5.0 | 300 | 1 | 1 |
| P-36 | Polystyrene | 20 | 93 | 2 | $\leftarrow \underset{\underset{COONa}{\vert}}{CH}\rightarrow\!\!-\!\!\leftarrow \underset{\underset{COONa}{\vert}}{CH}\rightarrow$ | 5.0 | 200 | 1 | 1 |
| P-37 | H | — | 97 | 2 | $\leftarrow CH_2-\underset{\underset{COOH}{\vert}}{CH}\rightarrow$ | 1.0 | 400 | 1 | 0 |
| P-38 | H | — | 88 | 12 | — | | 300 | 1 | 0 |
| P-39 | H | — | 88 | 10 | $\leftarrow CH_2-\underset{\underset{COOH}{\vert}}{CH}\rightarrow$ | 2.0 | 300 | 1 | 0 |

(Note)

*1 $\leftarrow CH_2-\underset{\underset{OH}{\vert}}{CH}\rightarrow$

-continued

| Compound No. | R | Degree of Polymerization | P: A *1 Content (mol %) | P: B *2 Content (mo %) | P: C Content (mol %) | P: Degree of Polymerization | *3 n | *3 m |
|---|---|---|---|---|---|---|---|---|
| *2 $\leftarrow CH_2-\underset{\underset{OCOCH_3}{\vert}}{CH}\rightarrow$ | | | | | | | | |
| *3 $P\leftarrow(S\rightarrow_m R)_n$ | | | | | | | | |

An amount of the compound of general formula (I) for use in the present invention varies depending on physical properties and an amount of the dispersion of dye in the form of solid fine grains to be used, but generally from 0.001 $g/m^2$ to 10 $g/m^2$, and preferably from 0.002 $g/m^2$ to 5 $g/m^2$. The compound of general formula (I) may be used as a dispersing agent when the dispersion is prepared, or may be mixed therewith after dispersion or just before coating.

The compound of general formula (I) can be prepared by the methods as described in, for example, JP-A-288643/1987, JP-A-254237/1986, JP-A-254238/1986, JP-A-254239/1986 and JP-A-254240/1986. The polymers in which R in general formula (I) is an alkyl group are available in the market, such as MP-103, MP-203 and MP-102 (manufactured by Kurare).

The dye for use in the present invention is subjected to heat treatment before the same is incorporated in a light-sensitive material, whereby superior effects of the present invention are obtained. The heat treatment includes a method in which heating is conducted before the step of finely dispersing the dye in the form of solid grains (e.g., a powdered dye is heated in a solvent), a method in which the dispersion is conducted without cooling or at an elevated temperature when the dye is dispersed with a dispersing agent to water or other solvent, or a method in which a dispersed solution or a coating solution is heated. It is especially preferred that heating is carried out after dispersion.

The pH during heat treatment at the dispersion or after the dispersion is not especially limited so long as the dispersion is held stably, but preferably from 2.0 to 8.0, more preferably from 3.0 to 7.0, and still more preferably from 3.5 to 7.5. The pH adjustment of the dispersion is conducted by the use of sulfuric acid, chloric acid, acetic acid, citric acid, phosphoric acid, oxalic acid, carbonic acid, sodium hydrogen carbonate, sodium carbonate, sodium hydrooxide, potassium hydroxide, or a buffer solution containing these compounds. The terminology "the pH of the dispersion" used herein means a value at 25° C.

The temperature for heat treatment is not definitely described because a suitable temperature varies depending on a step of heat treatment, a size or form of the powder or grains, a condition for the heat treatment, a dispersion medium (solvent), etc., but from 40° C. up to the temperature at which the dye to be used does not decompose. When the dye in the form of a powder is heated, a suitable temperature is from 40° C. to 200° C., preferably from 50° C. to 150° C. When the dye is heated in a dispersion medium, a suitable temperature is from 40° C. to 150° C., preferably from 50° C. to 150° C. When the dye is heated during dispersion, a suitable temperature is from 40° C. to 90° C., preferably from 50° C. to 90° C. When a solution of the dispersed dye is heated, a suitable temperature is from 40° C. to 100° C., preferably from 50° C. to 95° C.

In the case where heat treatment is conducted in a dispersion medium, any kinds of media can be used except for the medium which dissolves the dye. Examples of the medium include water, alcohols (e.g., methanol, ethanol, isopropylalcohol, butanol, isoamylalcohol, octanol, ethylene glycol, diethylene glycol, ethyl cellosolve), ketones (e.g., acetone, methylethylketone), esters (e.g., ethyl acetate, butyl acetate), alkylcarbonic acids (e.g., acetic acid, propionic acid), nitriles (e.g., acetonitrile), esters (e.g., dimethoxyethane, dioxane, tetrahydrofurane), and amides (e.g., dimethylformamide).

Further, even though the dye dissolves in a single use of the above-described medium, such the medium can be used by mixing with water or other media, or by adjusting the pH value unless the dye substantially dissolves therein.

The time for the heat treatment is not definitely described. That is, if the applied temperature is low, a longer time is necessary, whereas the higher temperature, the shorter time. The time optionally can be set in such a period that the heat treatment is conducted without any adverse influence to production processes. Generally, the period of time ranging from 1 hr. to 4 days is preferable.

The dispersion of dye in the form of solid fine grains for use in the present invention can be prepared according to the publicly known methods. Details of the preparation processes are described in, for example, *Applied technology of functional dyes*, published by C. M. C (1991).

The media dispersion is one of ordinary methods. According to the method, a powder of dye or a dye wetted with water or an organic solvent, which is called a wet cake, is used to make an aqueous slurry, and mechanically pulverized by means of a publicly known pulverizer (e.g., ball mill, vibration ball mill, planetary ball mill, vertical sand mill, roller mill, pin mill, Co Ball Mill (Fryma), caddy mill, horizontal sand mill, attriter (attrition mill)), in the presence of dispersion media (e.g., steel ball, ceramic ball, glass beads, alumina beads, zirconia silicate beads, zirconia beads, Ottawa sand). Of these dispersion media, there can be used beads having an average diameter of preferably 2 mm to 0.3 mm, more preferably from 1 mm to 0.3 mm, and still more preferably from 0.5 mm to 0.3 mm. In place of the above-described methods, there can be also used methods for pulverization by means of jet mill, roll mill, homogenizer, colloid mill or dissolver, or by means of an ultrasonic dispersing machine.

Further, methods of precipitating a dye in the form of solid fine grains by dissolving the dye in a solvent to make an uniform solution, and then adding a poor solvent to the solution, as described in U.S. Pat. No. 2,870,012, or alternatively by dissolving the dye in an alkaline solution, followed by a reduction in pH, as described in, for example, JP-A-182743/1991, are also used.

These dispersions of dye in the form of solid fine grains are preferably prepared in the presence of a dispersant. Examples of the hitherto known dispersant include anionic dispersants such as a condensation product of formaldehyde with alkylphenoxyethoxysulfonic acid salts, alkylbenzenesulfonic acid salts, alkylnaphthalenesulfonic acid salts, alkylsulfate ester salts, alkylsulfosuccinic acid salts, sodium oleilmethyltauride, or naphthalene sulfonic acid, polyacrylic acid, polymethacrylic acid, a copolymer of maleic acid and acrylic acid, carboxymethyl cellulose and cellulose sulfate; nonionic dispersants such as polyoxyethylene alkyl ether, sorbitan fatty acid ester, and polyoxyethylenesorbitan fatty acid ester; cationic dispersants and betain dispersants.

Of these dispersants, polyalkyleneoxides represented by the following general formula (I-a) or (I-b) are particularly preferred.

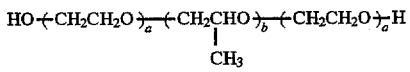

formula (I-a)

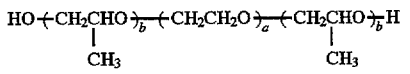

formula (I-b)

wherein a and b each represents a value of 5 to 500.

In the above-described dispersants, a ratio by weight of the polyethylene portion is preferably from 0.3 to 0.9, more preferably from 0.7 to 0.9, and still more preferably from 0.8 to 0.9. Further, an average molecular weight of the dispersant is preferably from 1,000 to 30,000, more preferably from 5,000 to 40,000, and still more preferably from 8,000 to 20,000. Further, the HLB (hydrophilic and oleophilic balance) value is preferably from 7 to 30, more preferably from 12 to 30, and still more preferably from 18 to 30.

These compounds are available at a market. For example, Pluronic manufactured by BASF is put on the market.

Specific examples of the compound represented by general formula (I-a) or (I-b) for use in the present invention are illustrated below.

formula (I-a)

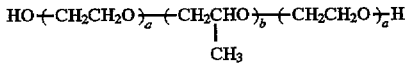

| No. | Ratio by weight of Polyethyleneoxide | Average molecular weight | HLB | No. | Ratio by weight of Polyethyleneoxide | Average molecule weight | HLB |
|---|---|---|---|---|---|---|---|
| I-1 | 0.5 | 1900 | ≧18 | I-11 | 0.7 | 7700 | ≧20 |
| I-2 | 0.8 | 4700 | ≧20 | I-12 | 0.8 | 11400 | ≧20 |
| I-3 | 0.3 | 1850 | 7~12 | I-13 | 0.8 | 13000 | ≧20 |
| I-4 | 0.4 | 2200 | 12~18 | I-14 | 0.3 | 4950 | 7~12 |
| I-5 | 0.4 | 2900 | 12~18 | I-15 | 0.4 | 5900 | 12~18 |
| I-6 | 0.5 | 3400 | 12~18 | I-16 | 0.5 | 6500 | 12~18 |
| I-7 | 0.8 | 8400 | ≧20 | I-17 | 0.8 | 14600 | ≧20 |
| I-8 | 0.7 | 6600 | ≧20 | I-18 | 0.3 | 5750 | 7~12 |
| I-9 | 0.4 | 4200 | 12~18 | I-19 | 0.7 | 12600 | ≧18 |
| I-10 | 0.5 | 4600 | 12~18 | | | | |

formula (I-b)

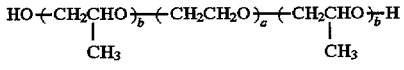

| No. | Ratio by weight of Polyethyleneoxide | Average molecular weight | HLB |
|---|---|---|---|
| I-20 | 0.5 | 1950 | 12~18 |
| I-21 | 0.4 | 2650 | 7~12 |

-continued formula (I-b)

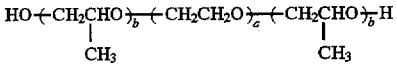

| No. | Ratio by weight of Polyethyleneoxide | Average molecular weight | HLB |
|---|---|---|---|
| I-22 | 0.4 | 3600 | 7~12 |
| I-23 | 0.8 | 8600 | 12~18 |

In the present invention, a ratio by weight of the above-described dispersants to the dye of the present invention is preferably from 0.05 to 0.5, and more preferably from 0.1 to 0.3.

Further, a dispersion of dye in the form of solid fine grains can be prepared in the presence of hydrophilic colloids such as polyvinylalcohol, polyvinylpyrrolidone, polyethylene glycol, polysaccharide and gelatin in order to stabilize the dispersion, or to reduce the viscosity of the dispersion.

A layer containing fine grains of dye can be set in a photographic material by coating on a suitable support, an almost homogeneous dispersion of solid fine grains prepared by dispersing the thus obtained fine grains in a suitable binder.

The above-described binder can be used with no limitation, so long as the binder is a hydrophilic colloid which is usable for a light-sensitive emulsion layer or a light-insensitive layer. Generally, gelatin or synthetic polymers such as polyvinyl alcohol and polyacrylamide are used.

An average grain size of the fine grains in a solid fine grain dispersion is generally from 0.005 μm to 10 μm, preferably from 0.01 μm to 1 μm, and more preferably from 0.01 μm to 0.7 μm.

The solid fine grain dispersion of dye for use in the present invention is preferably incorporated in a light-insensitive hydrophilic colloid layer (e.g., a filter layer, an antihalation layer, a crossover cut filter layer) of the silver halide photographic light-sensitive material according to a hue of the dye. In a light-sensitive material containing two or more light-insensitive layers, the solid fine grain dispersion may be incorporated in these light-insensitive layers.

A density of the dye in a solid fine grain dispersion in the present invention is generally from 0.1 wt. % to 50 wt. %, and preferably from 2 wt. % to 30 wt. %. The amount of the dye to be used in a photographic light-sensitive material varies depending on its hue and function, etc., but generally it is from 1 mg/m$^2$ to 1,000 mg/m$^2$, preferably from 5 mg/m$^2$ to 300 g/m$^2$, and still more preferably from 5 mg/m$^2$ to 200 mg/m$^2$.

The present invention provides a silver halide photographic light-sensitive material having excellent effects, such that the dispersion of dye in the form of solid fine grains is prevented from changing with the lapse of time, and that variation in the absorption spectrum of the dispersion of solid fine grains is considerably minimized, and further that the layer strength is markedly high. Further, the present invention provide a silver halide photographic light-sensitive material containing the dispersion of dye in the form of solid fine grains, which material is able to simplify the processing steps and also to reduce the load of replenishment of the processing solution. The above-mentioned dispersion of dye in the form of solid fine grains exerts excellent effects, such that the dispersed dye does not migrate through hydrophilic colloidal layers during storage of the light-sensitive material, and the dye is photochemically inert and still has excellent light-absorption characteristics, and moreover the dye can easily be decolored and/or diluted, so that it does not cause a stain due to a residual color at the developing process.

EXAMPLE

Example 1

Preparation of a solid fine-grain dispersion

A methanol wet cake of the dye: exemplified compound (V-1) was weighed, so that the net weight of the compound was 240 g. To the wet cake, was added 48 g of the dispersant: exemplified compound (I-12), and then water, to make 4000 g. The mixture was pulverized by means of a "distribution-type sand grinder mill (UVM-2, manufactured by IMEX K.K.)" filled with 1.7 l of zirconia beads (diameter 0.5 mm), in an output amount of 0.5 l/min at a running speed of 10 m/sec, for 2 hours. After that, the pH value of the dispersion was adjusted to 4.0 with a 2 wt. % aqueous $NaHCO_3$ solution, and then the dispersion was diluted with water, to obtain the dispersion (a) containing 3 wt. % of dye. The dispersion (a) was heated at 90° C. for 10 hours, with stirring, and then it was cooled to a room temperature, to obtain the dispersion (b). The exemplified compound P-2 was each added to the dispersions (a) and (b) in an amount of 3 wt. % based on the dye to obtain the dispersions (c) and (d), respectively. The grain size of the dispersed solid dye in the dispersions (a) to (d) was each about 0.50 μm.

The following evaluation was conducted using these dispersions.

Preparation of the dispersion solution for coating and Evaluation of variation of absorption spectrum in a coating layer To 1800 g of a 10% aqueous gelatin solution at 40° C., was added 840 g of the above-described dispersion while stirring, and further stirred for 10 min. to obtain a dispersion solution for coating. A viscosity of the dispersion solution for coating was measured just after the preparation, after 3 hrs. at 40° C. and after 6 hrs. at 40° C., respectively. The viscosity of the dispersion solution for coating is preferably from 40 cp to 80 cp. Further, if the viscosity varies with the lapse of time after preparation, it is difficult to keep its optimum viscosity balance with other layers. Therefore, variation in viscosity is not desirable for the stability of production.

Besides, the coating layers as shown below were prepared by the use of the thus obtained dispersion solution for coating.

| Layer Structure | | |
|---|---|---|
| Support | Polyethylene terephthalate film having coated thereon a subbing layer (Thickness 120 μm) | |
| First Layer (Dispersion-containing layer) | Gelatin | 1.00 g |
| | Solid fine grain dispersion of dye | 0.14 g |
| Second Layer (Protective layer) | Gelatin | 1.00 g |

Absorption spectrum of the thus prepared coating layers was measured by means of a spectrometer, and the ratio of density of absorption at 750 nm ($D_{750}$) to density of absorption at 600 nm ($D_{600}$) (the ratio of density of absorption $D_{750}/D_{600}$) was calculated. It is ideal that the ratio of density of absorption does not vary with the lapse of time after preparation of the dispersion solution for coating.

Variations in viscosity of the dispersion solution for coating and in absorption spectrum of the coating layers by the use of the dispersions (a) to (d) were evaluated. The results which were obtained are shown in Table 1.

TABLE 1

| | Dispersion | | | Lapse of time | Viscosity of Coating- | Coating layer Rate of | |
|---|---|---|---|---|---|---|---|
| No. | Kind | Heat treatment | Polymer of Invention | for coating-dispersion | dispersion (cp) | Density of Absorption | Remarks |
| 101 | (a) | none | absence | 0 | 70 | 1.30 | Comparison |
| 102 | (a) | none | absence | 3 | 120 | 1.68 | Comparison |
| 103 | (a) | none | absence | 6 | 600 | 2.05 | Comparison |
| 104 | (b) | done | absence | 0 | 45 | 1.18 | Comparison |
| 105 | (b) | done | absence | 3 | 55 | 1.36 | Comparison |
| 106 | (b) | done | absence | 6 | 75 | 1.54 | Comparison |
| 107 | (c) | none | presence | 0 | 60 | 1.20 | Comparison |
| 108 | (c) | none | presence | 3 | 72 | 1.36 | Comparison |
| 109 | (c) | none | presence | 6 | 85 | 1.56 | Comparison |
| 110 | (d) | done | presence | 0 | 40 | 0.96 | Invention |
| 111 | (d) | done | presence | 3 | 40 | 0.97 | Invention |
| 112 | (d) | done | presence | 6 | 40 | 0.98 | Invention |

As is apparent from the results in Table 1, only Sample Nos. 110 to 112, in which a dispersion has been subjected to heat treatment and a polymer for the use in the present invention is incorporated therein, are excellent for the production stability because of no increase in viscosity and further for the spectral absorption characteristics of the coating layers because of a minimum variation in the ratio of density of absorption even after the lapse of 6 hrs. (Sample No. 112).

Example 2

Dispersions 201 to 230 were prepared in the same manner as the Dispersion (d) prepared in Example 1, except that the condition at the heating, and kinds and amounts of the polymer for the use in the present invention were altered. Absorption spectra of coating layers prepared in the same manner as Example 1 except for using these dispersions were measured, and the percentage (%) of variation in the ratio of density of absorption of the dispersion solutions for coating after and before the lapse of 6 hrs., as shown by the following formula, was evaluated.

Percentage (%) of variation in the ratio of density of absorption={(ratio of density of absorption after the lapse of 6 hrs./ratio of density of absorption just after the preparation of the dispersion)−1}×100

The closer to 0 the percentage of variation in the ratio of density of absorption, the better, because variation in absorption spectrum becomes less.

The results which were obtained are shown in Table 2.

TABLE 2

| | Condition of Heat treatment | | | Polymer of Invention | | Ratio of Variation in |
|---|---|---|---|---|---|---|
| No. | pH at heating | Heat temperature (°C.) | Heat period of time (hr) | Kind | Amount relative To Dye (%) | Rate of Density of Absorption (%) |
| 201 | — | — | — | — | — | 58 |
| 202 | — | — | — | P-2 | 3 | 30 |
| 203 | 4.0 | 90 | 10 | — | — | 31 |
| 204 | 1.8 | 90 | 10 | P-2 | 3 | 5 *1 |
| 205 | 2.4 | 90 | 10 | P-2 | 3 | 3 |
| 206 | 4.0 | 90 | 10 | P-2 | 3 | 2 |
| 207 | 5.4 | 90 | 10 | P-2 | 3 | 2 |
| 208 | 7.0 | 90 | 10 | P-2 | 3 | 2 |
| 209 | 8.0 | 90 | 10 | P-2 | 3 | — *2 |
| 210 | 4.0 | 80 | 10 | P-2 | 3 | 4 |
| 211 | 4.0 | 80 | 24 | P-2 | 3 | 2 |
| 212 | 4.0 | 60 | 24 | P-2 | 3 | 4 |
| 213 | 4.0 | 60 | 48 | P-2 | 3 | 2 |
| 214 | 4.0 | 50 | 24 | P-2 | 3 | 6 |
| 215 | 4.0 | 50 | 48 | P-2 | 3 | 4 |
| 216 | 4.0 | 50 | 96 | P-2 | 3 | 2 |
| 217 | 4.0 | 40 | 48 | P-2 | 3 | 8 |
| 218 | 4.0 | 40 | 96 | P-2 | 3 | 6 |
| 219 | 4.0 | 40 | 192 | P-2 | 3 | 3 |
| 220 | 4.0 | 90 | 10 | P-1 | 3 | 3 |
| 221 | 4.0 | 90 | 10 | P-3 | 3 | 3 |
| 222 | 4.0 | 90 | 10 | P-22 | 3 | 4 |
| 223 | 4.0 | 90 | 10 | P-37 | 3 | 6 |
| 224 | 4.0 | 90 | 10 | P-38 | 3 | 5 |
| 225 | 4.0 | 90 | 10 | P-1 | 10 | 2 |
| 226 | 4.0 | 90 | 10 | P-2 | 10 | 1 |
| 227 | 4.0 | 90 | 10 | P-3 | 10 | 3 |
| 228 | 4.0 | 90 | 10 | P-22 | 10 | 3 |
| 229 | 4.0 | 90 | 10 | P-37 | 10 | 3 |
| 230 | 4.0 | 90 | 10 | P-38 | 10 | 3 |

(Note)
*1 Cohesion partially occured during a heating of the dispersion.
*2 Cohesion occured so markedly during a heating of the dispersion that the coating was difficult.

As is apparent from the results in Table 2, variation in the ratio of density of absorption becomes less by heating the dispersion on the condition of pH 2 to 7 (Sample Nos. 205 to 208). Further, the higher heating temperature, the shorter is the time necessary to obtain an equal effect (Sample Nos. 206, 210 to 219).

Example 3

Onto a polyethylene terephthalate support having coated thereon a subbing layer (On the side opposite to the emulsion-coated surface, a resin layer containing carbon fine grains is set in a coating amount necessary to obtain transmitted density of 1.0) (thickness 120 μm), layers having the compositions as described below were multi-coated to obtain a multi-layer color photographic light-sensitive material (Sample 301).

Layer Constitution:

Compositions of the layers are mentioned below, in which the numerical value indicates the amount coated (g/m$^2$), and the amount of the silver halide emulsion coated is represented as silver therein.

| | |
|---|---|
| First Layer: Blue-Sensitive Emulsion Layer | |
| Silver iodobromide emulsion (1/8 (by mol of silver) mixture of gold- and sulfur-sensitized emulsion B1, of cubic grains with a mean grain size of 0.7 μm, and gold- and sulfur-sensitized emulsion B2; of cubic grains with a mean grain size of 0.4 μm; average halogen composition I/Br = 0.6 mol %: 99.4 mol %) | 0.50 |
| Gelatin | 1.66 |

-continued

| | |
|---|---|
| Yellow coupler (ExY) | 1.10 |
| Solvent (Solv-1) | 0.13 |
| Solvent (Solv-2) | 0.13 |

-continued

| | |
|---|---|
| (Cpd-1) | 0.0016 |
| (Cpd-2) | 0.0006 |
| (Cpd-3) | 0.006 |
| (Cpd-4) | 0.03 |
| Second Layer: Color-Mixing-Preventing Layer | |
| Gelatin | 0.40 |
| (Cpd-5) | 0.03 |
| Solvent (Solv-3) | 0.03 |
| Solvent (Solv-4) | 0.03 |
| Third Layer: Red-Sensitive Emulsion Layer | |
| Silver chlorobromide emulsion (1/3 (by mol of silver) mixture of gold- and sulfur-sensitized emulsion R1, of cubic grains with a mean grain size of 0.25 μm, and gold- and sulfur-sensitized emulsion R2, of cubic grains with a mean grain size of 0.1 μm; average halogen composition Br/Cl = 25 mol %: 75 mol %) | 0.44 |
| Gelatin | 2.12 |
| Cyan coupler (ExC) | 0.97 |
| (Cpd-6) | 0.18 |
| (Cpd-5) | 0.015 |
| Solvent (Solv-5) | 0.50 |
| Solvent (Solv-6) | 0.32 |
| (Cpd-7) | 0.0002 |
| (Cpd-8) | 0.003 |
| (Cpd-2) | 0.003 |
| Fourth Layer: Color-Mixing-Preventing Layer | |
| Gelatin | 0.40 |
| (Cpd-5) | 0.03 |
| Solvent (Solv-3) | 0.03 |
| Solvent (Solv-4) | 0.03 |
| Fifth Layer: Green-Sensitive Emulsion Layer | |
| Silver chlorobromide emulsion (1/3 (by mol of silver) mixture of gold- and sulfur-sensitized emulsion G1, of cubic grains with a mean grain size of 0.25 μm and gold- and sulfur-sensitized emulsion G2, of cubic grains with a mean grain size of 0.1 μm; average halogen composition Br/Cl = 25 mol %: 75 mol %) | 0.52 |
| Gelatin | 1.29 |
| Magenta coupler (ExM) | 0.61 |
| (Cpd-9) | 0.001 |
| (Cpd-5) | 0.012 |
| Solvent (Solv-3) | 0.15 |
| (Cpd-10) | 0.003 |
| (Cpd-11) | 0.002 |
| (Cpd-12) | 0.003 |
| Sixth Layer: Protective Layer | |
| Gelatin | 0.98 |
| Acrylic denaturated copolymer of polyvinyl alcohol (metamorphic grade 17%) | 0.05 |
| Liquid paraffin | 0.02 |

Compounds used are shown below.

ExY

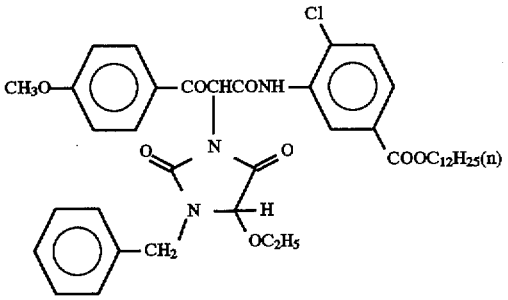

(1)

-continued

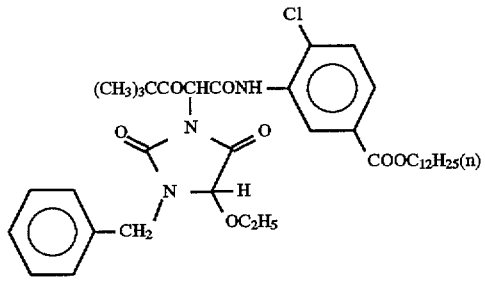

(2)

Mixture of (1), (2) (76:24 in weight ratio)

ExM

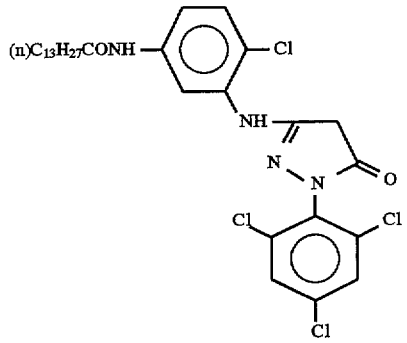

ExC

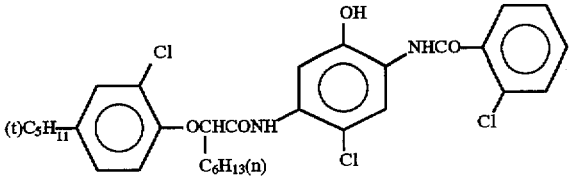

(1)

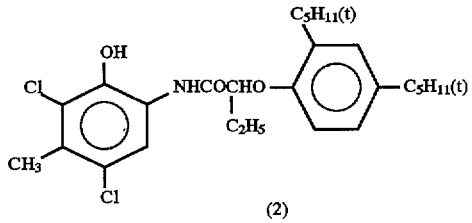

(2)

Mixture of (1), (2) (88:12 in weight ratio)

(Cpd-1)

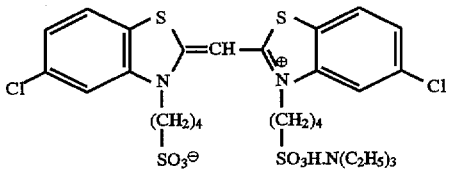

(Cpd-2)

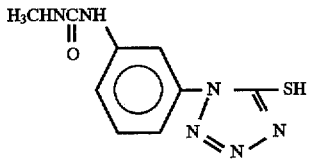

-continued (Cpd-3)

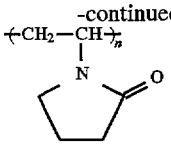

(Cpd-4)

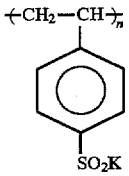

(Cpd-5)

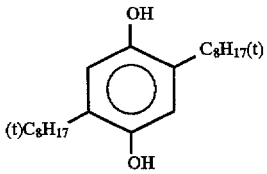

(Cpd-6)

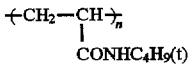

Av. molecular weight: ca. 60,000

(Cpd-7)

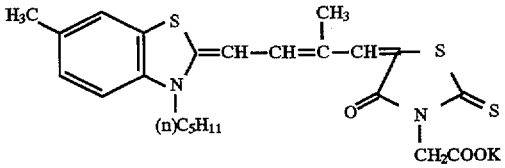

(Cpd-8)

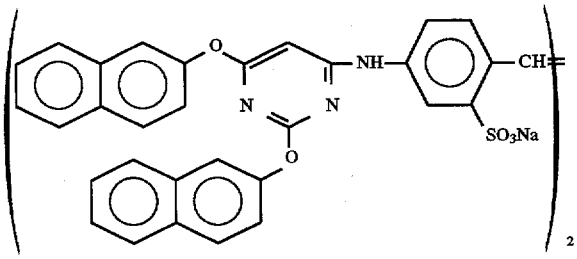

(Cpd-9)

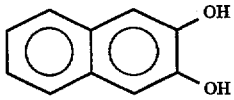

(Cpd-10)

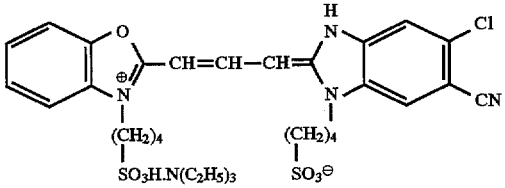

(Cpd-11)

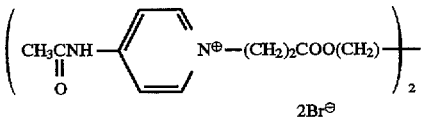

(Cpd-12)

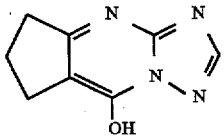

-continued (Solv-1)

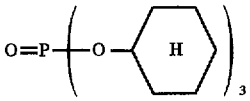

(Solv-2)

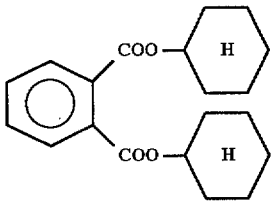

(Solv-3)

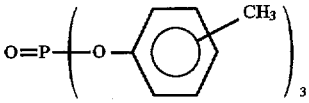

(Solv-4)

(Solv-5)

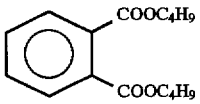

(Solv-6)

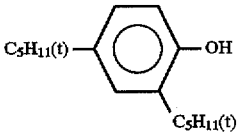

As a gelatin hardening agent for each layer, added thereto was 1-oxy-3,5-dichloro-s-triazine sodium salt, in an amount of 1.3 wt. % based on the gelatin.

For anti-irradiation, the following dyes were added to the respective emulsion layers, the coated amount being parenthesized.

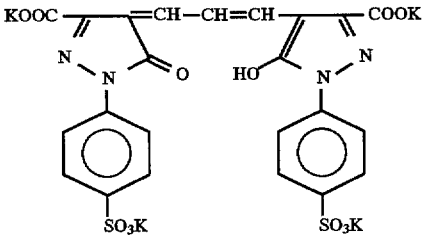

(0.043 g/m²)

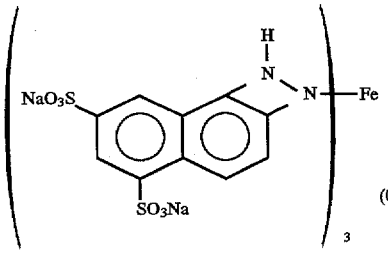

(0.098 g/m²)

-continued

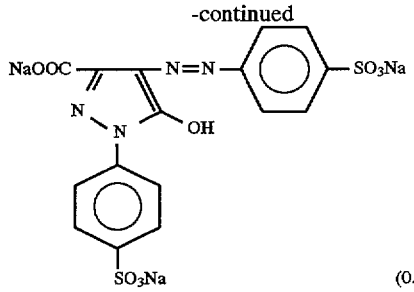

(0.008 g/m²)

Further, samples 302 to 309 were prepared in the same manner as sample 301, except that the resin layer on the back surface of the support was replaced by a hydrophilic colloidal layer containing the electric conductive polymer as illustrated below (0.05 g/m²) and fine grains of tin oxide (0.23 g/m²), and besides a layer containing solid fine grain dispersion having the composition shown below was additionally set between the surface of the support and the first layer.

The solid fine grain dispersion of dye was dispersed in the same manner as Example 1, and a dispersion solution for coating was prepared by the use of the dispersion. Thus, the light-sensitive material samples 302 to 309 were prepared. But, for the solid fine dispersion of dye (the exemplified compound (IV-4)), polynaphthalene sulfonic acid was used as a dispersant.

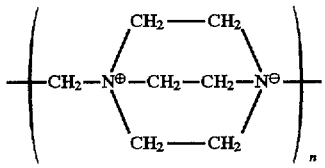

Each of the samples was exposed to light through an optical wedge for a measurement of sharpness, and then processed according to the ECP-2B process for a cinematographic color-posi published by Eastman Kodak company.

As a result of comparison tests on the CTF value of these samples, it was found that the values of samples 302 to 309 were equal to that of sample 301 with respect to cyan, magenta and yellow images, and therefore there was no substantial difference in the sharpness between the previous sample having coated a resin layer containing carbon black on the back surface of the support, and the samples containing the solid fine grain dispersion of dye.

Further, even the samples 302 to 309 were processed by the same process as the ECP-2B process, except that a step of removing the resin layer on the back surface of the sample (i.e., prebath and then jet washing) was omitted, these samples each provided the sharpness equal to that obtained by the ECP-2B process. Evaluation of the layer strength at the processing Each sample was exposed to white light, and then the emulsions-coated surface of each sample was scratched with a sapphire needle (its had a radius of curvature of 0.02 mm) to which a load of 500 g had been imparted, while drawing a checkered pattern on the surface. These samples were then processed according to the ECP-2B process by means of automatic developing apparatus at a line speed of 300 feet/min. The emulsion peeling at the periphery of the checkered scratches, if any, occurred on the processed sample was checked with the naked eye. Generally, the emulsion peeling easily occurs at the boundary between a layer containing the dispersion of solid fine grains and a photographic constituting layer coated thereon. The degree of the emulsion peeling, if any, was ranked by three ranks of "x", "Δ" and "○".

Evaluation Degree of Emulsion Peeling

○ No emulsion peeling occurred.

Δ The width of the portion at which the emulsion peeling occurs, from the scratch with the sapphire is 0.5 mm or shorter.

x The width of the portion at which the emulsion peeling occurs, from the scratch with the sapphire is longer than 0.5 mm.

The results of each sample thus obtained in the above evaluation are shown in Table 3 below.

TABLE 3

Layer containing Dispersion of Solid fine grains

| | | | | | |
|---|---|---|---|---|---|
| | Gelatin | | | 1.00 (g/m²) | |
| | Dispersion of Solid dye (IV-4) | | | 0.025 (g/m²) | |
| | Dispersion of Solid dye (V-1) | | | 0.140 (g/m²) | |
| Sample No. | Heat treatment | Polymer of Invention | Lapse of Time for Coating dispersion | Layer Strength | Remarks |
| 301 | — | — | — | o | Comparison *1 |
| 302 | none | absence | 0 | o | Comparison |
| 303 | none | absence | 6 | x | Comparison |
| 304 | 90° C.-10 hr | absence | 0 | o | Comparison |
| 305 | 90° C.-10 hr | absence | 6 | Δ | Comparison |
| 306 | none | P-2 | 0 | o | Comparison |
| 307 | none | P-2 | 6 | x | Comparison |
| 308 | 90° C.-10 hr | P-2 | 0 | o | Invention |
| 309 | 90° C.-10 hr | P-2 | 6 | o | Invention |

(Note)
*1 Sample 301 does not have the layer containing the dispersion of solid fine grains.

From the results shown in Table 3, it is found that exclusively in the samples each having a layer containing the dispersion of solid fine grains, in which the dispersion has been subjected to heat treatment and a polymer for the use of the present invention is added thereto, no emulsion peeling occurred even in the lapse of 6 hours after the preparation of the coating dispersion solution, which means that these samples each has the layer strength equal to that of a conventional samples each having a resin layer containing carbon black on the back surface of the support.

As mentioned above, according to the present invention a light-sensitive material having both an excellent sharpness and a satisfied layer strength can be obtained without a step of removing a resin layer on the back surface of the support.

Example 4

On a cellulose triacetate film support having coated a subbing layer thereon (a resin layer containing carbon fine grains has been coated on the opposite side of the emulsion-coated surface in such an amount as the transmitted density 1.0) (thickness 140 μm), was coated each of layers having the following compositions, to obtain a multilayer color photographic light-sensitive material (sample 401).

Layer Constitution:

Compositions of the layers are mentioned below, in which the numerical value indicates the amount coated (g/m$^2$), and the amount of the silver halide emulsion coated is represented as silver therein.

| | |
|---|---|
| First Layer: Blue-Sensitive Emulsion Layer | |
| Silver iodobromide emulsion (⅓ (by mol of silver) mixture of gold- and sulfur-sensitized emulsion B1, of cubic grains with a mean grain size of 0.7 μm, and gold- and sulfur-sensitized emulsion B2, of cubic grains with a mean grain size of 0.4 μm; average halogen composition Br/Cl = 1 mol %:99 mol %) | 0.50 |
| Gelatin | 1.66 |
| Yellow coupler (ExY) | 1.10 |
| Solvent (Solv-3) | 0.26 |
| (Cpd-13) | 0.04 |
| (Cpd-1') | 0.0016 |
| (Cpd-2) | 0.0006 |
| (Cpd-3) | 0.006 |
| (Cpd-4) | 0.03 |
| Second Layer: Color-Mixing-Preventing Layer | |
| Gelatin | 0.56 |
| (Cpd-5) | 0.01 |
| Solvent (Solv-1) | 0.006 |
| Solvent (Solv-3) | 0.02 |
| Solvent (Solv-4) | 0.0007 |
| Solvent (Solv-5) | 0.02 |
| Third Layer: Red-Sensitive Emulsion Layer | |
| Silver chlorobromide emulsion (⅓ (by mol of silver) mixture of gold- and sulfur-sensitized emulsion R1, of cubic grains with a mean grain size of 0.25 μm, and gold- and sulfur-sensitized emulsion R2, of cubic grains with a mean grain size of 0.1 μm; average halogen composition Br/Cl = 25 mol %:75 mol %) | 0.44 |
| Gelatin | 2.55 |
| Cyan coupler (ExC') | 0.87 |
| (Cpd-13) | 0.46 |
| (Cpd-5) | 0.015 |
| (Cpd-14) | 0.10 |
| Solvent (Solv-5) | 0.28 |
| Solvent (Solv-1) | 0.14 |
| Solvent (Solv-2) | 0.14 |
| Solvent (Solv-3) | 0.14 |
| (Cpd-7) | 0.0002 |
| (Cpd-8) | 0.003 |
| (Cpd-2) | 0.003 |
| Fourth Layer: Color-Mixing-Preventing Layer | |
| Gelatin | 0.56 |
| (Cpd-5) | 0.01 |
| Solvent (Solv-1) | 0.006 |
| Solvent (Solv-3) | 0.02 |
| Solvent (Solv-4) | 0.0007 |
| Solvent (Solv-5) | 0.02 |

-continued

| | |
|---|---|
| Fifth Layer: Green-Sensitive Emulsion Layer | |
| Silver chlorobromide emulsion (⅓ (by mol of silver) mixture of gold- and sulfur-sensitized emulsion G1, of cubic grains with a mean grain size of 0.25 μm, and gold- and sulfur-sensitized emulsion G2, of cubic grains with a mean grain size of 0.1 μm; average halogen composition Br/Cl = 25 mol %:75 mol %) | 0.52 |
| Gelatin | 1.29 |
| Magenta coupler (ExM) | 0.61 |
| (Cpd-9) | 0.001 |
| (Cpd-5) | 0.012 |
| Solvent (Solv-3) | 0.15 |
| (Cpd-10) | 0.003 |
| (Cpd-11) | 0.002 |
| (Cpd-12) | 0.003 |
| Sixth Layer: Protective Layer | |
| Gelatin | 0.98 |
| (Cpd-15) | 0.02 |
| (Cpd-16) | 0.02 |
| (Cpd-17) | 0.03 |
| (Cpd-18) | 0.003 |

Compounds used are illustrated below.

(ExC') Cyan coupler Mixture (45:15:40 in molar ratio) of

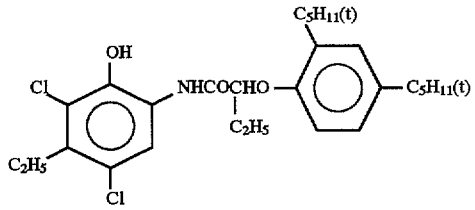

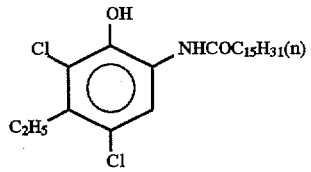

and

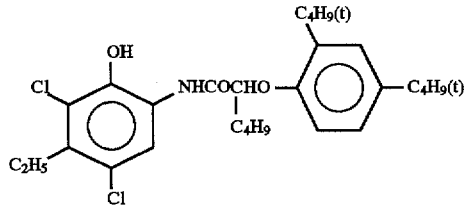

ExY

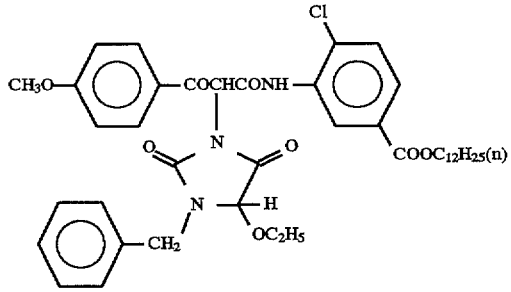

(1)

-continued
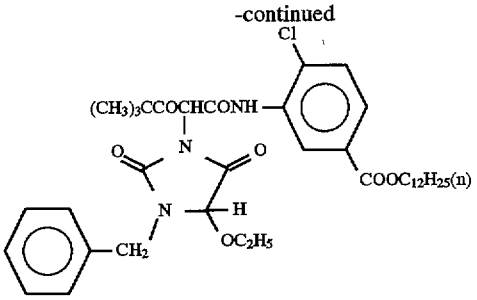
(2)
Mixture of (1), (2) (76:24 in weight ratio)
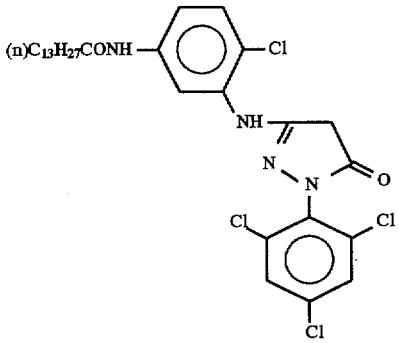
Mixture (1:1 in molar ratio) of
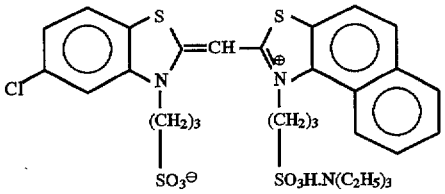
and
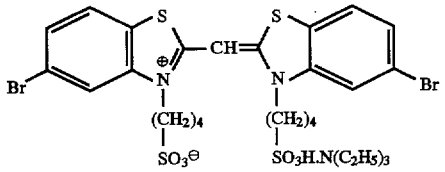
(Cpd-2)
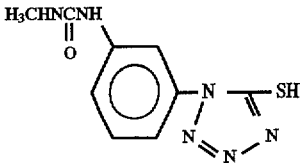
(Cpd-3)
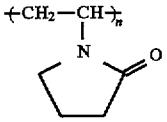
(Cpd-4)
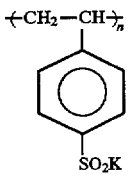
-continued
(Cpd-5)
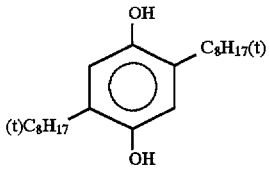
(Cpd-6)
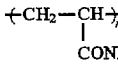
Av. molecular weight: ca. 60,000
ExM (Cpd-7)
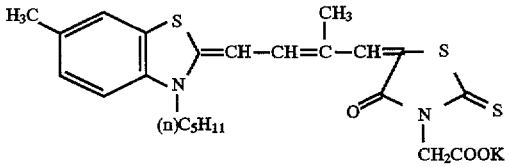
(Cpd-8)
(Cpd-1')
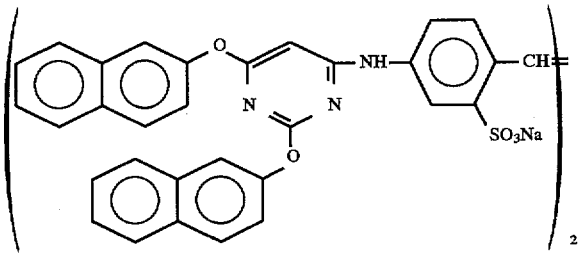
(Cpd-9)
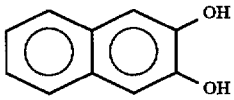
(Cpd-10)
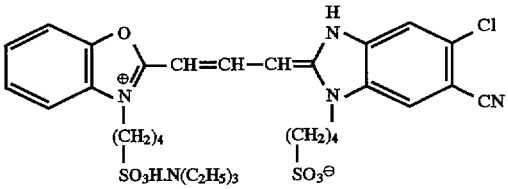
(Cpd-11)
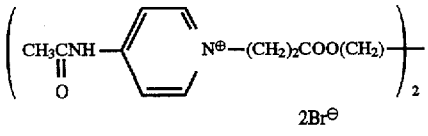
(Cpd-12)
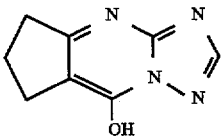
(Cpd-13)
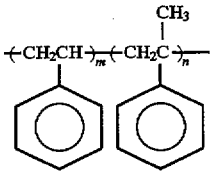
number-average molecular weight 600
m/n = 10/90

-continued

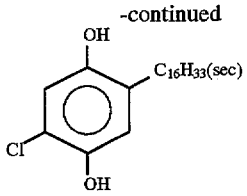

(Cpd-14)

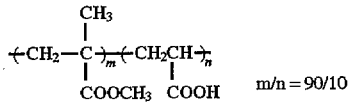

m/n = 90/10 (Cpd-15)

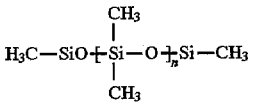

(Cpd-16)

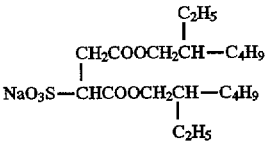

(Cpd-17)

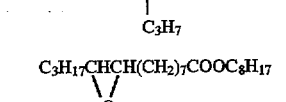

(Cpd-18)

(Solv-1)

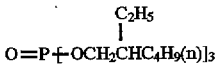

(Solv-2)

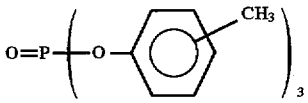

(Solv-3)

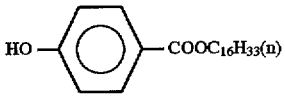

(Solv-4)

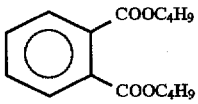

(Solv-5)

As a gelatin hardening agent for each layer, added thereto was 1-oxy-3,5-dichloro-s-triazine sodium salt.

For anti-irradiation, the following dyes were added to the respective emulsion layers, the coated amount being parenthesized.

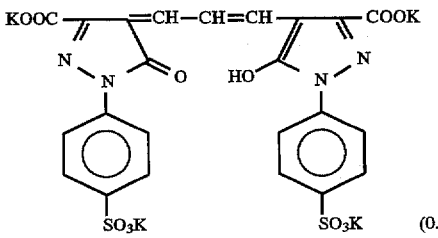

(0.043 g/m²)

-continued

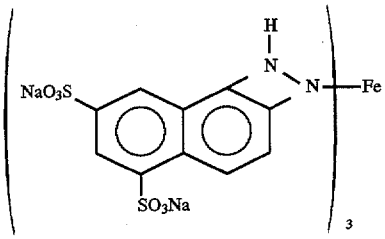

(0.098 g/m²)

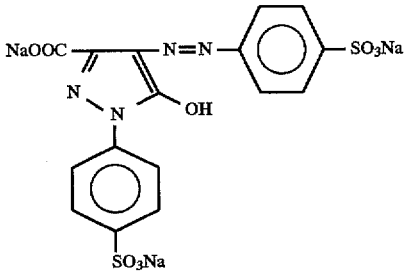

(0.008 g/m²)

Further, samples 402 to 409 were prepared in the same manner as sample 401, except that the resin layer on the back surface of the support was replaced by a hydrophilic colloidal layer containing the electric conductive polymer and fine grains of tin oxide. Further, a layer containing a solid fine-grain dispersion having the composition shown in Table 4 and gelatin in 1.00 g/m² was additionally set between the surface of the support and the first layer.

The solid fine-grain dispersion of dye was dispersed in the same manner as in Example 1, and a dispersion solution for coating was prepared by use of the dispersion. Then, the light-sensitive material samples 402 to 409 were prepared by using respective dispersion solution for coating, which solution was maintained for 6 hrs. at 40° C.

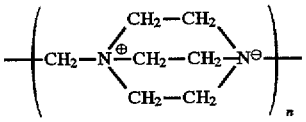

Each sample was processed and the evaluation was conducted in the same manner as in Example 3. The results are shown in Table 4.

TABLE 4

| Sample No. | Kind of Dye | Amount ($g/m^2$) | Dispersant *1 | Heat treatment | Polymer of Invention *2 | Layer strength | Remarks |
|---|---|---|---|---|---|---|---|
| 401 | — | — | — | — | — | o | Comparison |
| 402 | V-1 | 0.140 | I-12 | None | — | x | Comparison |
| | IV-4 | 0.025 | a *1 | None | | | |
| 403 | V-1 | 0.140 | I-12 | 90° C.-10 hr | — | Δ | Comparison |
| | IV-4 | 0.025 | a *1 | 90° C.-10 hr | — | | |
| 404 | V-1 | 0.140 | I-12 | — | P-2 | x | Comparison |
| | IV-4 | 0.025 | a *1 | — | P-2 | | |
| 405 | V-1 | 0.140 | I-12 | 90° C.-10 hr | P-2 | o | Invention |
| | IV-4 | 0.025 | a *1 | 90° C.-10 hr | P-2 | | |
| 406 | IV-3 | 0.100 | b *1 | 85° C.-15 hr | P-2 | o | Invention |
| | IV-2 | 0.030 | a *1 | 90° C.-10 hr | P-38 | | |
| | III-26 | 0.070 | a *1 | 90° C.-10 hr | P-38 | | |
| 407 | V-50 | 0.140 | I-12 | 85° C.-15 hr | P-2 | o | Invention |
| | IV-1 | 0.010 | I-12 | 80° C.-24 hr | P-2 | | |
| | III-1 | 0.010 | I-12 | 80° C.-24 hr | P-38 | | |
| | III-25 | 0.010 | I-12 | 80° C.-24 hr | P-38 | | |
| 408 | IV-3 | 0.170 | b *1 | 90° C.-10 hr | P-1 | o | Invention |
| | IV-4 | 0.020 | a *1 | 90° C.-10 hr | P-1 | | |
| 409 | III-3 | 0.050 | b *1 | 80° C.-10 hr | P-38 | o | invention |
| | IV-24 | 0.170 | b *1 | 80° C.-10 hr | P-38 | | |

(Note)
*1 The dispersant was used in an amount of 15% by weight based on the dye.
a: Sodium salt of poly naphthalene sulfonic acid
b: Carboxymethylcellulose
*2 The polymer of the present invention was used in an amount of 5% by weight based on the dye.

From the results shown in Table 4, it is found that in the samples that each had a layer containing the dispersion of solid fine grains, in which the dispersion had been subjected to heat treatment, and a polymer had been added according to the present invention, a satisfactory layer strength was maintained.

Example 5

1) Support:

The support used in this example was produced according to the method mentioned below.

100 parts by weight of polyethylene-2,6-naphthalate, and 2 parts by weight of a commercial ultraviolet absorbent, Tinuvin P-326 (produced by Ciba-Geigy Co.), were dried in an ordinary manner; then they were melted at 300° C., extruded through a T-die, stretched by 3.3 times at 140° C. in the machine direction, and then stretched by 3.3 times at 130° C. in the transverse direction, and thereafter they were fixed at 250° C. for 6 seconds, to obtain a PEN film having a thickness of 90 μm. To this PEN film, were added a blue dye, a magenta dye and a yellow dye (i.e., I-1, I-4, I-6, I-24, I-26, I-27 and II-5 as described in Kokai Gihou publication No. 94-6023) in an optimal amount. Further, a part of this film was wound around a stainless steel core having a diameter of 20 cm, and thermal hysteresis was imparted thereto at 110° C. for 48 hours to obtain a support having minimized core set curl.

2) Coating of Subbing Layer on Support:

The both surfaces of the support prepared in the above were treated by corona-discharging treatment, UV-discharging treatment, and further glow-discharging treatment. One surface of the support that had heated higher during the stretching was coated with a coating solution having the composition mentioned below to form a subbing layer (10 $cc/m^2$) by means of a bar coater.

| Composition of Coating Solution for Subbing Layer: | |
|---|---|
| Gelatin | 0.1 $g/m^2$ |
| Sodium α-sulfo-di-2-ethylhexylsuccinate | 0.01 $g/m^2$ |
| Salicylic Acid | 0.04 $g/m^2$ |
| p-Chlorophenol | 0.2 $g/m^2$ |
| $(CH_2{=}CHSO_2CH_2CH_2NHCO)_2CH_2$ | 0.012 $g/m^2$ |
| Polyamido epichlorohydrin condensation polymerization compound | 0.02 $g/m^2$ |

The thus coated layer was dried at 115° C. for 6 minutes in a drier where the rollers and the conveying means in the drying zone were all kept at 115° C.

3) Coating of Backing Layers on Support:

On the other surface of the support opposite to the surface coated with the subbing layer, were coated an antistatic layer, a magnetic recording layer and a lubricant layer each having the composition mentioned below, as backing layers.

3-1) Coating of Antistatic Layer on Support:

0.2 $g/m^2$ of a powder of fine grains of tin oxide-antimony oxide composite having a mean grain size of 0.005 μm and a specific resistivity of 5 Ω·cm (grain size of secondary aggregate: about 0.08 μm was coated on the support with 0.05 $g/m^2$ of gelatin, 0.02 $g/m^2$ of $(CH_2{=}CHSO_2CH_2CH_2NHCO)_2CH_2$, 0.005 $g/m^2$ of polyoxyethylene-p-nonyl phenol (polymerization degree 10) and resorcine.

3-2) Coating of Electromagnetic Layer on Support:

0.06 $g/m^2$ of Co-γ-iron oxide (grains having a specific surface area of 43 $m^2/g$, and having a major axis of 0.14 μm and a minor axis of 0.03 μm, a saturation magnetization of 89 emu/g, and a ratio of $Fe^{2+}/Fe^{3+}$=6/94; their surfaces were treated with 2% by weight, relative to the iron oxide, of aluminum oxide and 2% by weight, relative to the iron oxide, of silicon oxide) surface treated with 15% by weight, relative to the Co-iron oxide, of 3-polyoxyethylenepropyltrimethoxysilane having a degree of polymerization of 15 was coated on the above-mentioned antistatic layer by means of a bar coater with 0.06 $g/m^2$ of diacetyl cellulose, a 3 g/m$^2$ of hardening agent $C_2H_5O(CH_2OCONH—C_6H_3(CH_3)NCO)_3$ and solvents (acetone, methyl ethyl ketone and cyclohexanone) to form thereon a magnetic layer having a thickness of 1.2 μm. The magnetic grains were kneaded in an open kneader and the kneaded mixture was dispersed in a ball mill. To the coating composition, were added a mat agent of silica grains (0.3 μm) and an abrasive of aluminum oxide (0.15 μm) surface treated with 15% by weight of 3-polyoxyethylenepropyloxytrimethoxysilane having a degree of polymerization of 15 in an amount of 10 mg/m$^2$, respectively. The thus coated layer was dried at 115° C. for 6 minutes in a drier where the rollers and the conveying means in the drying zone were all kept at 115° C.

The increase in the $D^B$ color density of the magnetic recording layer was about 0.1, when measured with an X-light through a blue filter. The magnetic recording layer had a saturation magnetization moment of 4.2 emu/g, a coercive force of $7.3\times10^4$ A/m and a squareness ratio of 65%.

3-3) Preparation of Lubricant Layer

A coating composition comprising the components mentioned below was coated on the above-described magnetic layer and dried at 115° C. for 6 minutes to form a lubricant layer thereon.

Diacetyl cellulose 25 mg/m$^2$

A mixture of $C_6H_{13}CH(OH)C_{10}H_{20}COOC_{40}H_{81}$ (Compound a) 6 mg/m$^2$ and $C_{50}H_{101}O(CH_2CH_2O)_{16}H$ (Compound b) 9 mg/m$^2$ The mixture of Compound a and Compound b was dissolved in xylene/propyleneglycol monomethyl ether (1/1 by volume) under heat at 105° C., and the resulting solution was added to propylene glycol monomethyl ether (25° C.) of 10 times the solution to obtain a fine dispersion. This was diluted with acetone to obtain a dispersion having a mean grain size of 0.01 μm. This dispersion was added to the above-mentioned coating composition. Further, to the coating composition, were added a mating agent of silica grains (0.3 μm) and an abrasive of aluminum oxide (0.15 μm) surface treated with 15% by weight of 3-polyoxyethylenepropyloxytrimethoxysilane having a degree of polymerization of 15 in an amount of 15 mg/m$^2$, respectively. The thus coated layer was dried at 115° C. for 6 minutes in a drier where the rollers and the conveying means in the drying zone were all kept at 115° C. The lubricant layer thus formed had excellent characteristics, concretely having a coefficient of kinetic friction of 0.06 (to hard stainless steel balls with 5 mmϕ under a load of 100 g at a speed of 6 cm/min), a coefficient of static friction of 0.07 (measured by a clipping method), and a coefficient of kinetic friction of 0.12 regarding the lubricative characteristic of the lubricant layer sliding on the surface of the emulsion layer described hereinunder.

4) Coating of Light-sensitive Layer:

On the side of the support opposite to the back layer provided as above, the layers each having the following composition were coated in a superposition manner to provide a color negative photographic film. This film was designated as sample 501.

(Composition of Light-sensitive Layer)

Main materials used in each layer are classified as follows:

ExC: Cyan coupler UV: ultraviolet absorbent
ExM: magenta coupler HBS: high boiling organic solvent
ExY: yellow coupler H: gelatin hardener
ExS: sensitizing dye The numerical value corresponding to each component indicates the amount coated (g/m$^2$) and the amount of the silver halide coated is represented as silver therein. But for the sensitizing dye, the amount coated is represented by mol per 1 mol of the silver halide contained in the same layer.

| | | |
|---|---|---|
| First Layer: Antihalation Layer | | |
| Black colloidal silver | silver | 0.050 |
| Gelatin | | 1.60 |
| ExM-1 | | 0.12 |
| ExF-1 | | $2.0\times10^{-3}$ |
| Solid dispersed dye ExF-2 | | 0.030 |
| Solid dispersed dye ExF-3 | | 0.040 |
| Solid dispersed dye ExF-8 | | 0.040 |
| HBS-1 | | 0.15 |
| HBS-2 | | 0.02 |
| Second Layer: Intermediate Layer | | |
| Silver iodobromide emulsion M | silver | 0.065 |
| ExC-2 | | 0.04 |
| Polyethyl acrylate latex | | 0.20 |
| Gelatin | | 1.04 |
| Third Layer: Low Sensitivity Red-Sensitive Emulsion Layer | | |
| Silver iodobromide emulsion A | silver | 0.25 |
| Silver iodobromide emulsion B | silver | 0.25 |
| ExS-1 | | $6.9\times10^{-5}$ |
| ExS-2 | | $1.8\times10^{-5}$ |
| ExS-3 | | $3.1\times10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| Fourth Layer: Medium Sensitivity Red-Sensitive Emulsion Layer | | |
| Silver iodobromide emulsion C | silver | 0.70 |
| ExS-1 | | $3.5\times10^{-4}$ |
| ExS-2 | | $1.6\times10^{-5}$ |
| ExS-3 | | $5.1\times10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| Fifth Layer: High Sensitivity Red Sensitive Emulsion Layer | | |
| Silver iodobromide emulsion D | silver | 1.40 |
| ExS-1 | | $2.4\times10^{-4}$ |
| ExS-2 | | $1.0\times10^{-4}$ |
| ExS-3 | | $3.4\times10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| Sixth Layer: Intermediate Layer | | |
| Cpd-1 | | 0.090 |
| Solid dispersed dye ExF-4 | | 0.030 |
| HBS-1 | | 0.050 |
| Polyethylacrylate Latex | | 0.15 |
| Gelatin | | 1.10 |
| Seventh Layer: Low Sensitivity Green-Sensitive Emulsion Layer | | |
| Silver iodobromide emulsion E | silver | 0.15 |
| Silver iodobromide emulsion F | silver | 0.10 |

-continued

| | | |
|---|---|---|
| Silver iodobromide emulsion G | silver | 0.15 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth Layer: Medium Sensitivity Green-Sensitive Emulsion Layer | | |
| Silver iodobromide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| Ninth Layer: High Sensitivity Green-Sensitive Emulsion Layer | | |
| Silver iodobromide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.025 |
| Polyethyl acrylate latex | | 0.15 |
| Gelatin | | 1.33 |
| Tenth Layer: Yellow Filter Layer | | |
| Yellow colloidal silver | silver | 0.015 |
| Cpd-1 | | 0.16 |
| Solid dispersed dye ExF-5 | | 0.060 |
| Solid dispersed dye ExF-6 | | 0.060 |
| Oil-soluble dye ExF-7 | | 0.010 |
| HBS-1 | | 0.60 |
| Gelatin | | 0.60 |
| Eleventh Layer: Low Sensitivity Blue-Sensitive Emulsion Layer | | |
| Silver iodobromide emulsion J | silver | 0.09 |

-continued

| | | |
|---|---|---|
| Silver iodobromide emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| Twelfth Layer: High Sensitivity Blue-Sensitive Emulsion Layer | | |
| Silver iodobromide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth Layer: First Protective Layer | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth Layer (Second Protective Layer): | | |
| Silver iodobromide emulsion M | silver | 0.10 |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 70 |

Further, in order to improve stability, processing property, pressure resistance, keeping property from mold and fungi, antistatic property, and coating property, besides above-mentioned components, W-1 to W-3, B-4 to B-6, F-1 to F-17 and iron salt, lead salt, gold salt, platinum salt, palladium salt, iridium salt, rhodium salt are optionally contained in all emulsion layers.

TABLE 5

| Emulsion | Average AgI Content (%) | Coefficient of Deviation in AgI Content among grains (%) | Mean grain size Spherically equivalent size (μm) | Coefficient of Deviation in Grain size (%) | Projected area diameter circular equivalent size (μm) | Ratio of Diameter thickness |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |

TABLE 5-continued

| | Average AgI Content (%) | Coefficient of Deviation in AgI Content among grains (%) | Mean grain size Spherically equivalent size (μm) | Coefficient of Deviation in Grain size (%) | Projected area diameter circular equivalent size (μm) | Ratio of Diameter thickness |
|---|---|---|---|---|---|---|
| L | 14.0 | 25 | 1.28 | 26 | 1.46 | 3.5 |
| M | 1.0 | — | 0.07 | 15 | — | 1 |

In Table 5:

(1) Emulsions J to L were subjected to reduction sensitization using thiourea dioxide and thiosulfonic acid in accordance with Examples given in JP-A No. 191938/1990 when the grains were prepared.

(2) Emulsions A to I were subjected to gold sensitization, sulfur sensitization, and selenium sensitization using in the presence of sodium thiocyanate and spectrally sensitizing dyes stated for the respective photosensitive layers in accordance with Examples given in JP-A No. 237450/1991.

(3) In the preparation of tabular grains, low-molecular weight gelatins were used in accordance with Examples given in JP-A No. 158426/1989.

(4) Rearrangement lines as described in JP-A No. 237450/1991 were observed in the tabular grains under a high-voltage electron microscope.

(5) Emulsion L was a double structure grain containing high-internal iodo core as described in JP-A No. 143331/1985.

Preparation of a Dispersion of Solid Dye

ExF-2 (exemplified compound IV-3) illustrated hereinunder was dispersed in the manner as described below.

Into 700-ml pot mill, were placed 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether having a degree of polymerization of 10, followed by addition of 5.0 g of the dye ExF-2 and 500 ml of zirconium oxide beads having a diameter of 1 mm. The resulting mixture was dispersed for 2 hrs. The dispersion was conducted by means of a BO-type vibration ball mill, manufactured by Chuo-Koki Co. After the dispersion, the content was recovered, and the beads were removed by filtration. The pH value of the dispersion solution was adjusted to 4.4 with hydrochloric acid and sodium hydrogencarbonate, and a 10% dispersion solution of dye was obtained with addition of water. The mean grain size of the fine grains of dye was 0.44 μm.

Dispersions of ExF-3, ExF-4, ExF-6, and ExF-8 in the form of solid fine grains were obtained in the same manner as above. Mean grain sizes of the fine grains of dye were 0.24 μm, 0.45 μm, 0.52 μm and 0.70 μm, respectively.

ExF-5 was dispersed by the microprecipitation dispersion method as described in Example 1 of EP 549,489A. A mean grain size of the fine grains of ExF-5 was 0.06 μm.

ExC-1

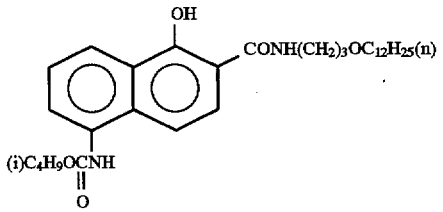

ExC-2

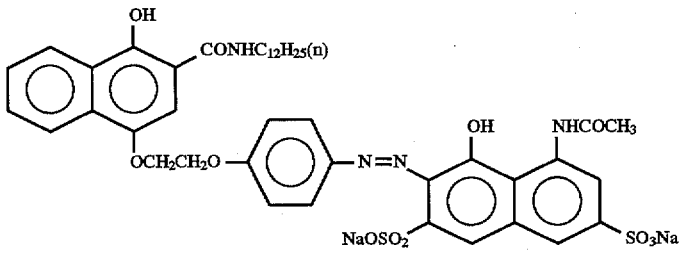

ExC-3

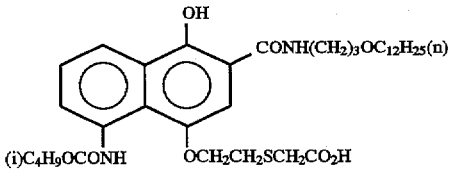

-continued
ExC-4
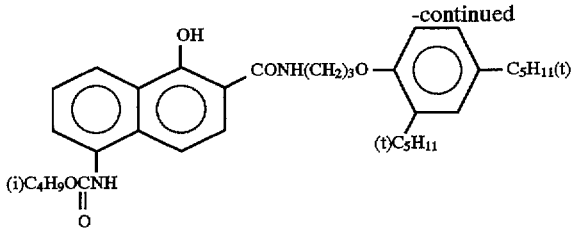
ExC-5
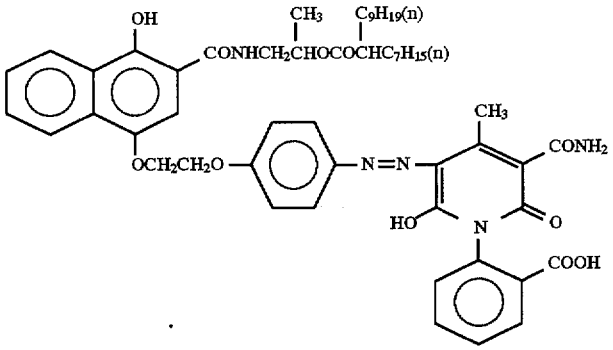
ExC-6
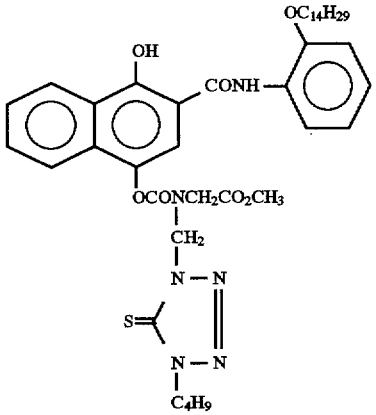
ExC-7
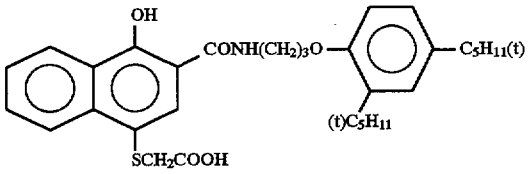
ExC-8
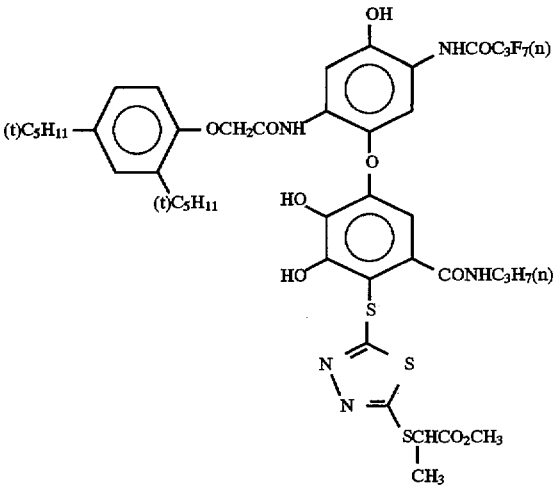

-continued
ExM-1
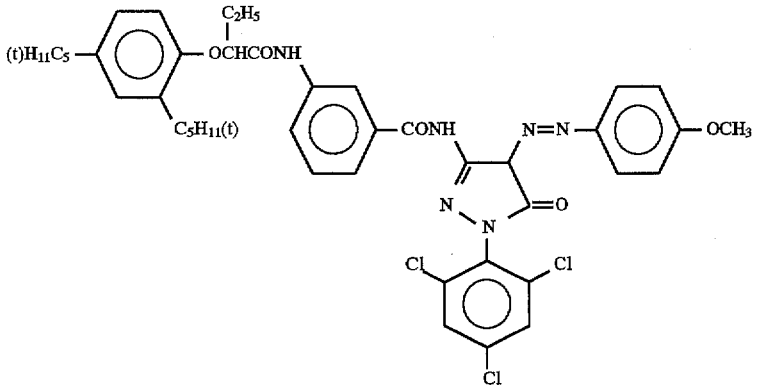
ExM-2
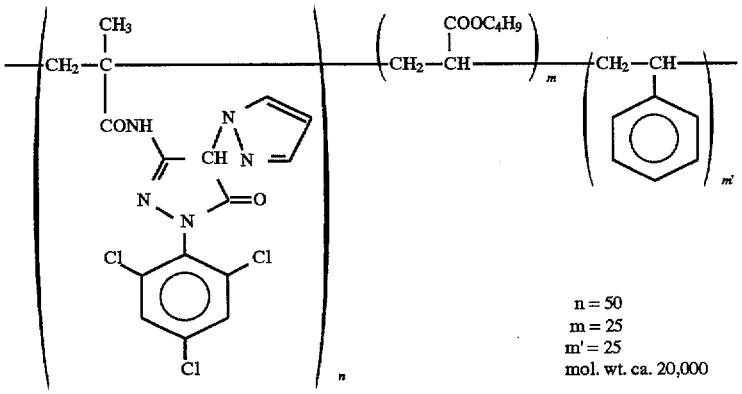
n = 50
m = 25
m' = 25
mol. wt. ca. 20,000
ExM-3
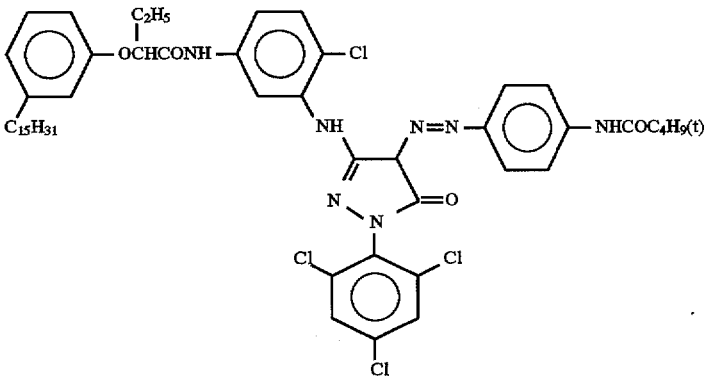
ExM-4
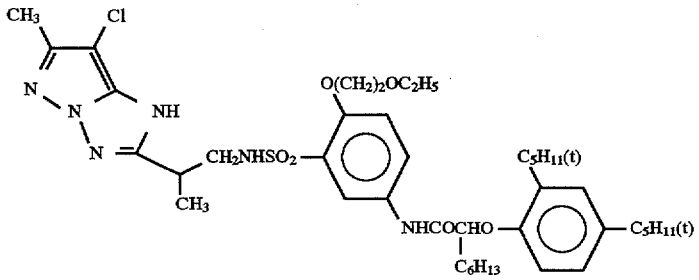

-continued
ExM-5
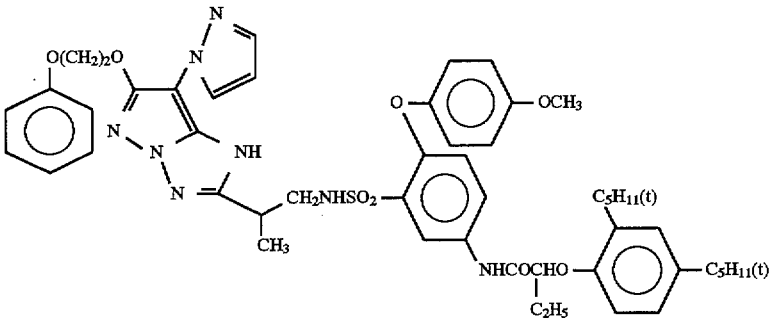
ExY-1
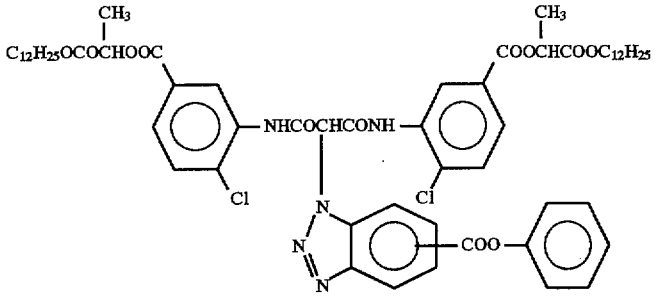
ExY-2
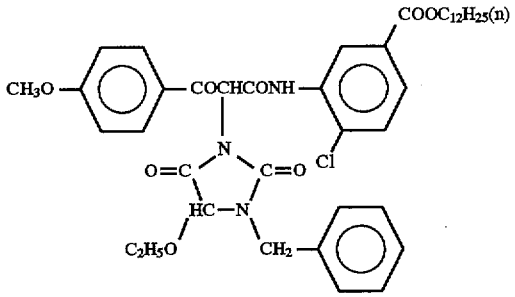
ExY-3
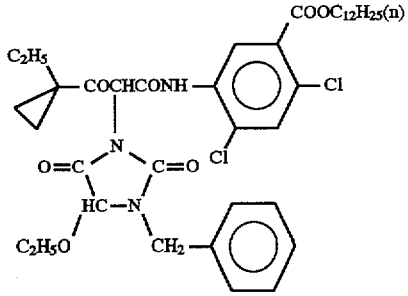
ExY-4
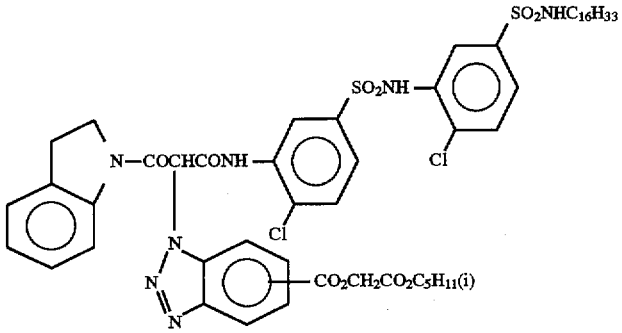

-continued
ExY-5
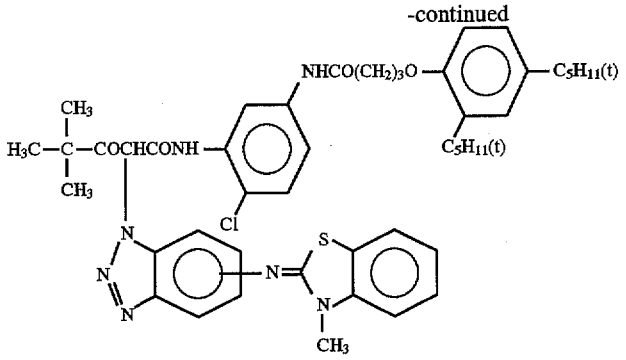
ExF-1
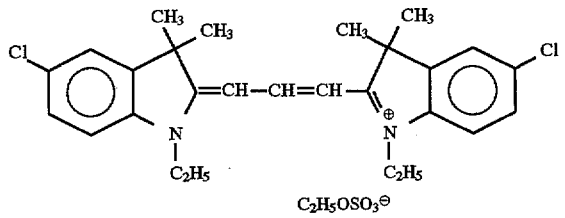
ExF-2
(Exemplified Compound IV-3)
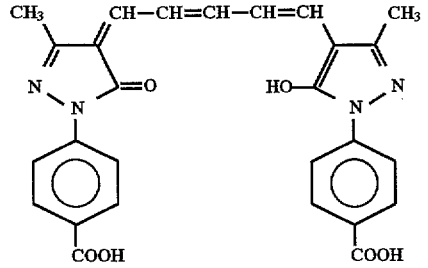
ExF-3
(Exemplified Compound IV-18)
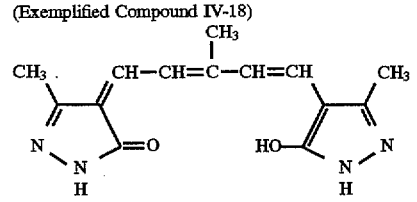
ExF-4
(Exemplified Compound IV-2)
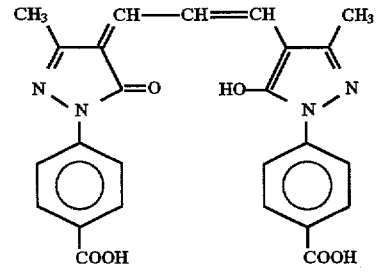
ExF-5
(Exemplified Compound IV-1)
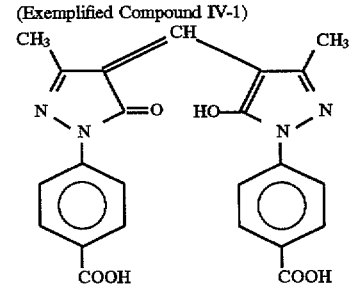

-continued
(Exemplified Compound IV-4) ExF-6
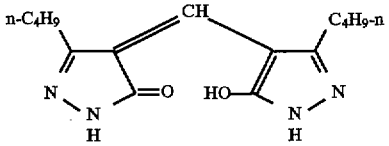
ExF-7
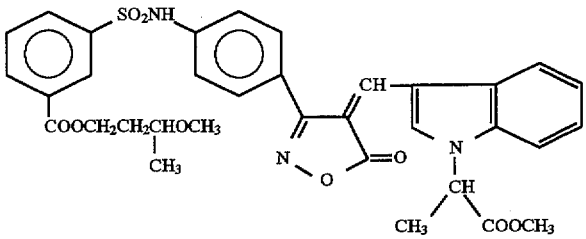
(Exemplified Compound V-1) ExF-8
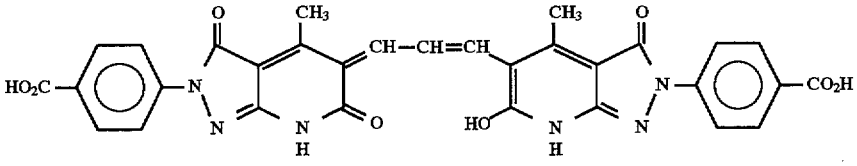
Cpd-1
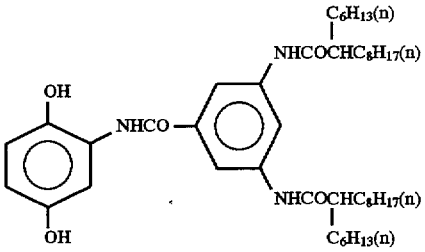
Cpd-2
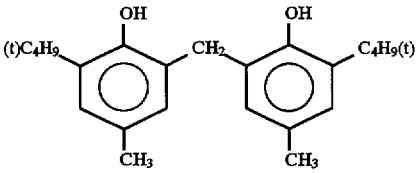
Cpd-3
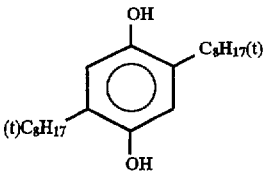
UV-1
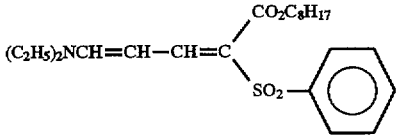
UV-2
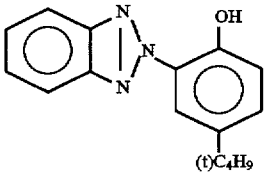

-continued
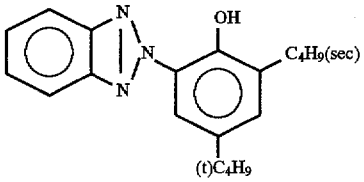
UV-3
Tricresyl phosphate
HBS-1
Di-n-butyl phthalate
HBS-2
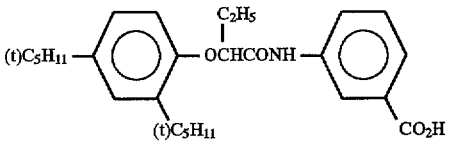
HBS-3
Tri(2-ethylhexyl) phosphate
HBS-4
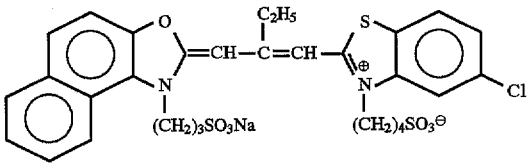
ExS-1
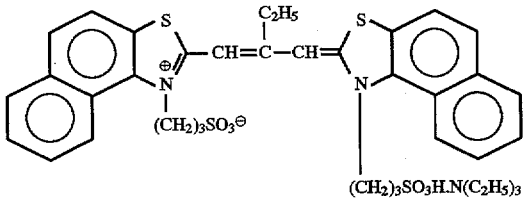
ExS-2
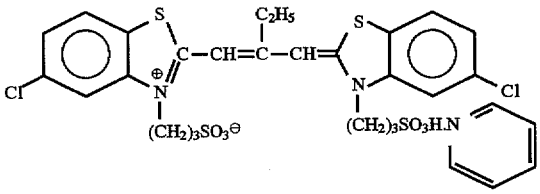
ExS-3
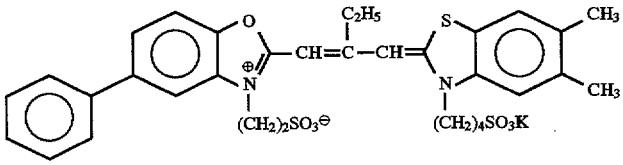
ExS-4
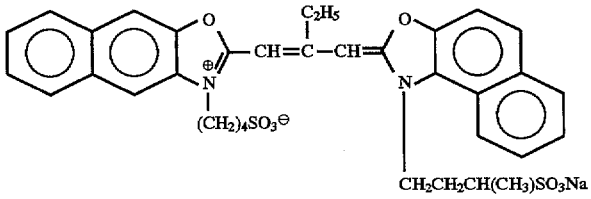
ExS-5
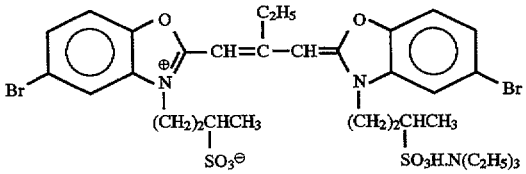
ExS-6

-continued
ExS-7
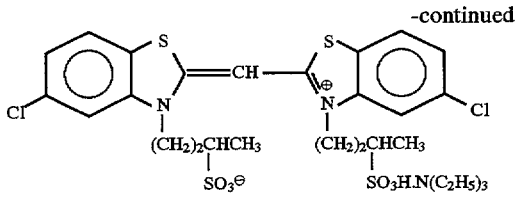
S-1
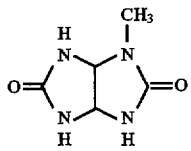
H-1
$CH_2{=}CH{-}SO_2{-}CH_2{-}CONH{-}CH_2$
$CH_2{=}CH{-}SO_2{-}CH_2{-}CONH{-}CH_2$
B-1
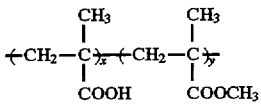
x/y = 10/90 (weight ratio)
Av. molecular weight: ca. 35,000
B-2
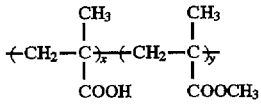
x/y = 40/60 (weight ratio)
Av. molecular weight: ca. 20,000
B-3
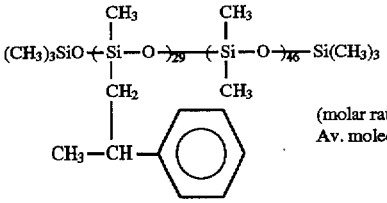
(molar ratio)
Av. molecular weight: ca. 8,000
B-4
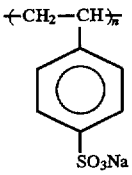
Av. molecular weight: ca. 750,000
B-5
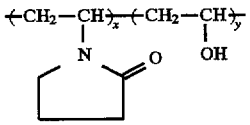
x/y = 70/30 (weight ratio)
Av. molecular weight: ca. 17,000
B-6
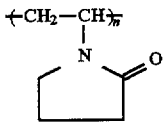
Av. molecular weight: ca. 10,000
W-1
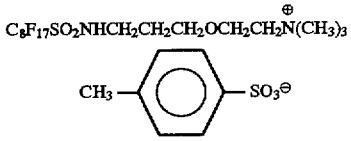
W-2
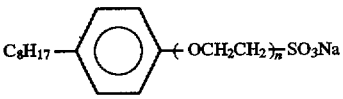
n = 2~4

-continued
W-3
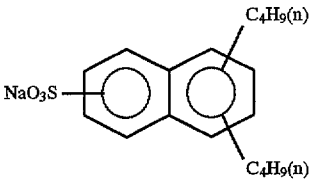
F-1
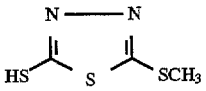
F-2
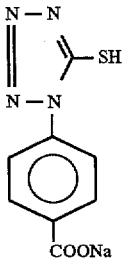
F-3
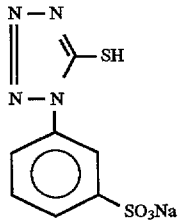
F-4
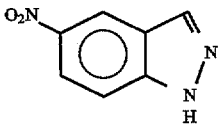
F-5
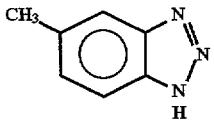
F-6
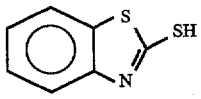
F-7
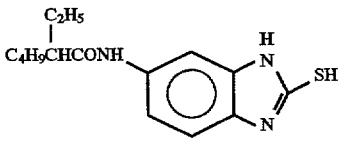
F-8
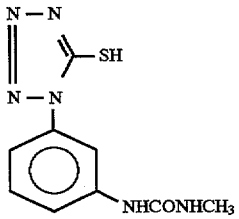
F-9
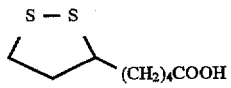

-continued

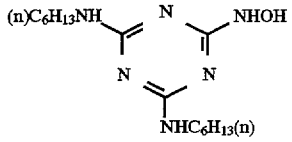

F-10

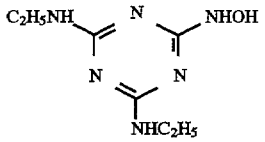

F-11

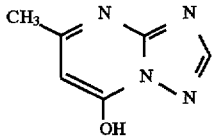

F-12

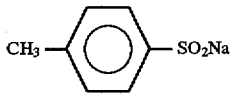

F-13

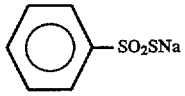

F-14

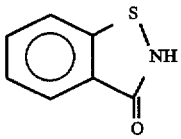

F-15

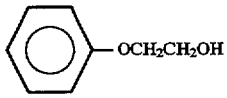

F-16

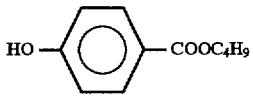

F-17

Samples 502 and 503 were prepared in the same manner as in the preparation of the sample 501, except that the first layer, the sixth layer and the tenth layer were altered as described below.

Sample 502: Coating solutions for the first layer, the sixth layer and the tenth layer were coated after the lapse of 6 hours at 40° C.

Sample 503: The dispersions of solid dye for the first layer, the sixth layer and the 10th layer were subjected to heat treatment at 90° C. for 10 hrs. A coating solution, in which the polymer (p-2) for use of the present invention was each added to the thus heat treated dispersion in an amount of 5% by weight, respective to the dye, was coated after the lapse of 6 hrs. at 40° C.

Each of the thus prepared light-sensitive materials was cut into a film having a width of 24 mm and a length of 160 cm. Further, on each of these light-sensitive materials, were made sets of two perforations at intervals of 32 mm. Each of perforations has 2 millimeters square and is located at a distance of 0.7 mm from one side width direction of the light-sensitive material, and the two perforations of each set are apart from each other in the distance of 5.8 mm. These perforated films were each set in a plastic film-cartridge as described in FIGS. 1 to 7 of U.S. Pat. No. 5,296,887.

FM signals were recorded at the conveying speed between the above-described perforations of the light-sensitive materials by means of a head which has a head gap of 5 μm from the magnetic recording layer-coated surface, and which is capable for input and output of the turn numbers of 2,000.

After the recording of the FM signals, the emulsion surface was subjected to the whole and uniform exposure to light of 1,000 cms, followed by each of the processings as described below. After that, the processed samples were set again in the plastic film-cartridge.

With respect to each of the samples, the layer strength at the processing was evaluated in the same manner as in Example 3. At that time, the processing was conducted using the processing solution of CN-16X by means of the autodeveloping apparatus FP-360B manufactured by Fuji Photo Film Co., Ltd. As a result, it was found that the emulsion peeling was observed in the sample 502, and therefore its evaluation was ranked as "x". On the other hand, for the sample 503 in which the dispersion has been subjected to heat treatment according to the present invention, and further a polymer for the use of the present invention is incorporated, the emulsion peeling was not appreciated. It indicates that the present invention provides a light-sensitive material having a satisfactory layer strength in the practical use.

Example 6

The present invention is further explained by another example, but should not be limited thereto.

Preparation of Sample 601

Onto a cellulose triacetate support having thereon a subbing layer (total thickness 127 μm), were coated thereon the layers having the compositions as described below to provide a multi-layer color photographic light-sensitive material, which was designated as sample 601. The numerical figures indicate an addition amount per 1 $m^2$. The effect that the compound added herein exerts should not be limited to the use thereof as described below.

| | | |
|---|---|---|
| **First Layer: Antihalation Layer** | | |
| Black colloidal silver | | 0.10 g |
| Gelatin | | 1.90 g |
| Ultraviolet absorbent U-1 | | 0.10 g |
| Ultraviolet absorbent U-3 | | 0.040 g |
| Ultraviolet absorbent U-4 | | 0.10 g |
| High-boiling organic solvent Oil-1 | | 0.10 g |
| Solid dispersion of Dye E-1 | | 0.10 g |
| Solid dispersion of Dye E-3 | | 0.10 g |
| **Second Layer: Intermediate Layer** | | |
| Gelatin | | 0.40 g |
| Compound Cpd-C | | 5.0 mg |
| Compound Cpd-J | | 5.0 mg |
| Compound Cpd-K | | 3.0 mg |
| High-boiling organic solvent Oil-3 | | 0.10 g |
| Dye D-4 | | 0.80 mg |
| **Third Layer: Intermediate Layer** | | |
| Fine grains silver iodobromide emulsion fogged the surface and the internal part thereof (average grain diameter of 0.06 μm, deviation coefficient of 18%, AgI content of 1 mol %) | silver amount | 0.050 g |
| Yellow colloidal silver | silver amount | 0.030 g |
| Gelatin | | 0.40 g |
| **Fourth Layer: Low Sensitivity Red-Sensitive Emulsion Layer** | | |
| Emulsion A | silver amount | 0.30 g |
| Emulsion B | silver amount | 0.20 g |
| Gelatin | | 0.80 g |
| Coupler C-1 | | 0.15 g |
| Coupler C-2 | | 0.050 g |
| Coupler C-3 | | 0.050 g |
| Coupler C-9 | | 0.050 g |
| Compound Cpd-C | | 5.0 mg |
| Compound Cpd-J | | 5.0 mg |
| High-boiling organic solvent Oil-2 | | 0.10 g |
| Additive P-1 | | 0.10 g |
| **Fifth Layer: Medium Sensitivity Red-Sensitive Emulsion Layer** | | |
| Emulsion B | silver amount | 0.20 g |
| Emulsion C | silver amount | 0.30 g |
| Gelatin | | 0.80 g |
| Coupler C-1 | | 0.20 g |
| Coupler C-2 | | 0.050 g |
| Coupler C-3 | | 0.20 g |
| High-boiling organic solvent Oil-2 | | 0.10 g |
| Additive P-1 | | 0.10 g |
| **Sixth Layer: High Sensitive Red-Sensitive Emulsion Layer** | | |
| Emulsion D | silver amount | 0.40 g |
| Gelatin | | 1.10 g |
| Coupler C-1 | | 0.30 g |
| Coupler C-2 | | 0.10 g |
| Coupler C-3 | | 0.70 g |
| Additive P-1 | | 0.10 g |
| **Seventh Layer: Intermediate Layer** | | |
| Gelatin | | 0.60 g |
| Additive M-1 | | 0.30 g |
| Color mix inhibitor Cpd-1 | | 2.6 mg |
| Dye D-5 | | 0.020 g |
| Dye D-6 | | 0.010 g |

-continued

| | | |
|---|---|---|
| Compound Cpd-J | | 5.0 mg |
| High-boiling organic solvent Oil-1 | | 0.020 g |
| **Eighth Layer: Intermediate Layer** | | |
| Silver iodobromide emulsion fogged the surface and the internal part thereof (average grain diameter of 0.06 μm, deviation coefficient of 16%, AgI content of 0.3 mol %) | silver amount | 0.020 g |
| Yellow colloidal silver | silver amount | 0.020 g |
| Gelatin | | 1.00 g |
| Additive P-1 | | 0.20 g |
| Color mix inhibitor Cpd-A | | 0.10 g |
| Compound Cpd-C | | 0.10 g |
| **Ninth Layer: Low Sensitive Green-Sensitive Emulsion Layer** | | |
| Emulsion E | silver amount | 0.10 g |
| Emulsion F | silver amount | 0.20 g |
| Emulsion G | silver amount | 0.20 g |
| Gelatin | | 0.50 g |
| Coupler C-4 | | 0.10 g |
| Coupler C-7 | | 0.050 g |
| Coupler C-8 | | 0.20 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.020 g |
| High-boiling organic solvent Oil-1 | | 0.10 g |
| High-boiling organic solvent Oil-2 | | 0.10 g |
| **Tenth Layer: Medium Sensitivity Green-Sensitive Emulsion Layer** | | |
| Emulsion G | silver amount | 0.30 g |
| Emulsion H | silver amount | 0.10 g |
| Gelatin | | 0.60 g |
| Coupler C-4 | | 0.10 g |
| Coupler C-7 | | 0.20 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.050 g |
| Compound Cpd-L | | 0.050 g |
| High-boiling organic solvent Oil-2 | | 0.010 g |
| **Eleventh Layer: High Sensitivity Green-Sensitive Emulsion Layer** | | |
| Emulsion I | silver amount | 0.50 g |
| Gelatin | | 1.00 g |
| Coupler C-4 | | 0.30 g |
| Coupler C-7 | | 0.10 g |
| Coupler C-8 | | 0.10 g |
| Compound Cpd-B | | 0.080 g |
| Compound Cpd-E | | 0.020 g |
| Compound Cpd-F | | 0.040 g |
| Compound Cpd-K | | 5.0 mg |
| Compound Cpd-L | | 0.020 g |
| High-boiling organic solvent Oil-1 | | 0.020 g |
| High-boiling organic solvent Oil-2 | | 0.020 g |
| **Twelfth Layer (Intermediate Layer):** | | |
| Gelatin | | 0.60 g |
| Compound Cpd-L | | 0.050 g |
| High-boiling organic solvent Oil-1 | | 0.050 g |
| **Thirteenth Layer: Yellow-Filter Layer** | | |
| Yellow colloidal silver | silver amount | 0.070 g |
| Gelatin | | 1.10 g |
| Color mix inhibitor Cpd-A | | 0.010 g |
| Compound Cpd-L | | 0.010 g |
| High-boiling organic solvent Oil-1 | | 0.010 g |
| Fine crystal solid dispersant of Dye E-2 | | 0.050 g |
| **Fourteenth Layer: Intermediate Layer** | | |
| Gelatin | | 0.60 g |
| **Fifteenth Layer: Low Sensitivity Blue-** | | |

-continued

| | | |
|---|---|---|
| Sensitive Emulsion Layer | | |
| Emulsion J | silver amount | 0.20 g |
| Emulsion K | silver amount | 0.30 g |
| Gelatin | | 0.80 g |
| Coupler C-5 | | 0.20 g |
| Coupler C-6 | | 0.10 g |
| Coupler C-10 | | 0.40 g |
| Sixteenth Layer: Medium Sensitivity Blue-Sensitive Emulsion Layer | | |
| Emulsion L | silver amount | 0.30 g |
| Emulsion M | silver amount | 0.30 g |
| Gelatin | | 0.90 g |
| Coupler C-5 | | 0.10 g |
| Coupler C-6 | | 0.10 g |
| Coupler C-10 | | 0.60 g |
| Seventeenth Layer: High Sensitivity Blue-Sensitive Emulsion Layer | | |
| Emulsion N | silver amount | 0.20 g |
| Emulsion O | silver amount | 0.20 g |
| Gelatin | | 1.20 g |
| Coupler C-5 | | 0.10 g |
| Coupler C-6 | | 0.10 g |
| Coupler C-10 | | 0.60 g |
| High-boiling organic solvent Oil-2 | | 0.10 g |
| Eighteenth Layer: First Protective Layer | | |
| Gelatin | | 0.70 g |
| Ultraviolet absorbent U-1 | | 0.20 g |
| Ultraviolet absorbent U-2 | | 0.050 g |
| Ultraviolet absorbent U-5 | | 0.30 g |
| Formalin scavenger Cpd-H | | 0.40 g |
| Dye D-1 | | 0.15 g |
| Dye D-2 | | 0.050 g |
| Dye D-3 | | 0.10 g |
| Nineteenth Layer: Second Protective Layer | | |
| Colloidal silver | silver amount | 0.10 mg |
| Fine grain silver iodobromide emulsion (Average grain diameter of 0.06 μm, AgI content of 1 mol %) | silver amount | 0.10 g |
| Gelatin | | 0.40 g |
| Twentieth Layer: Third Protective Layer | | |
| Gelatin | | 0.40 g |

-continued

| | |
|---|---|
| Polymethyl methacrylate (average grain diameter of 1.5 μm) | 0.10 g |
| Copolymer of methyl metahcrylate and acrylic acid in 4:6 (average grain diameter of 1.5 μm) | 0.10 g |
| Silicon oil | 0.030 g |
| Surface active agent W-1 | 3.0 mg |
| Surface active agent W-2 | 0.030 g |

Further, besides above-mentioned components, Additives F-1 to F-8 were added in all emulsion layers. Further, besides above-mentioned components, Gelatin Hardener H-1, and Surface-active agent for coating and emulsifying W-3, W-4, W-5, W-6 were added in all layers.

Further, phenol, 1,2-benzoisothiazoline-3-on, 2-phenoxy ethanol, phenethylalcohol, and butyl p-benzoate were added therein as an anti-sepsis or a mold-preventing agent.

The dispersion of solid dye was prepared in the same manner as in Example 1.

Further, samples 602 and 603 were prepared in the same manner as the thus obtained sample 601, except that the first layer and the 13th layer were modified as described below.

Sample 602: each of coating solutions for the first layer and the 13th layer was coated after the lapse of 6 hours at 40° C.

Sample 603: each of coating solutions for the first layer and the 13th layer, in which the dispersion of solid dye had been subjected to heat treatment at 90° C. for 10 hours, and further the polymer (P-2) for use of the present invention was added in an amount of 3% by weight, was coated after the lapse of 6 hours at 40° C.

With respect to the thus obtained samples, the layer strength at the processing was evaluated in the same manner as in Example 3. At the time, the processing was performed by the use of CR-56, as published by Fuji Photo Film Co., Ltd. As a result, it was found that sample 603 according to the present invention was a light-sensitive material having a satisfactory layer strength in practical use.

TABLE 6

The silver iodobromide emulsions which were used in sample 601 are as follows.

| Name of Emulsion | Characteristics of grains | Spherically equivalent mean grain size (μm) | Coefficient of Deviation (%) | AgI Content (%) |
|---|---|---|---|---|
| A | Monodispersed tetradecahedral grains | 0.28 | 16 | 4.0 |
| B | Monodispersed cubic internal latent image type grains | 0.30 | 10 | 4.0 |
| C | Monodispersed cubic grains | 0.38 | 10 | 5.o |
| D | Monodispersed tabular grains, an aspect ratio of 3.0 | D.68 | 8 | 2.0 |
| E | Monodispersed cubic grains | 0.20 | 17 | 4.0 |
| F | Monodispersed tetradecahedral grains | 0.25 | 16 | 4.o |
| G | Monodispersed cubic internal latent image type grains | 0.40 | 11 | 4.0 |
| H | Monodispersed cubic grains | 0.50 | 9 | 3.5 |
| I | Monodispersed tabular grains, an aspect ratio of 5.0 | 0.80 | 10 | 2.0 |
| | Monodispersed cubic grains | 0.30 | 18 | 4.0 |
| K | Monodispersed tetradecahedral grains | 0.45 | 17 | 4.0 |
| L | Monodispersed tabular grains, an aspect ratio of 5.0 | 0. ss | 10 | 2.0 |
| M | Monodispersed tabular grains, | 0.70 | 13 | 2.0 |

TABLE 6-continued

The silver iodobromide emulsions which were used in sample 601 are as follows.

| Name of Emulsion | Characteristics of grains | Spherically equivalent mean grain size (μm) | Coefficient of Deviation (%) | AgI Content (%) |
|---|---|---|---|---|
| | an aspect ratio of 8.0 | | | |
| N | Monodispersed tabular grains, an aspect ratio of 6.0 | 1.00 | 10 | 1.5 |
| O | Monodispersed tabular grains, an aspect ratio of 9.0 | 1.20 | 15 | 1.5 |

TABLE 7

Spectral sensitization of Emulsions A to I

| Name of Emulsion | Sensitizing dye Added | Amount (g) per 1 mol of silver halide |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |

TABLE 7-continued

Spectral sensitization of Emulsions A to I

| Name of Emulsion | Sensitizing dye Added | Amount (g) per 1 mol of silver halide |
|---|---|---|
| | S-5 | 0.070 |
| | S-9 | 0.10 |

TABLE 8

Spectral sensitization of Emulsions J to N

| Name of Emulsion | Sensitizing dye Added | Amount (g) per 1 mol of silver halide |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

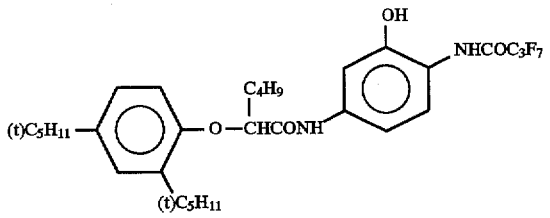

C-1

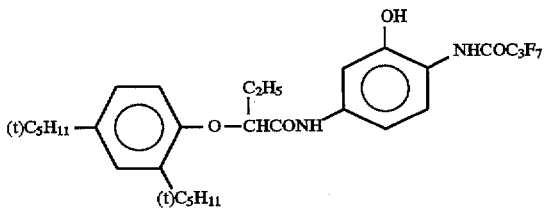

C-2

-continued
C-3
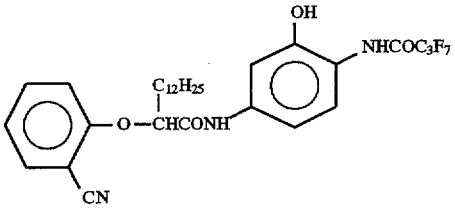
C-4
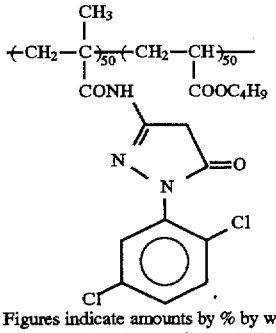
Figures indicate amounts by % by weight.
Av. molecular weight: ca. 25,000
C-5
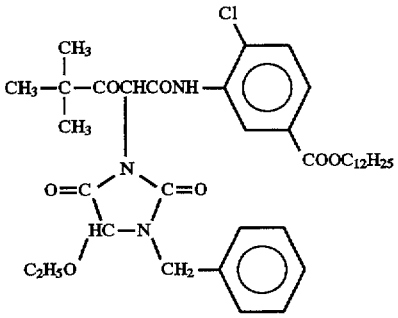
C-6
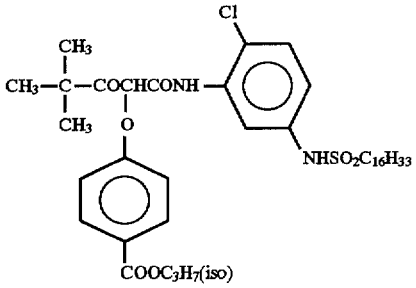
C-7
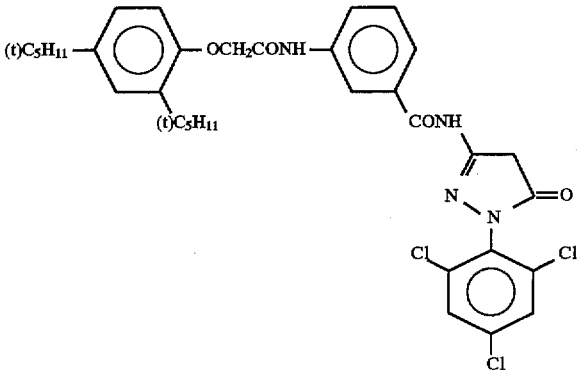

-continued
C-8
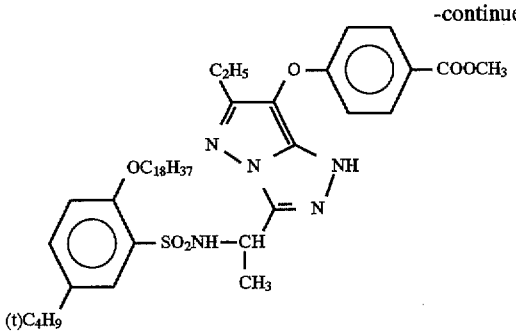
C-9
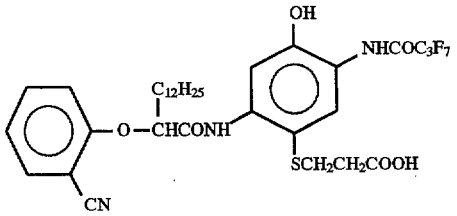
C-10
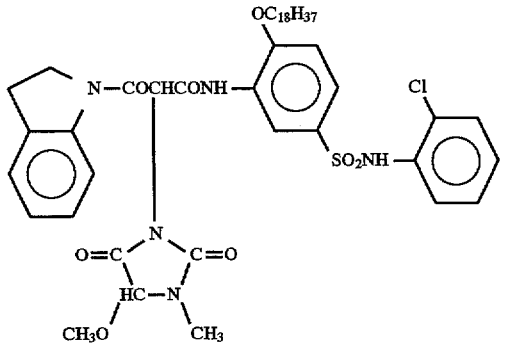
Dibutyl phthalate Oil-1
Tricresyl phosphate Oil-2
Oil-3
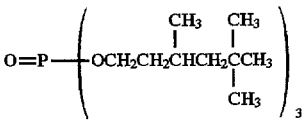
Cpd-A
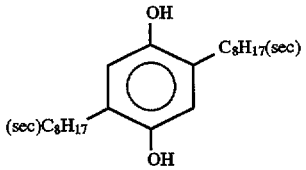
Cpd-B
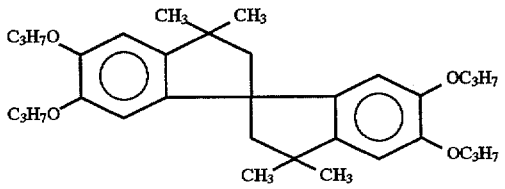
Cpd-C
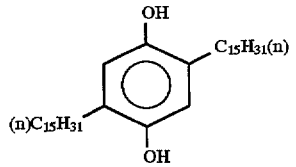

-continued
Cpd-D
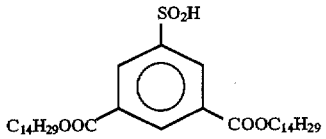
Cpd-E
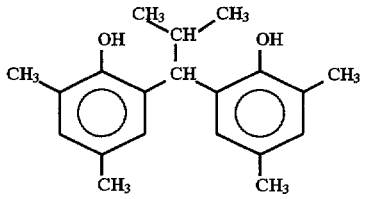
Cpd-F
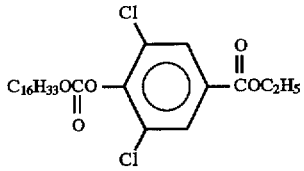
Cpd-H
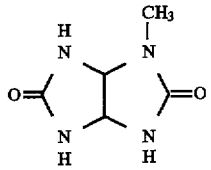
Cpd-I
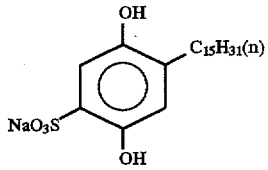
Cpd-J
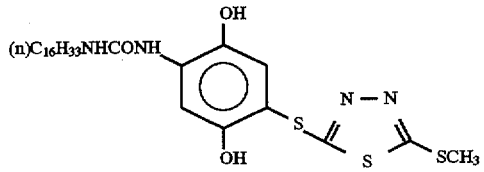
Cpd-K
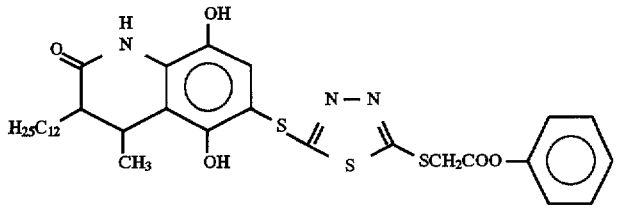
Cpd-L
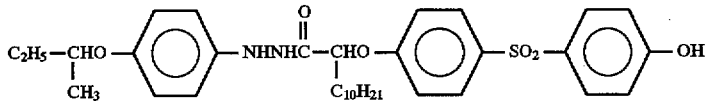
U-1
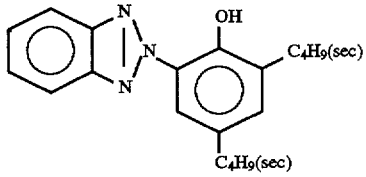

-continued
U-2
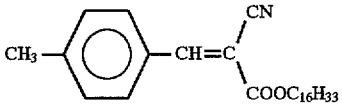
U-3
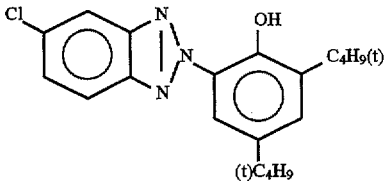
U-4
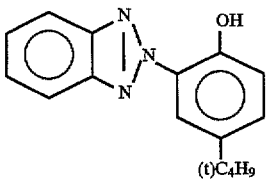
U-5
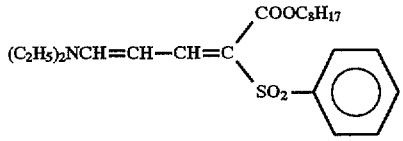
S-1
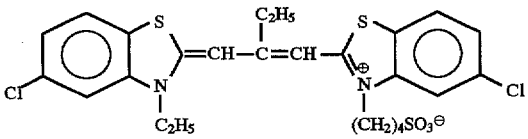
S-2
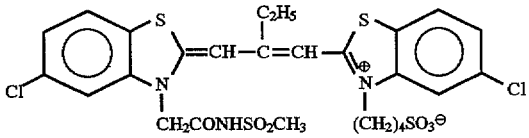
S-3
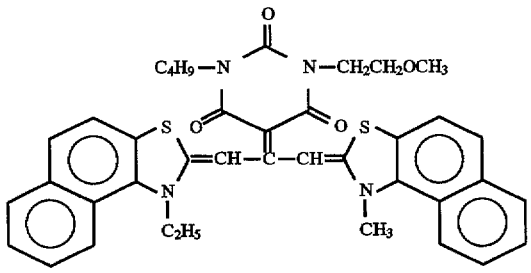
S-4
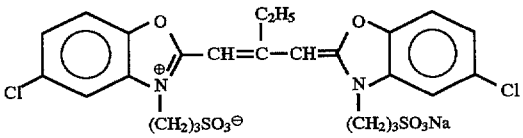
S-5
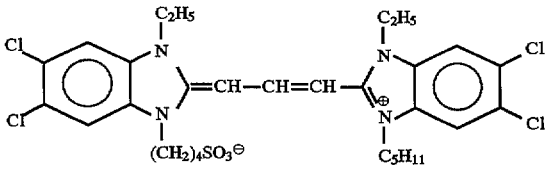

-continued
S-6
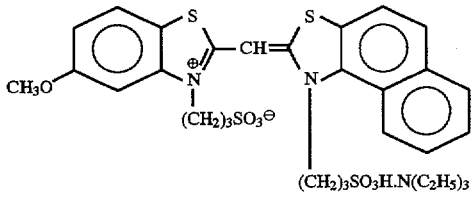
S-7
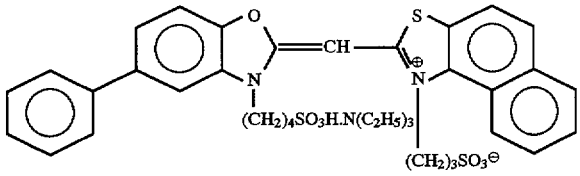
S-8
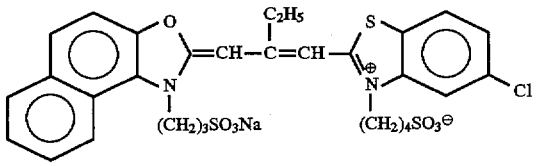
S-9
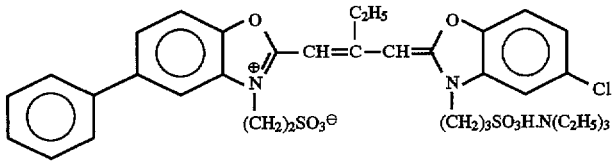
D-1
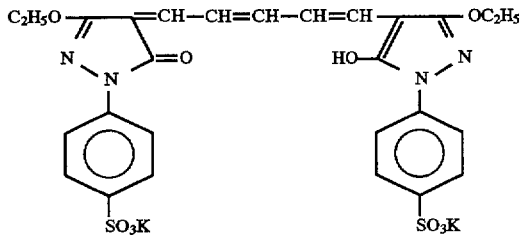
D-2
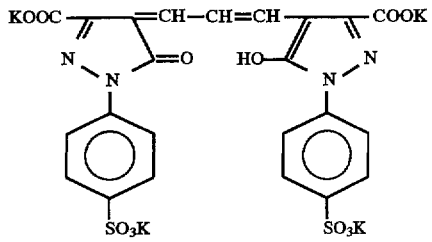
D-3
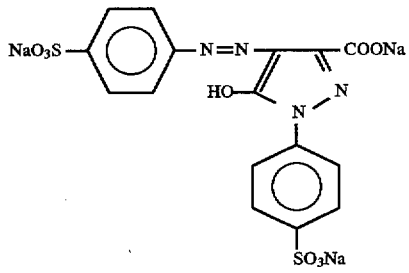

-continued
D-4
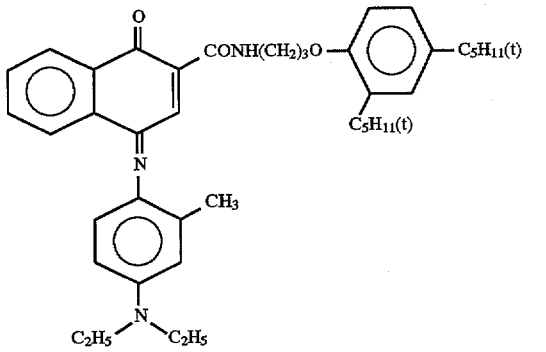
D-5
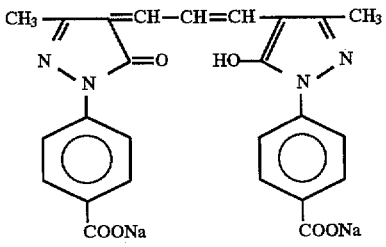
D-6
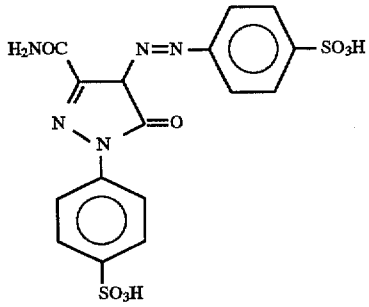
E-1
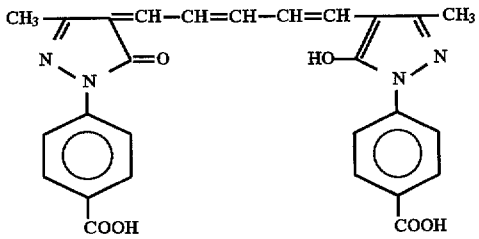
(Exemplified Compound IV-3)
E-2
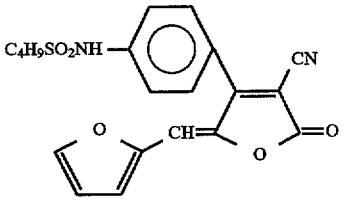
(Exemplified Compound III-26)
E-3
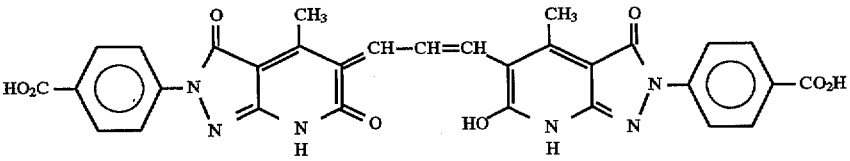
(Exemplified Compound V-1)

-continued
$CH_2{=}CH{-}SO_2{-}CH_2{-}CONH{-}CH_2$
$CH_2{=}CH{-}SO_2{-}CH_2{-}CONH{-}CH_2$ H-1
$C_8F_{17}SO_2NHCH_2CH_2CH_2OCH_2CH_2\overset{\oplus}{N}(CH_3)_3$ W-1
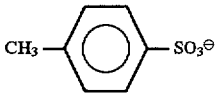
$C_8F_{17}SO_2N(C_3H_7)CH_2COOK$ W-2
$NaO_3S{-}CH(CH_2COOCH_2CH(C_2H_5)C_4H_9)COOCH_2CH(C_2H_5)C_4H_9$ W-3
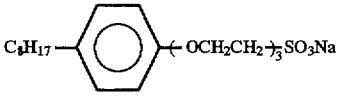
W-4
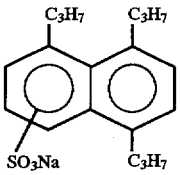
W-5
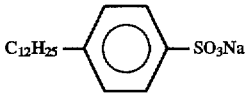
W-6
$\text{-}(CH_2{-}CH(CONHC_4H_9(t))\text{-})_n\text{-}$ P-1
$\text{-}(CH_2{-}CH(COOC_4H_9)\text{-})_n\text{-}$ M-1
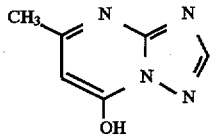
F-1
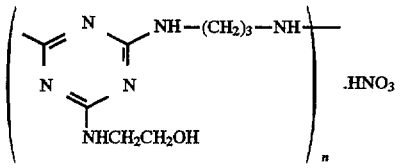
F-2
(n = 3~4)
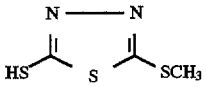
F-3
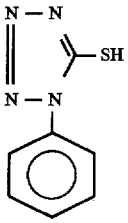
F-4

-continued

F-5

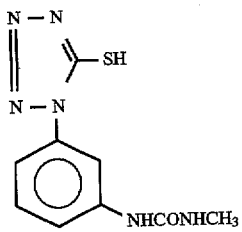

F-6

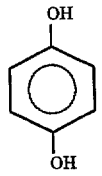

F-7

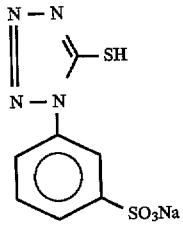

F-8

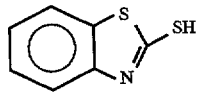

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide photographic light-sensitive material, comprising, in at least one photographic layer constituting the material, a dispersion containing fine grains of a solid dye represented by general formula (II), wherein the solid dye represented by general formula (II) has been subjected to heat treatment at 40° C. or higher, and wherein the dispersion further contains a compound represented by general formula (I):

$$D\text{-}(X)_y \qquad \text{formula (II)}$$

wherein D represents a residue of a compound having a chromophoric group; X represents a dissociating hydrogen atom, or a group having a dissociating hydrogen atom, which atom or group bonds to D directly or via a divalent connecting group; and y is an integer of 1 to 7:

$$P\text{-}(S)_m\text{-}R)_n \qquad \text{formula (I)}$$

wherein R represents a hydrogen atom, a hydrophobic group, or a hydrophobic polymer; P contains at least one of the recurring units A, B, and C as illustrated below, and represents a polymer having a polymerization degree of 10 to 3500; m is 0 or 1, and n is 1 or 2:

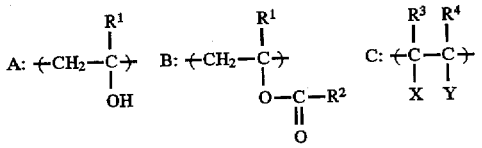

wherein $R^1$ represents a hydrogen atom or an alkyl group having 1 to 6 carbon atom(s); $R^2$ represents a hydrogen atom or an alkyl group having 1 to 10 carbon atom(s); $R^3$ represents a hydrogen atom or a methyl group; $R^4$ represents a hydrogen atom, a methyl group, a —$CH_2COOH$ group or an ammonium salt or metal salt thereof, or a cyano group; X represents a hydrogen atom, a —COOH group or an ammonium salt or metal salt thereof, or a —$CONH_2$ group; and Y represents a —COOH group or an ammonium salt or metal salt thereof, an —$SO_3H$ group or an ammonium salt or metal salt thereof, an —$OSO_3H$ group or an ammonium salt or metal salt thereof, a —$CH_2SO_3H$ group or an ammonium salt or metal salt thereof, a —$CONHC(CH_3)_2$ $CH_2SO_3H$ group or an ammonium salt or metal salt thereof, or a —$CONHCH_2CH_2CH_2N{+}(CH_3)_3Cl$ group, wherein the polymer P comprises an amount of the recurring unit A from 50 mol % to 100 mol %, and an amount of the recurring unit C of 10 mol % or less.

2. The photographic light-sensitive material is claimed in claim 1, wherein, in general formula (II), the group having a dissociating hydrogen atom is a group having a carboxylic acid group.

3. The photographic light-sensitive material as claimed in claim 1, wherein the dye is represented by general formula (III) or IV):

$$A^1{=}L^1{-}(L^2{=}L^3)_m{-}Q \qquad \text{formula (III)}$$

wherein $A^1$ represents an acidic nucleus; Q represents an aryl group or a heterocyclic group; $L^1$, $L^2$, and $L^3$ each represent a methine group; and m is 0, 1, or 2, with the proviso that the compound of general formula (III) has 1 to 7 group(s) selected from a group consisting of a carboxylic acid group, a sulfonamide group, a sulfamoyl group, a sulfonylcarbamoyl group, an acylsulfamoyl group, a phenolic hydroxyl group, and an enol group of an oxonol dye, as a water-soluble group in its molecule:

$$A^1{=}L^1{-}(L^2{=}L^3)_n{-}A^2 \qquad \text{formula (IV)}$$

wherein $A^1$ and $A^2$ each represent an acidic group; $L^1$, $L^2$, and $L^3$ each represent a methine group; and n is 0, 1, 2, or 3, with the proviso that the compound of general formula (IV) has 1 to 7 group(s) selected from a group consisting of a carboxylic acid group, a sulfonamide group, a sulfamoyl group, a sulfonylcarbamoyl group, an acylsulfamoyl group, a phenolic hydroxyl group, and an enol group of an oxonol dye, as a water-soluble group in its molecule.

4. The photographic light-sensitive material as claimed in claim 1, wherein the dye is represented by general formula (V):

formula (V)

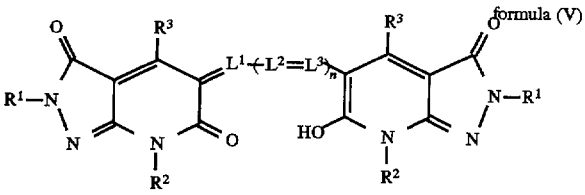

n = 1 or 2 wherein $R^1$ represents a hydrogen atom, an alkyl group, an aryl group, or a heterocyclic group; $R^2$ represents a hydrogen atom, an alkyl group, an aryl group, a heterocyclic group, a $—COR^4$ group, or an $—SO_2R^4$ group; $R^3$ represents a hydrogen atom, a cyano group, a hydroxyl group, a carboxyl group, an alkyl group, an aryl group, a $—CO_2R^4$ group, an $—OR^4$ group, an $—NR^5R^6$ group, a $—CONR^5R^6$ group, an $—NR^5COR^4$ group, an $—NR^5SO_2R^4$ group, or an $—NR^5CONR^5R^6$ group, wherein $R^4$ represents an alkyl group or an aryl group, and wherein $R^5$ and $R^6$ each represent a hydrogen atom, an alkyl group, or an aryl group; $L^1$, $L^2$, and $L^3$ each represent a methine group; and n is 1 or 2.

5. The silver halide photographic light-sensitive material as claimed in claim 1, wherein the compound of general formula (I) is mixed with the dispersion after the preparation of the dispersion of the dye.

6. The silver halide photographic light-sensitive material as claimed in 1, wherein the amount of the recurring unit C constituting the polymer P is 1 mol % or less.

7. The silver halide photographic light-sensitive material as claimed in claim 1, wherein the polymer P consists of the recurring unit A or of the recurring units A and B.

8. The silver halide photographic light-sensitive material as claimed in claim 1, wherein said heat treatment of said dye is performed upon a dispersion of said dye having a pH of from 2.0 to 8.0.

9. The silver halide photographic light-sensitive material as claimed in claim 1, wherein the polymer P comprises an amount of the recurring unit A from 50 mol % to 100 mol % and an amount of the recurring unit C of 1 mol % or less.

10. The silver halide photographic light-sensitive material as claimed in claim 1, wherein the polymer P comprises an amount of the recurring unit A from 80 mol % to 100 mol % and an amount of the recurring C of 10 mol % or less.

11. The silver halide light-sensitive material as claimed in claim 10, wherein the amount of the recurring unit C is 1 mol % or less.

* * * * *